US008933853B2

(12) United States Patent
Asanuma et al.

(10) Patent No.: US 8,933,853 B2
(45) Date of Patent: Jan. 13, 2015

(54) SMALL ANTENNA APPARATUS OPERABLE IN MULTIPLE BANDS

(75) Inventors: Kenichi Asanuma, Kyoto (JP); Atsushi Yamamoto, Kyoto (JP); Tsutomu Sakata, Osaka (JP)

(73) Assignee: Panasonic Intellectual Property Corporation of America, Torrance, CA (US)

( * ) Notice: Subject to any disclaimer, the term of this patent is extended or adjusted under 35 U.S.C. 154(b) by 184 days.

(21) Appl. No.: 13/814,833

(22) PCT Filed: Jan. 31, 2012

(86) PCT No.: PCT/JP2012/000617

§ 371 (c)(1),
(2), (4) Date: Feb. 7, 2013

(87) PCT Pub. No.: WO2013/008356

PCT Pub. Date: Jan. 17, 2013

(65) Prior Publication Data

US 2013/0135164 A1 May 30, 2013

(30) Foreign Application Priority Data

Jul. 11, 2011 (JP) ..... 2011-152744

(51) Int. Cl.
*H01Q 9/00* (2006.01)
*H01Q 1/24* (2006.01)
(Continued)

(52) U.S. Cl.
CPC ..... *H01Q 5/0034* (2013.01); *H01Q 5/01* (2013.01); *H01Q 7/00* (2013.01); *H01Q 9/26* (2013.01)
USPC ..... 343/749; 343/702

(58) Field of Classification Search
CPC ..... H01Q 1/243; H01Q 5/01; H01Q 5/0034; H01Q 7/00; H01Q 9/26
USPC ..... 343/702, 722, 741, 742, 744, 749
See application file for complete search history.

(56) References Cited

U.S. PATENT DOCUMENTS 6,163,300 A 12/2000 Ishikawa et al.
8,094,080 B2 * 1/2012 Komura ..... 343/702

(Continued)

FOREIGN PATENT DOCUMENTS

JP 11-55022 2/1999
JP 2001-185938 7/2001

(Continued)

OTHER PUBLICATIONS

International Preliminary Report on Patentability and Written Opinion of the International Searching Authority issued Jan. 23, 2014 in International (PCT) Application No. PCT/JP2012/000617.

(Continued)

*Primary Examiner* — Robert Karacsony
(74) *Attorney, Agent, or Firm* — Wenderoth, Lind & Ponack, L.L.P.

(57) ABSTRACT

In a radiator, a large loop is formed by radiation conductors, first and second capacitors, and first and second inductors, and a small loop is formed by portions of the radiation conductors close to each other, the second capacitor, and the second inductor. The radiator is configured such that its first portion, second portion, and third portion resonate at predetermined frequencies, respectively. The first portion extends along the large loop, and includes the first inductor, the first capacitor, and one of the second inductor and the second capacitor. The second portion includes a section extending from a feed point to a second position through one of the first inductor and the first capacitor, and includes the small loop. The third portion includes a section extending from the feed point to the second position through the first capacitor.

16 Claims, 53 Drawing Sheets

(51) Int. Cl.

| | |
|---|---|
| ***H01Q 5/00*** | (2006.01) |
| ***H01Q 5/01*** | (2006.01) |
| ***H01Q 7/00*** | (2006.01) |
| ***H01Q 9/26*** | (2006.01) |

(56) References Cited

U.S. PATENT DOCUMENTS

| | | | |
|---|---|---|---|
| 2003/0034917 | A1 | 2/2003 | Nishizawa et al. |
| 2005/0243001 | A1 | 11/2005 | Miyata et al. |
| 2009/0167619 | A1 | 7/2009 | Yagi |

FOREIGN PATENT DOCUMENTS

| | | |
|---|---|---|
| JP | 4003077 | 11/2007 |
| JP | 2009-111999 | 5/2009 |
| JP | 2009-159480 | 7/2009 |

OTHER PUBLICATIONS

International Search Report issued Apr. 3, 2012 in International (PCT) Application No. PCT/JP2012/000617.

* cited by examiner

SMALL ANTENNA APPARATUS OPERABLE IN MULTIPLE BANDS

The present invention relates to an antenna apparatus mainly for use in mobile communication such as mobile phones, and relates to a wireless communication apparatus provided with the antenna apparatus.

BACKGROUND ART

The size and thickness of portable wireless communication apparatuses, such as mobile phones, have been rapidly reduced. In addition, the portable wireless communication apparatuses have been transformed from apparatuses to be used only as conventional telephones, to data terminals for transmitting and receiving electronic mails and for browsing web pages of WWW (World Wide Web), etc. Further, since the amount of information to be handled has increased from that of conventional audio and text information to that of pictures and videos, a further improvement in communication quality is required. In such circumstances, there are proposed a multiband antenna apparatus and a compact antenna apparatus, supporting a plurality of wireless communication schemes. Further, there is proposed an array antenna apparatus capable of reducing electromagnetic coupling among antenna apparatuses each corresponding to the above mentioned one, and thus, performing high-speed wireless communication.

According to an invention of Patent Literature 1, a two-frequency antenna is characterized by having: a feeder, an inner radiation element connected to the feeder, and an outer radiation element, all of which are printed on a first surface of a dielectric board; an inductor formed in a gap between the inner radiation element and the outer radiation element printed on the first surface of the dielectric board to connect the two radiation elements; a feeder, an inner radiation element connected to the feeder, and an outer radiation element, all of which are printed on a second surface of the dielectric board; and an inductor formed in a gap between the inner radiation element and the outer radiation element printed on the second surface of the dielectric board to connect the two radiation elements. The two-frequency antenna of Patent Literature 1 is operable in multiple bands by forming a parallel resonant circuit from the inductor provided between the radiation elements and a capacitance between the radiation elements.

According to an invention of Patent Literature 2, a multiband antenna includes an antenna element having a first radiation element and a second radiation element connected to respective opposite ends of an LC parallel resonance circuit, and is characterized in that the LC parallel resonant circuit is constituted of self-resonance of an inductor itself. The multiband antenna of Patent Literature 2 is operable in multiple bands due to the LC parallel resonant circuit constituted of the self-resonance of the inductor of a whip antenna itself.

CITATION LIST

Patent Literature

PATENT LITERATURE 1: Japanese Patent Laid-open Publication No. 2001-185938

PATENT LITERATURE 2: Japanese Patent Laid-open Publication No. H11-055022

PATENT LITERATURE 3: Japanese Patent No. 4003077

SUMMARY OF INVENTION

Technical Problem

In recent years, there has been an increasing need to increase the data transmission rate on mobile phones, and thus, a next generation mobile phone standard, 3G-LTE (3rd Generation Partnership Project Long Term Evolution) has been studied. According to 3G-LTE, as a new technology for an increased the wireless transmission rate, it is determined to use a MIMO (Multiple Input Multiple Output) antenna apparatus using a plurality of antennas to simultaneously transmit or receive radio signals of a plurality of channels by spatial division multiplexing. The MIMO antenna apparatus uses a plurality of antennas at each of a transmitter and a receiver, and spatially multiplexes data streams, thus increasing a transmission rate. Since the MIMO antenna apparatus uses the plurality of antennas so as to simultaneously operate at the same frequency, electromagnetic coupling between the antennas becomes very strong under circumstances where the antennas are disposed close to each other within a small-sized mobile phone. When the electromagnetic coupling between the antennas becomes strong, the radiation efficiency of the antennas degrades. Therefore, received radio waves are weakened, resulting in a reduced transmission rate. Hence, it is necessary to provide an low coupling array antenna in which a plurality of antennas are disposed close to each other. In addition, in order to implement spatial division multiplexing, it is necessary for the MIMO antenna apparatus to simultaneously transmit or receive a plurality of radio signals having a low correlation therebetween, by using different radiation patterns, polarization characteristics, or the like. Furthermore, a technique for increasing the bandwidth of antennas is required in order to increase communication rate.

According to the two-frequency antenna of Patent Literature 1, if decreasing the low-band operating frequency, the size of the radiation elements should be increased. In addition, no contribution to radiation is made by slits between the inner radiation elements and the outer radiation elements.

According to the multiband antenna of Patent Literature 2, if the antenna is to operate in a low band, the element lengths of the radiation elements should be increased. In addition, no contribution to radiation is made by the LC parallel resonant circuit.

Therefore, it is desired to provide an antenna apparatus capable of achieving both multiband operation and size reduction.

An object of the present invention is to solve the above-described problems, and to provide an antenna apparatus capable of achieving both multiband operation and size reduction, and to provide a wireless communication apparatus provided with such an antenna apparatus.

Solution to Problem

According to the first aspect of the present invention, an antenna apparatus is provided with at least one radiator. Each of the at least one radiator is provided with: a looped radiation conductor forming a first loop, and having a feed point, a first position, a second position, and a third position, which are arranged in this order along the first loop; a first inductor inserted at the first position of the radiation conductor; a first capacitor inserted at the third position of the radiation conductor; and a second inductor and a second capacitor inserted parallel to each other at the second position of the radiation conductor. A second loop is formed by the second position of the radiation conductor, portions of the radiation conductor close to the second position, the second inductor, and the second capacitor. Each of the at least one radiator is excited through the feed point at at least two of a first frequency, a second frequency higher than the first frequency, and a third frequency higher than the second frequency. Each of the at least one radiator includes: (A) a first portion of the radiator along the first loop, the first portion including the first inductor, the first capacitor, and one of the second inductor and the second capacitor; (B) a second portion of the radiator including a section along the first loop, the section extending from the feed point to the second position through one of the first inductor and the first capacitor, and the second portion including the second loop; and (C) a third portion of the radiator including a section along the first loop, the section extending from the feed point to the second position through the first capacitor, or the section extending from the feed point to the first position through the first capacitor and one of the second inductor and the second capacitor. Each of the at least one radiator is configured such that at least two of the first, second, and third portions resonate, and the radiator resonates at the first frequency when the first portion resonates, the radiator resonates at the second frequency when the second portion resonates, and the radiator resonates at the third frequency when the third portion resonates.

In the antenna apparatus, the radiation conductor includes a first radiation conductor and a second radiation conductor. At least one of the first and second capacitors is formed by a capacitance between the first and second radiation conductors.

In the antenna apparatus, at least one of the first and second capacitors includes a plurality of capacitors connected in series.

In the antenna apparatus, at least one of the first and second inductors includes an inductor made of a strip conductor.

In the antenna apparatus, at least one of the first and second inductors includes an inductor made of a meander conductor.

In the antenna apparatus, at least one of the first and second inductors includes a plurality of inductors connected in series.

The antenna apparatus is further provided with a ground conductor.

In the antenna apparatus, The antenna apparatus is provided with a printed circuit board provided with the ground conductor, and a feed line connected to the feed point. The radiator is formed on the printed circuit board.

The antenna apparatus is a dipole antenna including at least a pair of radiators.

The antenna apparatus is provided with a plurality of radiators, and the plurality of radiators have different first frequencies, different second frequencies, and different third frequencies, respectively.

In the antenna apparatus, the radiation conductor is bent at at least one position.

The antenna apparatus is provided with a plurality of radiators connected to different signal sources.

The antenna apparatus is provided with a first radiator and a second radiator configured symmetrically with respect to a reference axis. A first inductor of the second radiator is provided at a position corresponding to a position of a first capacitor of the first radiator, and a first capacitor of the second radiator is provided at a position corresponding to a position of a first inductor of the first radiator.

In the antenna apparatus, a second inductor of the second radiator is provided at a position corresponding to a position of a second-capacitor of the first radiator, and a second capacitor of the second radiator is provided at a position corresponding to a position of a second inductor of the first radiator.

In the antenna apparatus, the first and second radiators are shaped such that a distance between the first and second radiators gradually increases as a distance from the feed points of the first and second radiators along the reference axis increases.

According to the second aspect of the present invention, a wireless communication apparatus is provided with an antenna apparatus of the first aspect of the present invention.

Advantageous Effects of Invention

According to the antenna apparatus of the present invention, it is possible to provide an antenna apparatus operable in multiple bands, while having a simple and small configuration. In addition, when the antenna apparatus of the present invention includes a plurality of radiators, the antenna apparatus has low coupling between antenna elements, and thus, is operable to simultaneously transmit or receive a plurality of radio signals. In addition, according to the present invention, it is possible to provide a wireless communication apparatus provided with such an antenna apparatus.

DESCRIPTION OF EMBODIMENTS

Embodiments of the present invention will be described below with reference to the drawings. Note that like components are denoted by the same reference signs.

First Embodiment

Figure 1:
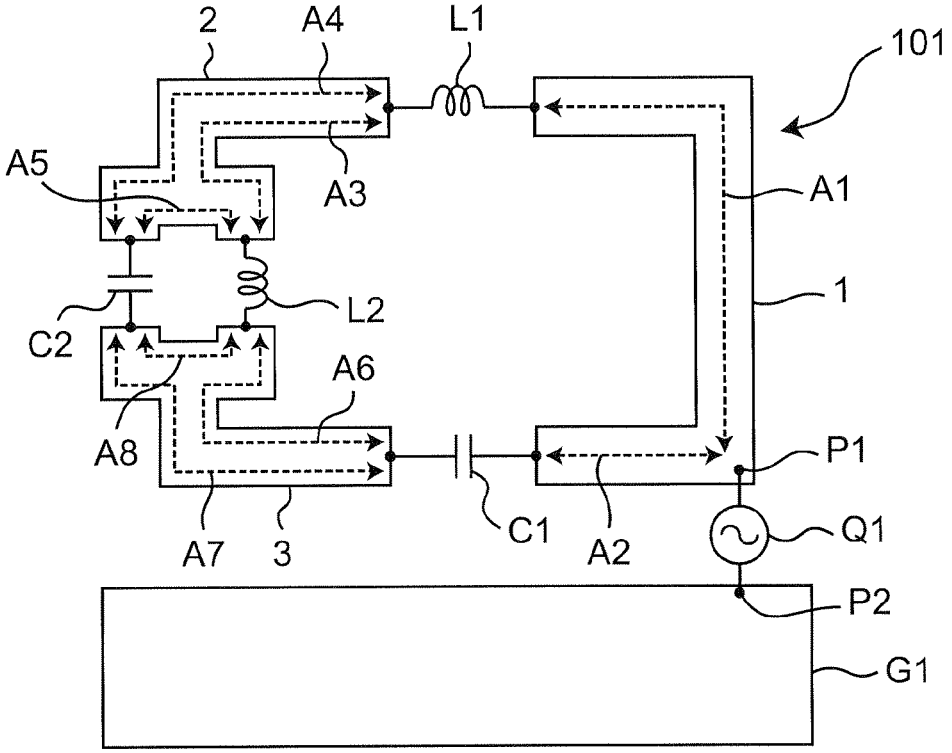
FIG. 1 is a plan view showing an antenna apparatus according to a first embodiment of the present invention.

FIG. 1 is a plan view showing an antenna apparatus according to a first embodiment of the present invention. The antenna apparatus of the present embodiment is characterized by using a single radiator 101 for triple-band operation.

Referring to FIG. 1, the radiator 101 has a first radiation conductor 1 having a certain electrical length, a second radiation conductor 2 having a certain electrical length, a third radiation conductor 3 having a certain electrical length, an inductor L1 connecting the radiation conductors 1 and 2 to each other at a certain position, a capacitor C1 connecting the radiation conductors 1 and 3 to each other at a certain position, and a capacitor C2 and an inductor L2 each connecting the radiation conductors 2 and 3 to each other at certain positions. The capacitor C2 and the inductor L2 are connected in parallel to each other. In the radiator 101, the radiation conductors 1, 2, and 3, the capacitors C1 and C2, and the inductors L1 and L2 form a first loop surrounding a central hollow portion (hereinafter, referred to as a "large loop"), and portions of the radiation conductors 2 and 3 close to each other, the capacitor C2, and the inductor L2 form a second loop having a different resonance frequency from that of the first loop (hereinafter, referred to as a "small loop"). Further, a feed point P1 is provided on the radiation conductor 1. Therefore, the radiation conductors have the feed point P1, a first position, a second position, and a third position, which are arranged in this order along the large loop. The inductor L1 is inserted at the first position, the inductor L2 and the capacitor C2 are inserted parallel to each other at the second position different from the first position, and the capacitor C1 is inserted at the third position different from the first and second positions. In other words, with respect to the inductor L1 and the capacitor C1 as boundaries along the large loop, the feed point P1 is provided on one side (i.e., on the radiation conductor 1), and the inductor L2 and the capacitor C2 are provided on the other side (i.e., between the radiation conductors 2 and 3). A signal source Q1 schematically shows a wireless communication circuit connected to the antenna apparatus of FIG. 1. The signal source Q1 generates a radio-frequency signal having a first frequency within a low frequency band (hereinafter, referred to as a "low-band resonance frequency f1"), a radio-frequency signal having a second frequency within a middle frequency band and higher than the first frequency (hereinafter, referred to as a "mid-band resonance frequency f2"), and a radio-frequency signal having a third frequency within a high frequency band and higher than the second frequency (hereinafter, referred to as a "high-band resonance frequency f3"). The signal source Q1 is connected to the feed point P1 on the radiation conductor 1, and is connected to a connecting point P2 on aground conductor G1 close to the radiator 101. In the radiator 101, current paths for the cases where the antenna apparatus is excited at the low-band resonance frequency f1, the mid-band resonance frequency f2, and the high-band resonance frequency f3 differ from one another, and thus, it is possible to effectively achieve triple-band operation.

The antenna apparatus of the present embodiment uses, for example, frequencies in the 900 MHz band as the low-range resonance frequency f1, frequencies in the 1500 MHz band as the mid-range resonance frequency f2, and frequencies in the 1900 MHz band as the high-range resonance frequency f3, as will be described in implementation examples described later. However, the frequencies are not limited thereto.

Figure 2:
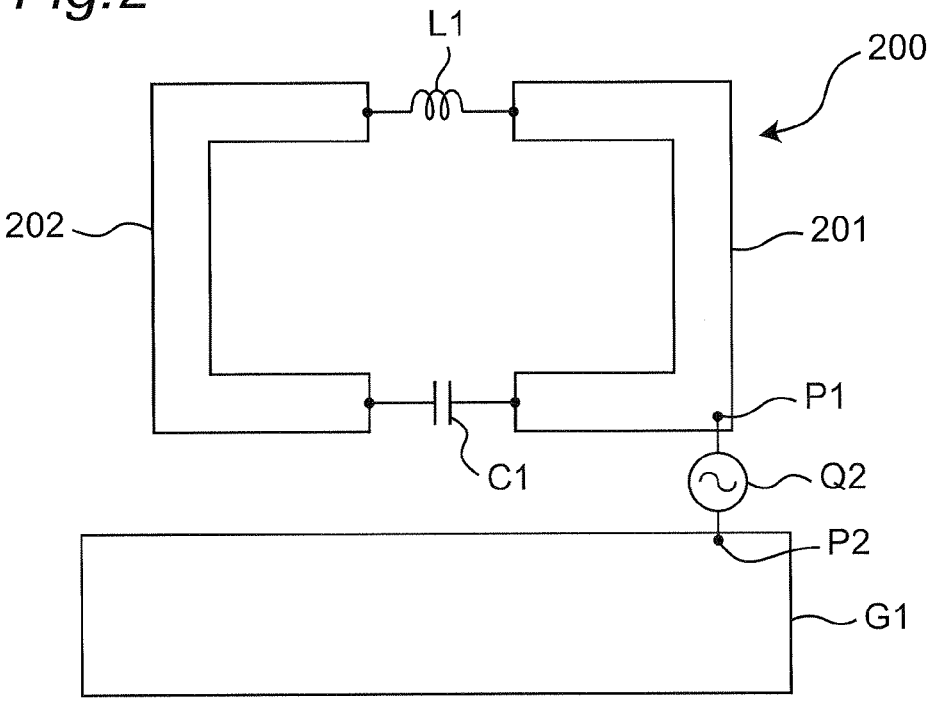
FIG. 2 is a plan view showing an antenna apparatus according to a comparison example of the first embodiment of the present invention.

FIG. 2 is a plan view showing an antenna apparatus according to a comparison example of the first embodiment of the present invention. The applicant proposed, in Japanese Patent Application No. 2011-057555, an antenna apparatus characterized by a single radiator operable in dual bands, and FIG. 2 shows that antenna apparatus. In a radiator 200 of FIG. 2, a loop surrounding a central hollow portion is formed by radiation conductors 201 and 202, a capacitor C1, and an inductor L1. Therefore, the radiator 200 has the radiation conductor 202, instead of the radiation conductors 2 and 3, the inductor L2, and the capacitor C2 of FIG. 1. A signal source Q2 generates a radio-frequency signal having the low-band resonance frequency f1 and a radio-frequency signal having the high-band resonance frequency f2, and the signal source Q2 is connected to a feed point P1 on the radiation conductor 201, and connected to a connecting point P2 on a ground conductor G1 close to the radiator 200. In the radiator 200, a current path for the case where the antenna apparatus is excited at the low-band resonance frequency f1 differs from a current path for the case where the antenna apparatus is excited at the high-band resonance frequency f2, and thus, it is possible to effectively achieve dual-band operation.

Triple-band operation of the present invention will be described below with reference to FIGS. 3 to 6.

Figure 3:
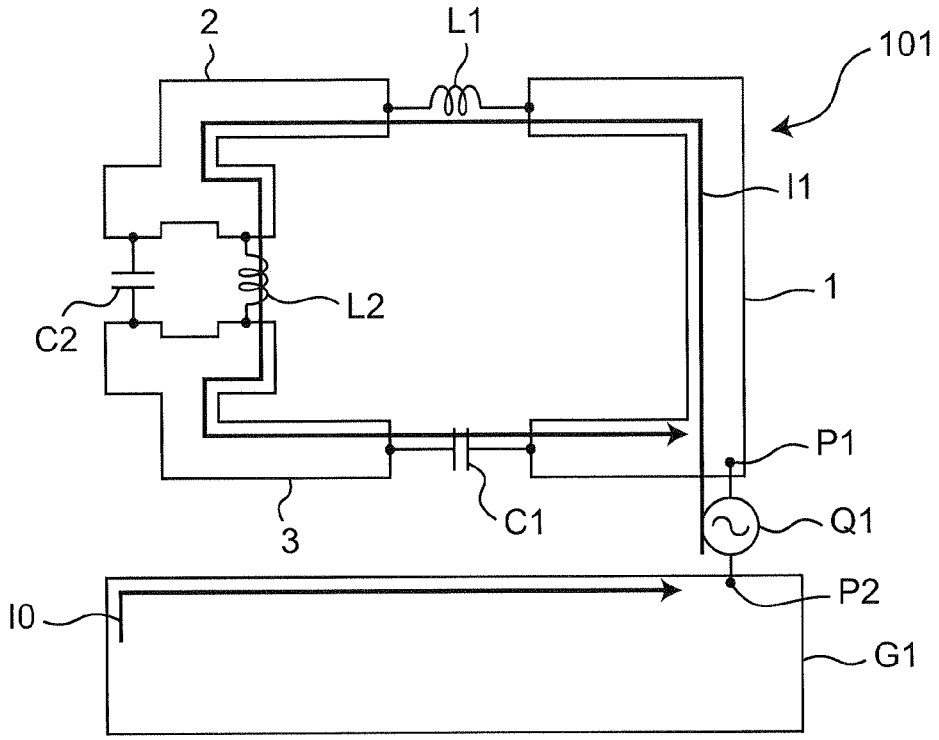
FIG. 3 is a diagram showing a current path for the case where the antenna apparatus of FIG. 1 operates at a low-band resonance frequency f1.

FIG. 3 is a diagram showing a current path for the case where the antenna apparatus of FIG. 1 operates at the low-band resonance frequency f1. By nature, a current having a low frequency component can pass through an inductor (low impedance), but is difficult to pass through a capacitor (high impedance). Hence, a current I1, for the case where the antenna apparatus operates at the low-band resonance frequency f1, flows through a portion of the radiation conductor 1 from the feed point P1 to a point connected to the inductor L1, passes through the inductor L1, flows through a portion of the radiation conductor 2 from a point connected to the inductor L1, to a point connected to the inductor L2 or the capacitor C2, passes through the inductor L2 or the capacitor C2, and flows through a portion of the radiation conductor 3 to a point to which the capacitor C1 is connected. Whether the current I1 passes through the inductor L2 or the capacitor C2 is determined by the impedances of the inductor L2 and the capacitor C2 obtained when the antenna apparatus operates at the low-band resonance frequency f1 (details will be described later). FIG. 3 shows the case in which the current I1 flows through the inductor L2. Further, due to a voltage difference across both ends of the capacitor C1, a current flows through a portion of the radiation conductor 1 from a point connected to the capacitor C1, to the feed point P1, and is connected to the current I1. Hence, it can be considered that the current I1 substantially also passes through the capacitor C1. The current I1 flows strongly along an inner edge of the large loop, close to the central hollow portion. The radiator 101 is configured such that when the antenna apparatus operates at the low-band resonance frequency f1, the current I1 flows through a current path as shown in FIG. 3, and the inductor L1, the capacitor C1, the inductor L2 or the capacitor C2, and portions of the radiation conductors along the large loop resonate at the low-band resonance frequency f1. Specifically, the radiator 101 is configured such that the sum of electrical lengths along the current path of the current I1 (i.e., referring to FIG. 1, the sum of an electrical length A1 of the portion of the radiation conductor 1 from the feed point P1 to the point connected to the inductor L1, an electrical length of the inductor L1, an electrical length of the capacitor C1, an electrical length A3 or A4 of the portion of the radiation conductor 2 from the point connected to the inductor L1 to the point connected to the inductor L2 or the capacitor C2, an electrical length of the inductor L2 or the capacitor C2, an electrical length A6 or A7 of the portion of the radiation conductor 3 from the point connected to the inductor L2 or the capacitor C2 to the point connected to the capacitor C1, and an electrical length A2 of the portion of the radiation conductor 1 from the point connected to the capacitor C1 to the feed point P1) is an electrical length at which the radiator 101 resonates at the low-band resonance frequency f1. The electrical length at which the radiator 101 resonates is, for example, 0.2 to 0.25 times of an operating wavelength of the low-band resonance frequency f1. In addition, a current I0 flows along a portion of the ground conductor G1, the portion being close to the radiator 101, and flows toward the connecting point P2.

When the antenna apparatus operates at the low-band resonance frequency f1, the current I1 flows through the current path as shown in FIG. 3, and accordingly, the large loop of the radiator 101 operates in a loop antenna mode, i.e., a magnetic current mode. Since the radiator 101 operates in the loop antenna mode, it is possible to achieve a long resonant length while maintaining a compact form, thus achieving good characteristics even when the antenna apparatus operates at the low-band resonance frequency f1. In addition, when the radiator 101 operates in the loop antenna mode, the radiator 101 has a high Q factor. The wider the central hollow portion of the large loop is (i.e., the larger the diameter of the large loop is), the more the radiation efficiency of the antenna apparatus improves.

Figure 4:
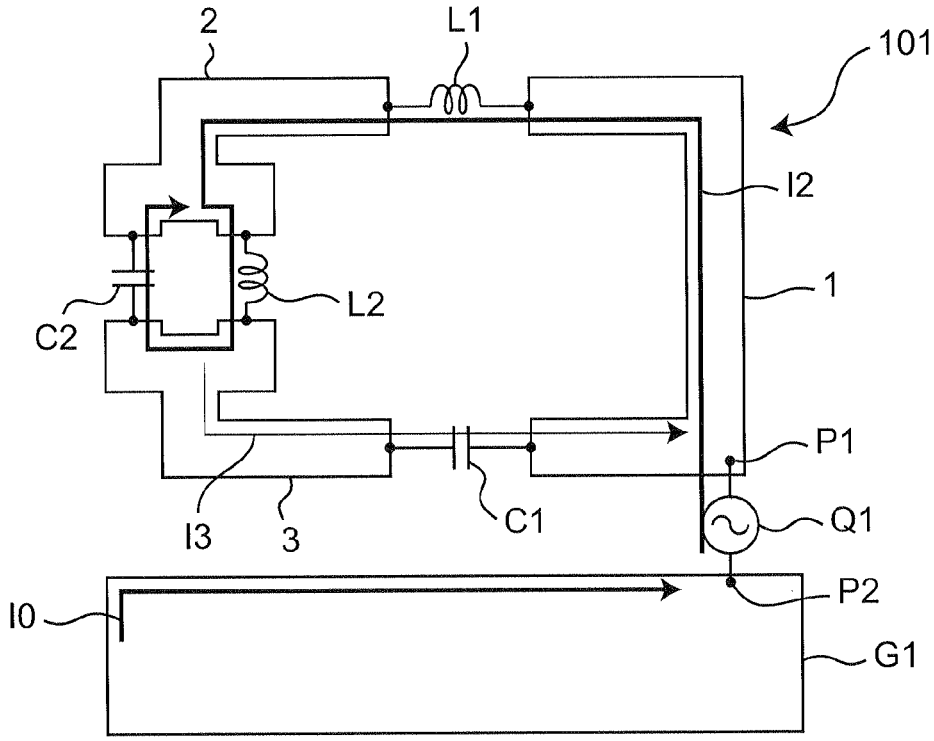
FIG. 4 is a diagram showing a first current path for the case where the antenna apparatus of FIG. 1 operates at a mid-band resonance frequency f2.

FIG. 4 is a diagram showing a first current path for the case where the antenna apparatus of FIG. 1 operates at the mid-band resonance frequency f2. Whether a current for the case where the antenna apparatus operates at the mid-band resonance frequency f2 passes through the inductor L1 or the capacitor C1 is determined by the impedances of the inductor L1 and the capacitors C1 obtained when the antenna apparatus operates at the mid-band resonance frequency f2 (details will be described later). FIG. 4 shows a current I2 passing through the inductor L1 when the antenna apparatus operates at the mid-band resonance frequency f2. The current I2 for the case where the antenna apparatus operates at the mid-band resonance frequency f2 flows through a portion of the radiation conductor 1 from the feed point P1 to a point connected to the inductor L1, passes through the inductor L1, flows through a portion of the radiation conductor 2 from a point connected to the inductor L1, to a point connected to the inductor L2 or the capacitor C2, and then, flows along the small loop. Whether the current I2 flows toward the inductor L2 or the capacitor C2 is determined by the impedances of the inductor L2 and the capacitor C2 obtained when the antenna apparatus operates at the mid-band resonance frequency f2 (details will be described later). FIG. 4 shows the case in which the current I2 flows toward the inductor L2. After passing through the inductor L2, the current I2 flows through a portion of the radiation conductor 3 from a point connected to the inductor L2, to a point connected to the capacitor C2, and further passes through the capacitor C2, and flows through a portion of the radiation conductor 2 from a point connected to the capacitor C2, to a point connected to the inductor L2, and then, is connected to the current I2. At this time, a partial current I3 flows from the small loop, through the capacitor C1, toward the feed point P1. The radiator 101 is configured such that when the antenna apparatus operates at the mid-band resonance frequency f2, the current I2 flows through a current path as shown in FIG. 4, and a portion of the radiator 101, the portion including a section along the large loop, the section extending from the feed point P1 through the inductor L1 to the position of the small loop, and the portion including the small loop, resonates at the mid-band resonance frequency f2. Specifically, the radiator 101 is configured such that the sum of electrical lengths along the current path of the current I2 (i.e., referring to FIG. 1, the sum of the electrical length A1 of the portion of the radiation conductor 1 from the feed point P1 to the point connected to the inductor L1, the electrical length of the inductor L1, the electrical length A3 or A4 of the portion of the radiation conductor 2 from the point connected to the inductor L1 to the point connected to the inductor L2 or the capacitor C2, an electrical length A5 of the portion of the radiation conductor 2 from the point connected to the inductor L2 to the point connected to the capacitor C2, the electrical lengths of the inductor L2 and the capacitor C2, and an electrical length A8 of the portion of the radiation conductor 3 from the point connected to the inductor L2 to the point connected to the capacitor C2) is an electrical length at which the radiator 101 resonates at the mid-band resonance frequency f2. The electrical length at which the radiator 101 resonates is, for example, 0.25 times of an operating wavelength of the mid-band resonance frequency f2. In addition, a current I0 flows along a portion of the ground conductor G1, the portion being close to the radiator 101, and flows toward the connecting point P2.

Figure 5:
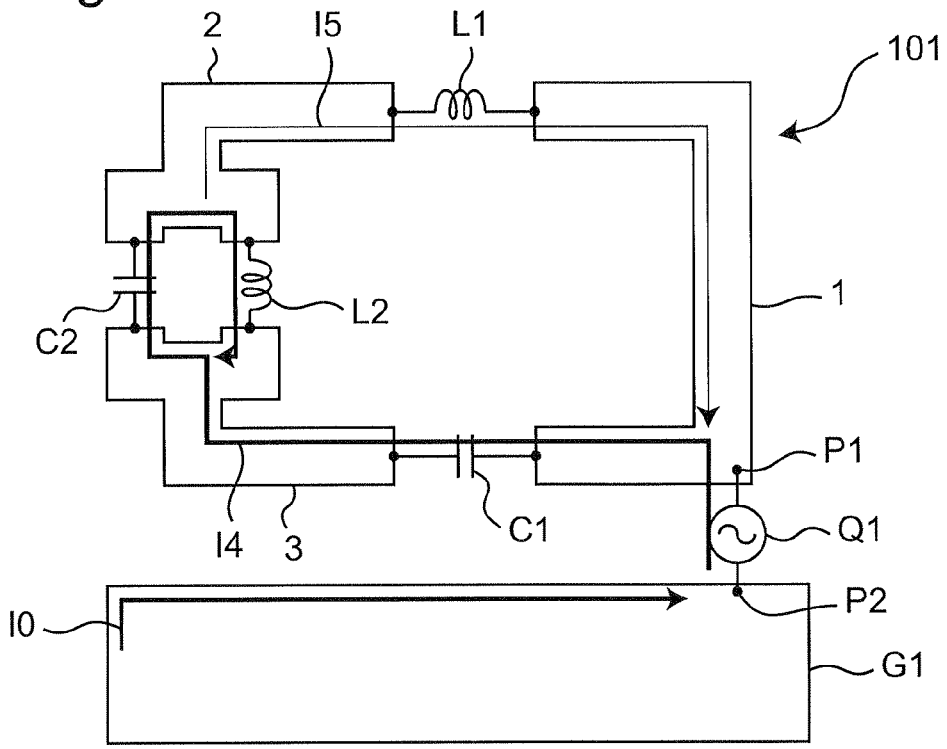
FIG. 5 is a diagram showing a second current path for the case where the antenna apparatus of FIG. 1 operates at the mid-band resonance frequency f2.

FIG. 5 is a diagram showing a second current path for the case where the antenna apparatus of FIG. 1 operates at the mid-band resonance frequency f2. FIG. 5 shows a current I4 passing through the capacitor C1 when the antenna apparatus operates at the mid-band resonance frequency f2. The current I4 for the case where the antenna apparatus operates at the mid-band resonance frequency f2 flows through a portion of the radiation conductor 1 from the feed point P1 to a point connected to the capacitor C1, passes through the capacitor C1, flows through a portion of the radiation conductor 3 from a point connected to the capacitor C1, to a point connected to the inductor L2 or the capacitor C2, and then, flows along the small loop. Whether the current I4 flows toward the inductor L2 or the capacitor C2 is determined by the impedances of the inductor L2 and the capacitor C2 obtained when the antenna apparatus operates at the mid-band resonance frequency f2 (details will be described later). FIG. 5 shows the case in which the current I4 flows toward the capacitor C2. After passing through the capacitor C2, the current I4 flows through a portion of the radiation conductor 2 from a point connected to the capacitor C2, to a point connected to the inductor L2, and further flows through the inductor L2, and flows through a portion of the radiation conductor 3 from a point connected to the inductor L2, to a point connected to the capacitor C2, and then, is connected to the current I4. At this time, a partial current I5 flows from the small loop, through the inductor L1, toward the feed point P1. The radiator 101 is configured such that when the antenna apparatus operates at the mid-band resonance frequency f2, a current I4 flows through a current path as shown in FIG. 5, and a portion of the radiator 101, the portion including a section along the large loop, the section extending from the feed point P1 through the capacitor C1 to the position of the small loop, and the portion including the small loop, resonates at the mid-band resonance frequency f2. Specifically, the radiator 101 is configured such that the sum of electrical lengths along the current path of the current I4 (i.e., referring to FIG. 1, the sum of the electrical length A2 of the portion of the radiation conductor 1 from the feed point P1 to the point connected to the capacitor C1, the electrical length of the capacitor C1, the electrical length A6 or A7 of the portion of the radiation conductor 3 from the point connected to the capacitor C1 to the point connected to the inductor L2 or the capacitor C2, the electrical length A8 of the portion of the radiation conductor 3 from the point connected to the inductor L2 to the point connected to the capacitor C2, the electrical lengths of the inductor L2 and the capacitor C2, and the electrical length A5 of the portion of the radiation conductor 2 from the point connected to the inductor L2 to the point connected to the capacitor C2) is an electrical length at which the radiator 101 resonates at the mid-band resonance frequency f2. In addition, a current I0 flows along a portion of the ground conductor G1, the portion being close to the radiator 101, and flows toward the connecting point P2.

When the antenna apparatus operates at the mid-band resonance frequency f2, the current I2 or I4 flows through the current path as shown in FIG. 4 or 5, and accordingly, the small loop of the radiator 101 operates in a loop antenna mode, i.e., a magnetic current mode, and further, the section of the radiator 101 from the feed point P1 to the small loop operates in a monopole antenna mode, i.e., a current mode. Since the radiator 101 operates in a "hybrid mode" of the loop antenna mode and the current mode, it is possible to achieve a sufficiently long resonant length while maintaining a compact form, thus achieving good characteristics even when the antenna apparatus operates at the mid-band resonance frequency f2.

Figure 6:
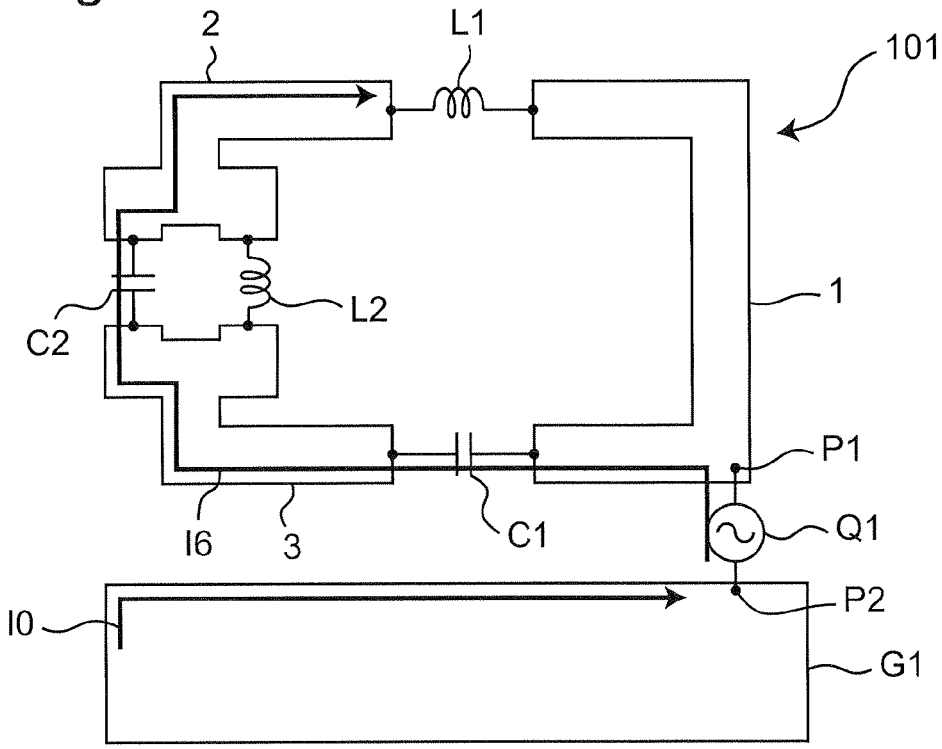
FIG. 6 is a diagram showing a current path for the case where the antenna apparatus of FIG. 1 operates at a high-band resonance frequency f3.

FIG. 6 is a diagram showing a current path for the case where the antenna apparatus of FIG. 1 operates at the high-band resonance frequency f3. By nature, a current having a high frequency component can pass through a capacitor (low impedance), but is difficult to pass through an inductor (high impedance). Hence, a current I6, for the case where the antenna apparatus operates at the high-range resonance frequency f3, flows through a section along the large loop, the section including the capacitor C1, and including the inductor L2 or the capacitor C2, but not including the inductor L1, and the section having its one end at the feed point P1. Specifically, the current I6 flows through a portion of the radiation conductor 1 from the feed point P1 to a point connected to the capacitor C1, passes through the capacitor C1, flows through a portion of the radiation conductor 3 to a point to which the inductor L2 or the capacitor C2 is connected, passes through the inductor L2 or the capacitor C2, and flows through a portion of the radiation conductor 2 from a point connected to the inductor L2 or the capacitor C2, to a point connected to the inductor L1. Whether the current I6 passes through the inductor L2 or the capacitor C2 is determined by the impedances of the inductor L2 and the capacitor C2 obtained when the antenna apparatus operates at the high-band resonance frequency f3 (details will be described later). FIG. 6 shows the case in which the current I6 flows through the capacitor C2. The current I6 flows strongly along an outer edge of the large loop. The radiator 101 is configured such that when the antenna apparatus operates at the high-band resonance frequency f3, the current I6 flows through a current path as shown in FIG. 6, and a portion of the radiator 101 including a section along the large loop, the section extending from the feed point P1 through the capacitor C1 and through the inductor L2 or the capacitor C2 to the position of the inductor L1, resonates at the high-band resonance frequency f3. Specifically, the radiator 101 is configured such that the sum of electrical lengths along the current path of the current I6 (i.e., referring to FIG. 1, the sum of the electrical length A2 of the portion of the radiation conductor 1 from the feed point P1 to the point connected to the capacitor C1, the electrical length of the capacitor C1, the electrical length A6 or A7 of the portion of the radiation conductor 3 from the point connected to the capacitor C1 to the point connected to the inductor L2 or the capacitor C2, the electrical length of the inductor L2 or the capacitor C2, and the electrical length A3 or A4 of the portion of the radiation conductor 2 from the point connected to the inductor L2 or the capacitor C2 to the point connected to the inductor L1) is an electrical length at which the radiator 101 resonates at the high-band resonance frequency f3. The electrical length at which the radiator 101 resonates is, for example, 0.25 times of an operating wavelength of the high-band resonance frequency f3. A current I0 flows along a portion of the ground conductor G1, the portion being close to the radiator 101, and flows toward the connecting point P2.

When the antenna apparatus operates at the high-band resonance frequency f3, the current I6 flows through the current path as shown in FIG. 6, and accordingly, the radiator 101 operates in a monopole antenna mode, i.e., a current mode. The current I6 may not flow through the inductor L2 or the capacitor C2, and may flow through a portion of the radiation conductor 3 from the point connected to the capacitor C1 to the point connected to the inductor L2 and the capacitor C2. In this case, the radiator 101 is configured such that when the antenna apparatus operates at the high-band resonance frequency f3, a current I6 flows through a current path as shown in FIG. 6, and a portion of the radiator 101 including a section along the large loop, the section extending from the feed point P1 through the capacitor C1 to the position of the small loop, resonates at the high-band resonance frequency f3. Specifically, the radiator 101 is configured such that the sum of electrical lengths along the current path of the current I6 (i.e., referring to FIG. 1, the sum of the electrical length A2 of the portion of the radiation conductor 1 from the feed point P1 to the point connected to the capacitor C1, the electrical length of the capacitor C1, and the electrical length A6 or A7 of the portion of the radiation conductor 3 from the point connected to the capacitor C1 to the point connected to the inductor L2 or the capacitor C2) is one-quarter of an operating wavelength λ3 of the high-band resonance frequency f3.

Now, the operating principle of the antenna apparatus of the present embodiment will be described. Hereinafter, "L1" and "L2" indicate the inductances of the inductors L1 and L2, and "C1" and "C2" indicate the capacitances of the capacitors C1 and C2.

An impedance $Z_{L1}$ of the inductor L1 and an impedance $Z_{C1}$ of the capacitor C1 are given as follows.

$$Z_{L1} = j \cdot \omega \cdot L1 \quad \text{[Mathematical Expression 1]}$$

$$Z_{C1} = \frac{1}{j \cdot \omega \cdot C1} \quad \text{[Mathematical Expression 2]}$$

In addition, a reflection coefficient $\Gamma_{L1}$ of the inductor L1 and a reflection coefficient $\Gamma_{C1}$ of the capacitor C1 are given as follows.

$$\Gamma_{L1} = \frac{Z_{L1} - Z_0}{Z_{L1} + Z_0} \quad \text{[Mathematical Expression 3]}$$

$$\Gamma_{C1} = \frac{Z_{C1} - Z_0}{Z_{C1} + Z_0} \quad \text{[Mathematical Expression 4]}$$

Where $Z_0$ denotes the line impedance, and for ease of illustration, let $Z_0$ be a constant.

Using the electrical length A1 of portion of the radiation conductor 1 from the feed point P1 to the inductor L1, and using the electrical length A2 of portion of the radiation conductor 1 from the feed point P1 to the capacitor C1, an impedance of the inductor L1 seen from the feed point P1, and an impedance $Z'_{C1}$ of the capacitor C1 seen from the feed point P1 can be approximated as follows.

$$Z'_{L1} = Z_0 \cdot \frac{1 + \Gamma_{L1} \cdot \exp(-2 \cdot \gamma \cdot A1)}{1 - \Gamma_{L1} \cdot \exp(-2 \cdot \gamma \cdot A1)} \quad \text{[Mathematical Expression 5]}$$

$$Z'_{C1} = Z_0 \cdot \frac{1 + \Gamma_{C1} \cdot \exp(-2 \cdot \gamma \cdot A2)}{1 - \Gamma_{C1} \cdot \exp(-2 \cdot \gamma \cdot A2)} \quad \text{[Mathematical Expression 6]}$$

Where $\gamma = \alpha \pm j\beta$, and $\alpha$ is the attenuation constant, and $\beta$ is the phase constant. When the radiation resistance is positive, the attenuation constant $\alpha$ is 0 or more.

At the low-band resonance frequency f1, the impedances and $Z'_{L1}$ and $Z'_{C1}$ satisfy: $|Z'_{L1}| < |Z'_{C1}|$. Accordingly, the current I1 flows from the feed point P1 not toward the capacitor C1, but toward the inductor L1, as shown in FIG. 3. In addition, at the high-band resonance frequency f3, the impedances $Z'_{L1}$ and $Z'_{C1}$ satisfy: $|Z'_{L1}| > |Z'_{C1}|$. Accordingly, the current I6 flows from the feed point P1 not toward the inductor L1, but toward the capacitor C1, as shown in FIG. 6. Meanwhile, at the mid-band resonance frequency f2, $|Z'_{L1}|$ is the substantially the same with $|Z'_{C1}|$, a current can substantially pass through either of the inductor L1 and the capacitor C1. Therefore, at the mid-band resonance frequency f2, the impedances $Z'_{L1}$ and $Z'_{C1}$ satisfy one of $|Z'_{L1}| < |Z'_{C1}|$, and $|Z'_{L1}| > |Z'_{C1}|$, depending on the actual structure of the antenna apparatus (the electrical lengths of the radiation conductors, the inductance of the inductor, and the capacitance of the capacitor), and depending on the actual operating frequency of the antenna apparatus. Thus, a current flows toward one of the inductor L1 and the capacitor C1 so that a current path with a low impedance is selected (FIGS. 4 and 5).

After passing through one of the inductor L1 and the capacitor C1 as described above, the current further flows toward one of the inductor L2 and the capacitor C2 of the small loop. Whether this current flows toward the inductor L2 or the capacitor C2 is determined according to an impedance $Z'_{L2}$ of the inductor L2 seen from the inductor L1 or the capacitor C1, and an impedance $Z'_{C2}$ of the capacitor C2 seen from the inductor L1 or the capacitor C1, so that a current path with a low impedance is selected, as described above with respect to a current flowing from the feed point P1 toward the inductor L1 or the capacitor C1. The impedances $Z'_{L2}$ and $Z'_{C2}$ depend on the electrical lengths A3, A4, A6, and A7 of the radiation conductors 2 and 3, the inductance of the inductor L2, and the capacitance of the capacitor C2, in a manner similar to as that of the mathematical expression 5 and 6.

However, if the impedances of the inductor L2 and the capacitor C2 are higher than impedances of the inductor L1 or the capacitor C1, then the inductor L2 and the capacitor C2 block the current. Such a block is not desirable when the antenna apparatus operates at the low-band resonance frequency f1 and the high-band resonance frequency f3. Therefore, the impedance $Z_{L1}$ of the inductor L1, the impedance $Z_{C1}$ of the capacitor C1, the impedance $Z_{L2}$ of the inductor L2, and the impedance $Z_{C2}$ of the capacitor C2 should satisfy the following relationships.

$$|Z_{L1}| \geq |Z_{L2}| \quad \text{[Mathematical Expression 7]}$$

$$|Z_{L1}| \geq |Z_{C2}| \quad \text{[Mathematical Expression 8]}$$

$$|Z_{C1}| \geq |Z_{L2}| \quad \text{[Mathematical Expression 9]}$$

$$|Z_{C1}| \geq |Z_{C2}| \quad \text{[Mathematical Expression 10]}$$

Thus, according to the antenna apparatus of the present embodiment, when the antenna apparatus operates at the low-band resonance frequency f1, the radiator 101 forms a current path along the large loop, and thus, operates in a loop antenna mode (magnetic current mode). When the antenna apparatus operates at the mid-band resonance frequency f2, the radiator 101 forms a current path from the feed point P1 to the small loop and a current path along the small loop, and thus, operates in a hybrid mode of a monopole antenna mode and a loop antenna mode. When the antenna apparatus operates at the high-band resonance frequency f3, the radiator 101 forms a non-looped current path, and thus, operates in a monopole antenna mode (current mode). Thus, it is possible to effectively achieve triple-band operation. According to the prior art, when the antenna operates at the low-band resonance frequency f1 (operating wavelength λ1), an antenna element length of about (λ1)/4 is required. On the other hand, the antenna apparatus of the present embodiment, forms a looped current path, and accordingly, the lengths in horizontal and vertical directions of the radiator 101 can be reduced to about (λ1)/15. The radiation efficiency of the antenna apparatus improves by increasing the distance between the capacitor C1 and the inductor L1 of the radiator 101 to increase the size of the large loop.

The radiator 101 may be excited at at least two of the low-band resonance frequency f1, the mid-band resonance frequency f2, and the high-band resonance frequency f3. In this case, at least two of a portion through which the current I1 flows as shown in FIG. 3, a portion through which the current I2 flows as shown in FIG. 4 or a portion through which the current I4 flows as shown in FIG. 5, and a portion through which the current I6 flows as shown in FIG. 6 may be configured to resonate at corresponding frequencies. By using the radiator 101 to operate in dual bands, it is possible to achieve dual-band operation with high flexibility.

As to an antenna apparatus provided with a looped radiation conductor, and a capacitor and an inductor which are inserted at certain positions along a loop of the radiation conductor, for example, there has been an invention of Patent Literature 3. However, according to the invention of Patent Literature 3, a parallel resonant circuit is formed by a capacitor and an inductor, and the parallel resonant circuit operates in one of a basic mode and a higher-order mode depending on a frequency. On the other hand, the invention of this application is based on a completely novel principle that the radiator 101 operates in one of a loop antenna mode and a monopole antenna mode depending on the operating frequency.

Figure 7:
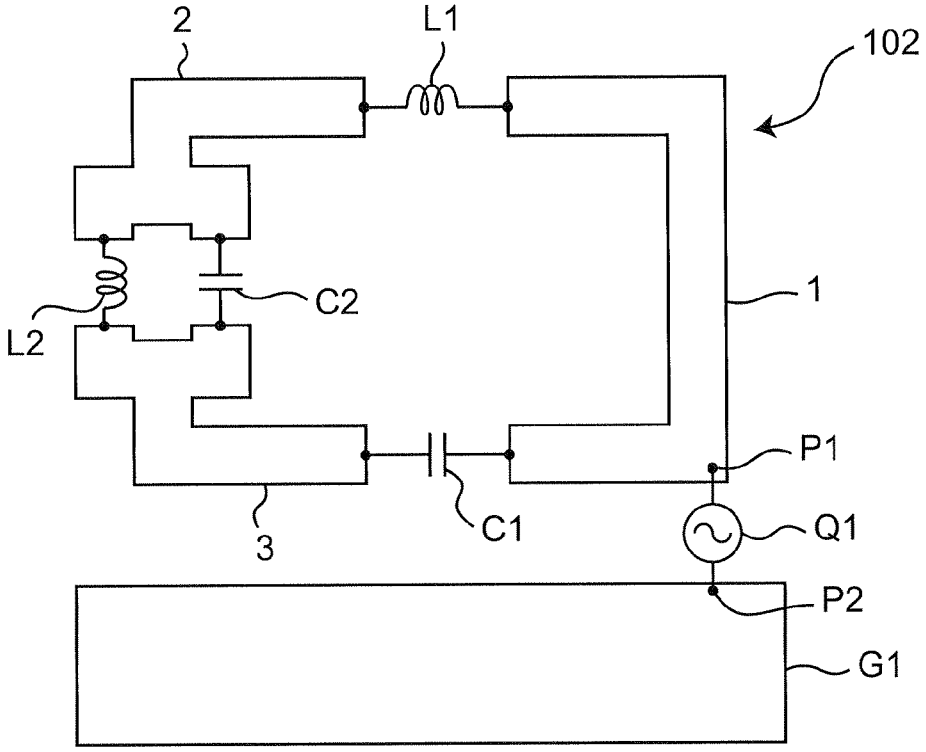
FIG. 7 is a plan view showing an antenna apparatus according to a first modified embodiment of the first embodiment of the present invention.

FIG. 7 is a plan view showing an antenna apparatus according to a first modified embodiment of the first embodiment of the present invention. The antenna apparatus of FIG. 7 is provided with a radiator 102 in which the positions of an inductor L2 and a capacitor C2 of the antenna apparatus of FIG. 1 are changed with each other. The antenna apparatus with such a configuration can also obtain the same advantageous effects as those obtained by the antenna apparatus of FIG. 1.

Figure 8:
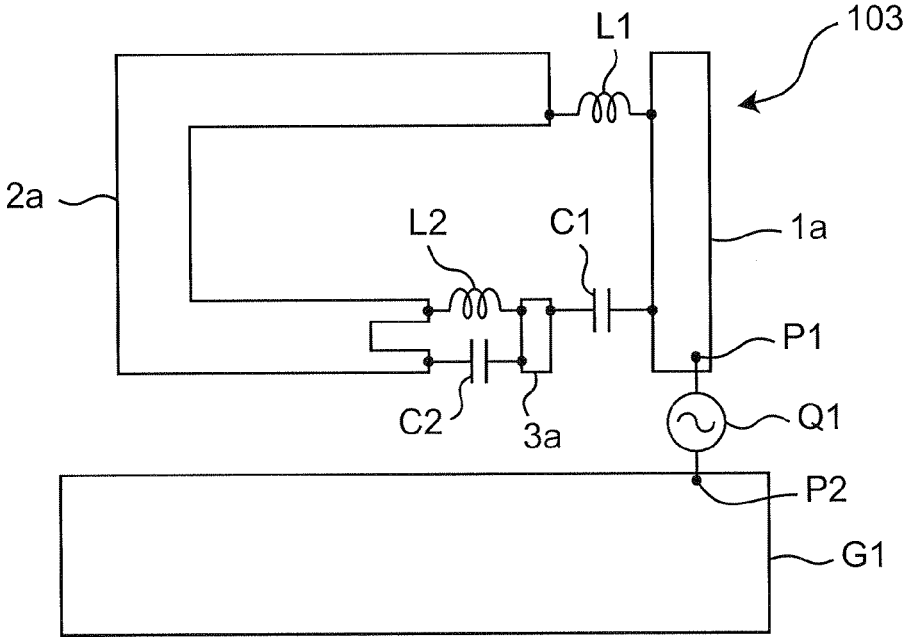
FIG. 8 is a plan view showing an antenna apparatus according to a second modified embodiment of the first embodiment of the present invention.
Figure 9:
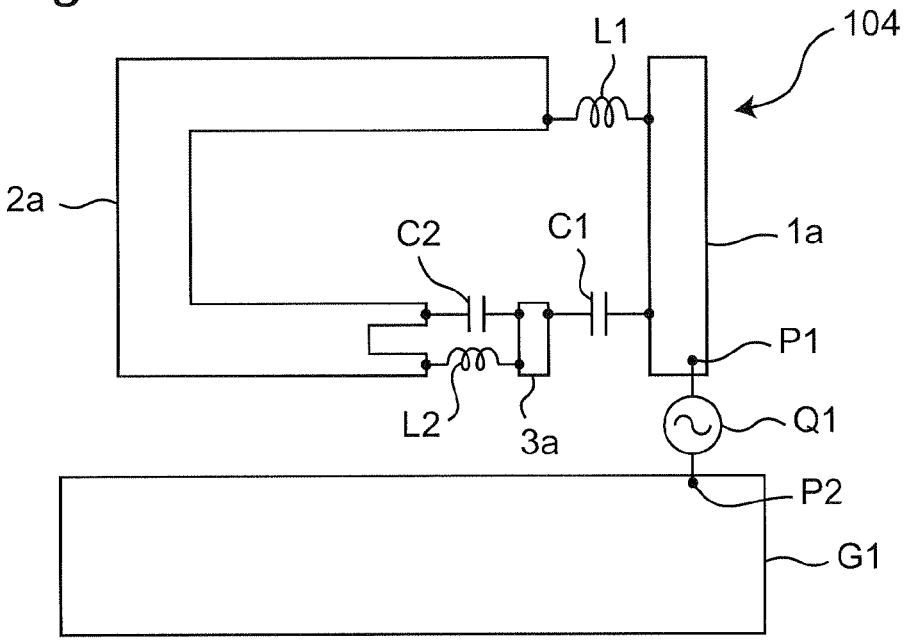
FIG. 9 is a plan view showing an antenna apparatus according to a third modified embodiment of the first embodiment of the present invention.
Figure 10:
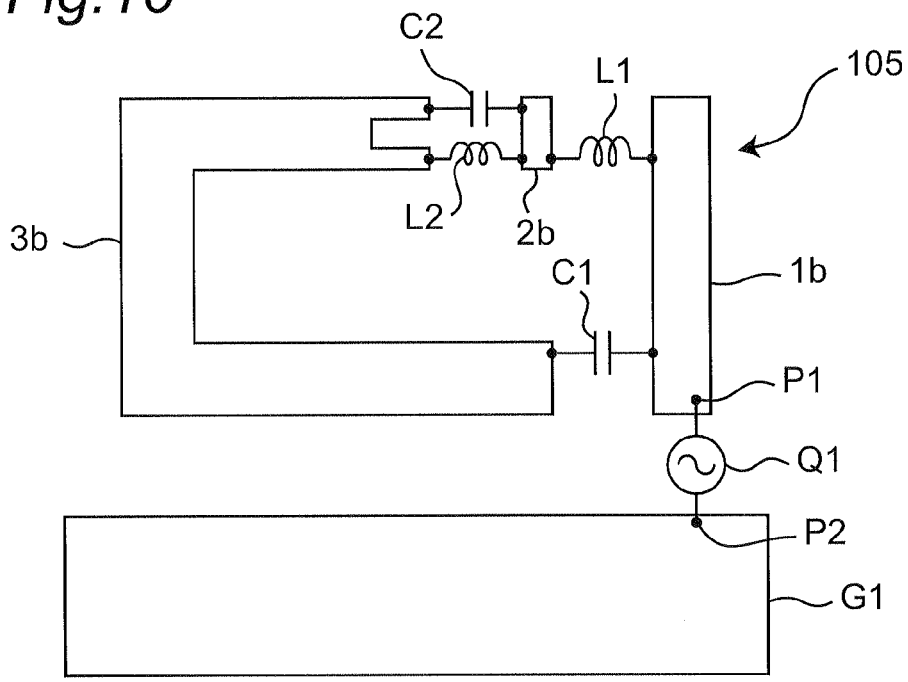
FIG. 10 is a plan view showing an antenna apparatus according to a fourth modified embodiment of the first embodiment of the present invention.
Figure 11:
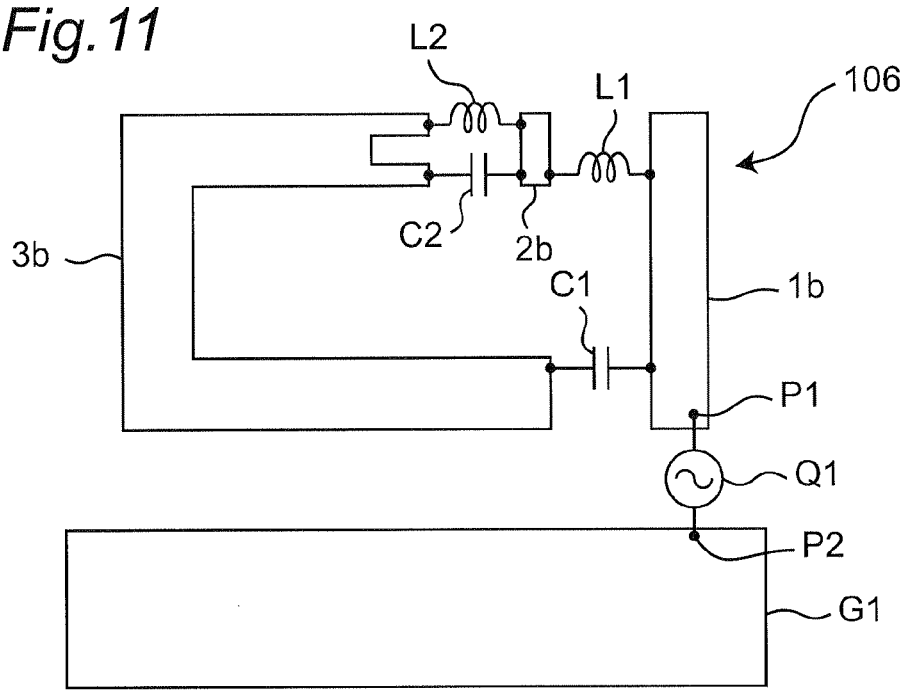
FIG. 11 is a plan view showing an antenna apparatus according to a fifth modified embodiment of the first embodiment of the present invention.

FIGS. 8 to 11 are plan views showing antenna apparatuses according to second to fifth modified embodiments of the first embodiment of the present invention. The antenna apparatuses of FIGS. 8 to 11 have an inductor L1 at a position remote from a feed point P1, and have a capacitor C1 at a position close to the feed point P1. Further, a small loop (i.e., an inductor L2 and a capacitor C2) can be provided at any position along a large loop and between the inductor L1 and the capacitor C1. However, with respect to the inductor L1 and the capacitor C1 as boundaries along the large loop, the small loop is provided on the side not including the feed point P1. The antenna apparatuses of FIGS. 8 and 9 are provided with radiators 103 and 104, respectively, in which the small loop is provided close to the capacitor C1. Among radiation conductors 1*a*, 2*a*, and 3*a* of the radiators 103 and 104, the radiation conductor 3*a* between the small loop and the capacitor C1 is shorter in length than the radiation conductor 3 of FIG. 1. The antenna apparatuses of FIGS. 10 and 11 are provided with radiators 105 and 106, respectively, in which the small loop is provided close to the inductor L1. Among radiation conductors 1*b*, 2*b*, and 3*b* of the radiators 105 and 106, the radiation conductor 2*b* between the small loop and the inductor L1 is shorter in length than the radiation conductor 2 of FIG. 1. The antenna apparatuses with such configurations can obtain the same advantageous effects as those obtained by the antenna apparatus of FIG. 1. The inventors of the present application numerically verified that it is possible to achieve triple-band operation in any of the configurations of FIGS. 8 to 11. At the high-band resonance frequency f3, a current flows through the capacitor C1 towards the inductor L1, and thus, an open end of the antenna apparatus is remote from a ground conductor G1. Hence, there is an advantageous effect that radiation resistance further increases at the high-band resonance frequency f3.

Figure 12:
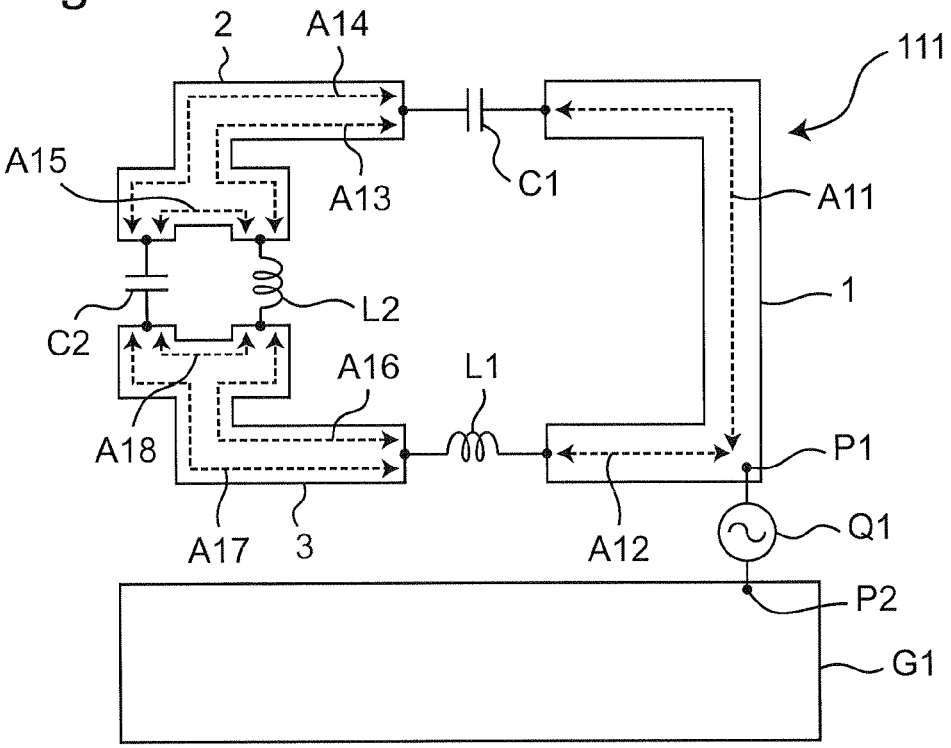
FIG. 12 is a plan view showing an antenna apparatus according to a sixth modified embodiment of the first embodiment of the present invention.

FIG. 12 is a plan view showing an antenna apparatus according to a sixth modified embodiment of the first embodiment of the present invention. FIG. 1 shows the antenna apparatus in which the capacitor C1 is disposed at a closer position to the feed point P1, than a position of the inductor L1, but the configuration is not limited thereto. The antenna apparatus of FIG. 12 includes a radiator 111 in which an inductor L1 is disposed at a closer position to a feed point P1, than a position of a capacitor C1.

Figure 13:
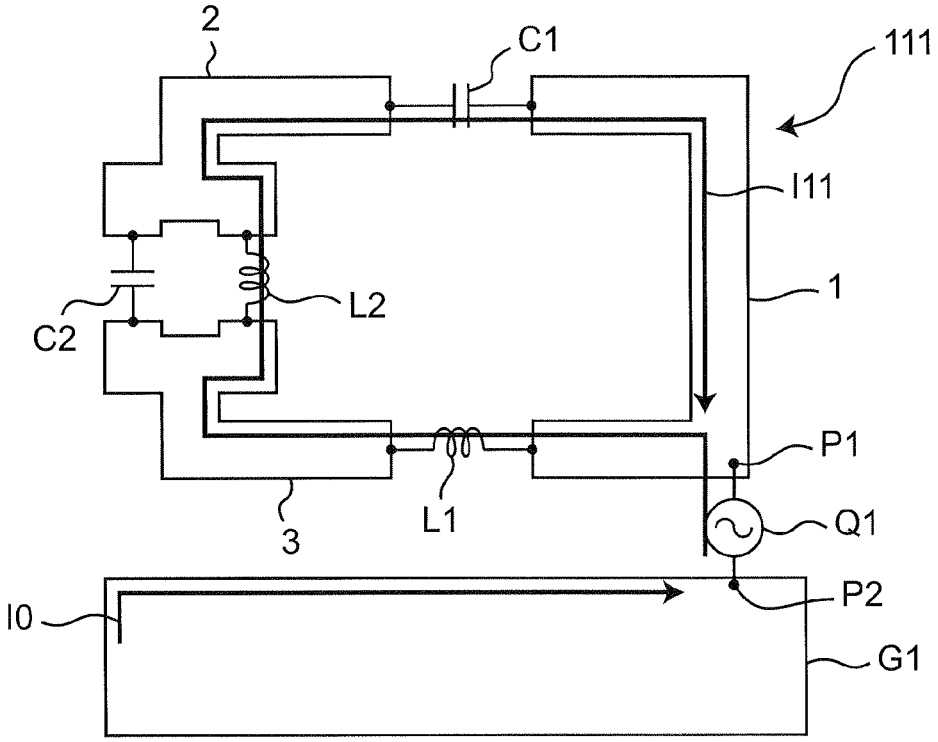
FIG. 13 is a diagram showing a current path for the case where the antenna apparatus of FIG. 12 operates at the low-band resonance frequency f1.

FIG. 13 is a diagram showing a current path for the case where the antenna apparatus of FIG. 12 operates at the low-band resonance frequency f1. A current I11, for the case where the antenna apparatus operates at the low-band resonance frequency f1, flows through a portion of a radiation conductor 1 from the feed point P1 to a point connected to the inductor L1, passes through the inductor L1, flows through a portion of a radiation conductor 3 from a point connected to the inductor L1, to a point connected to an inductor L2 or a capacitor C2, passes through the inductor L2 or the capacitor C2, and flows through a portion of a radiation conductor 2 to a point to which the capacitor C1 is connected. Whether the current I11 passes through the inductor L2 or the capacitor C2 is determined by the impedances of the inductor L2 and the capacitor C2 obtained when the antenna apparatus operates at the low-band resonance frequency f1. FIG. 13 shows the case in which the current I11 flows through the inductor L2. Further, due to a voltage difference across both ends of the capacitor C1, a current flows through a portion of the radiation conductor 1 from a point connected to the capacitor C1, to the feed point P1, and is connected to the current I11. The radiator 111 is configured such that the sum of electrical lengths along the current path of the current I11 (i.e., referring to FIG. 12, the sum of an electrical length A12 of the portion of the radiation conductor 1 from the feed point P1 to the point connected to the inductor L1, an electrical length of the inductor L1, an electrical length A16 or A11 of the portion of the radiation conductor 3 from the point connected to the inductor L1 to the point connected to the inductor L2 or the capacitor C2, an electrical length of the inductor L2 or the capacitor C2, an electrical length A13 or A14 of the portion of the radiation conductor 2 from the point connected to the inductor L2 or the capacitor C2 to the point connected to the capacitor C1, an electrical length of the capacitor C1, and an electrical length A11 of the portion of the radiation conductor 1 from the point connected to the capacitor C1 to the feed point P1) is one-quarter of an operating wavelength λ1 of the low-band resonance frequency f1. In addition, a current I0 flows along a portion of a ground conductor G1, the portion being close to the radiator 111, and flows toward a connecting point P2.

Figure 14:
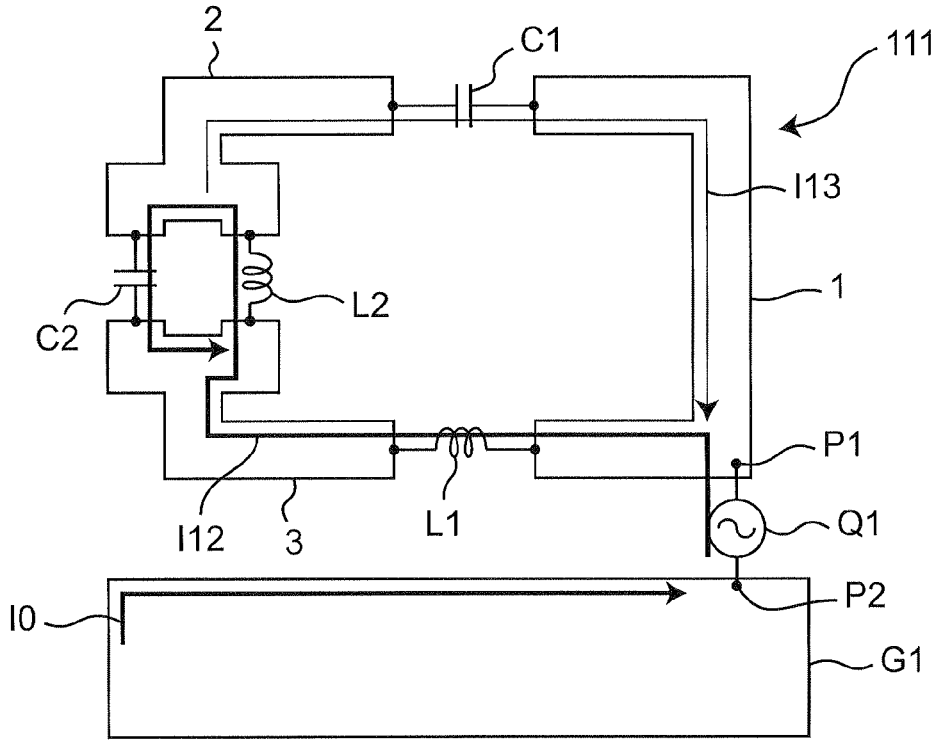
FIG. 14 is a diagram showing a first current path for the case where the antenna apparatus of FIG. 12 operates at the mid-band resonance frequency f2.

FIG. 14 is a diagram showing a first current path for the case where the antenna apparatus of FIG. 12 operates at the mid-band resonance frequency f2. FIG. 14 shows a current I12 passing through the inductor L1 when the antenna apparatus operates at the mid-band resonance frequency f2. The current I12 for the case where the antenna apparatus operates at the mid-band resonance frequency f2 flows through a portion of the radiation conductor 1 from the feed point P1 to a point connected to the inductor L1, passes through the inductor L1, flows through a portion of the radiation conductor 3 from a point connected to the inductor L1, to a point connected to the inductor L2 or the capacitor C2, and then, flows along a small loop. Whether the current I12 flows toward the inductor L2 or the capacitor C2 is determined by the impedances of the inductor L2 and the capacitor C2 obtained when the antenna apparatus operates at the mid-band resonance frequency f2. FIG. 14 shows the case in which the current I12 flows toward the inductor L2. After passing through the inductor L2, the current I12 flows through a portion of the radiation conductor 2 from a point connected to the inductor L2, to a point connected to the capacitor C2, and further passes through the capacitor C2, and flows through a portion of the radiation conductor 3 from a point connected to the capacitor C2, to a point connected to the inductor L2, and then, is connected to the current I12. At this time, a partial current I13 flows from the small loop, through the capacitor C1, toward the feed point P1. The radiator 111 is configured such that the sum of electrical lengths along the current path of the current I12 (i.e., referring to FIG. 12, the sum of the electrical length A12 of the portion of the radiation conductor 1 from the feed point P1 to the point connected to the inductor L1, the electrical length of the inductor L1, the electrical length A16 or A17 of the portion of the radiation conductor 3 from the point connected to the inductor L1 to the point connected to the inductor L2 or the capacitor C2, an electrical length A18 of the portion of the radiation conductor 3 from the point connected to the inductor L2 to the point connected to the capacitor C2, the electrical lengths of the inductor L2 and the capacitor C2, and an electrical length A15 of the portion of the radiation conductor 2 from the point connected to the inductor L2 to the point connected to the capacitor C2) is one-quarter of an operating wavelength λ2 of the mid-band resonance frequency f2. In addition, a current I0 flows along a portion of the ground conductor G1, the portion being close to the radiator 111, and flows toward the connecting point P2.

Figure 15:
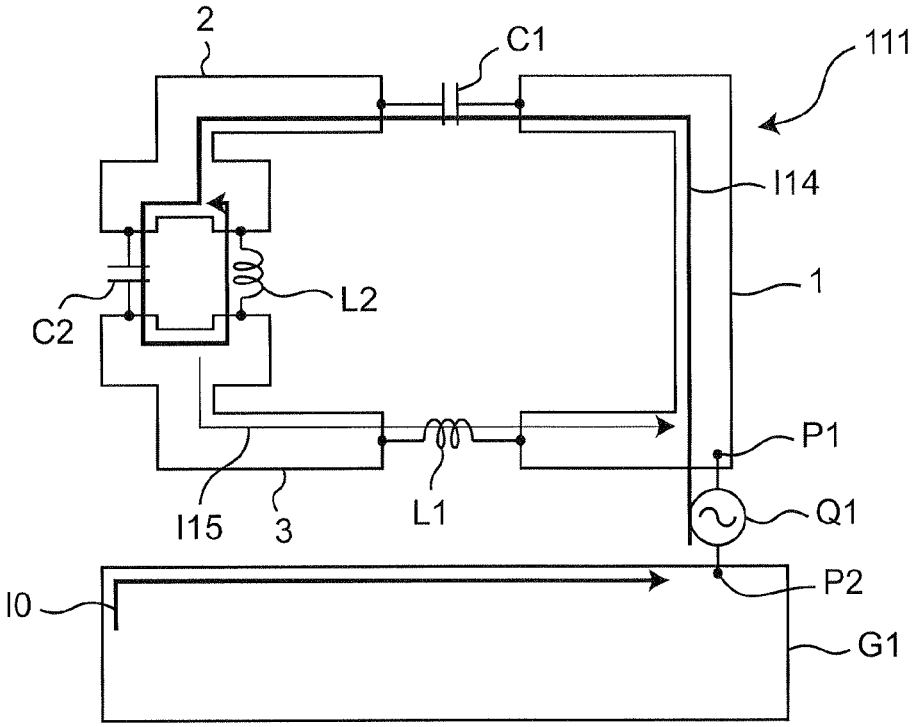
FIG. 15 is a diagram showing a second current path for the case where the antenna apparatus of FIG. 12 operates at the mid-band resonance frequency f2.

FIG. 15 is a diagram showing a second current path for the case where the antenna apparatus of FIG. 12 operates at the mid-band resonance frequency f2. FIG. 15 shows a current I14 passing through the capacitor C1 when the antenna apparatus operates at the mid-band resonance frequency f2. The current I14 for the case where the antenna apparatus operates at the mid-band resonance frequency f2 flows through a portion of the radiation conductor 1 from the feed point P1 to a point connected to the capacitor C1, passes through the capacitor C1, flows through a portion of the radiation conductor 2 from a point connected to the capacitor to a point connected to the inductor L2 or the capacitor C2, and then, flows along the small loop. Whether the current I14 flows toward the inductor L2 or the capacitor C2 is determined by the impedances of the inductor L2 and the capacitor C2 obtained when the antenna apparatus operates at the mid-band resonance frequency f2. FIG. 15 shows the case in which the current I14 flows toward the capacitor C2. After passing through the capacitor C2, the current I14 flows through a portion of the radiation conductor 3 from a point connected to the capacitor C2, to a point connected to the inductor L2, and further flows through the inductor L2, and flows through a portion of the radiation conductor 2 from a point connected to the inductor L2, to a point connected to the capacitor C2, and then, is connected to the current I14. At this time, a partial current I15 flows from the small loop, through the inductor L1, toward the feed point P1. The radiator 111 is configured such that the sum of electrical lengths along the current path of the current I14 (i.e., referring to FIG. 12, the sum of the electrical length A11 of the portion of the radiation conductor 1 from the feed point P1 to the point connected to the capacitor C1, an electrical length of the capacitor C1, the electrical length A13 or A14 of the portion of the radiation conductor 2 from the point connected to the capacitor C1 to the point connected to the inductor L2 or the capacitor C2, the electrical length A15 of the portion of the radiation conductor 2 from the point connected to the inductor L2 to the point connected to the capacitor C2, the electrical lengths of the inductor L2 and the capacitor C2, and the electrical length A18 of the portion of the radiation conductor 3 from the point connected to the inductor L2 to the point connected to the capacitor C2) is one-quarter of the operating wavelength λ2 of the mid-band resonance frequency f2. In addition, a current I0 flows along a portion of the ground conductor G1, the portion being close to the radiator 111, and flows toward the connecting point P2.

Figure 16:
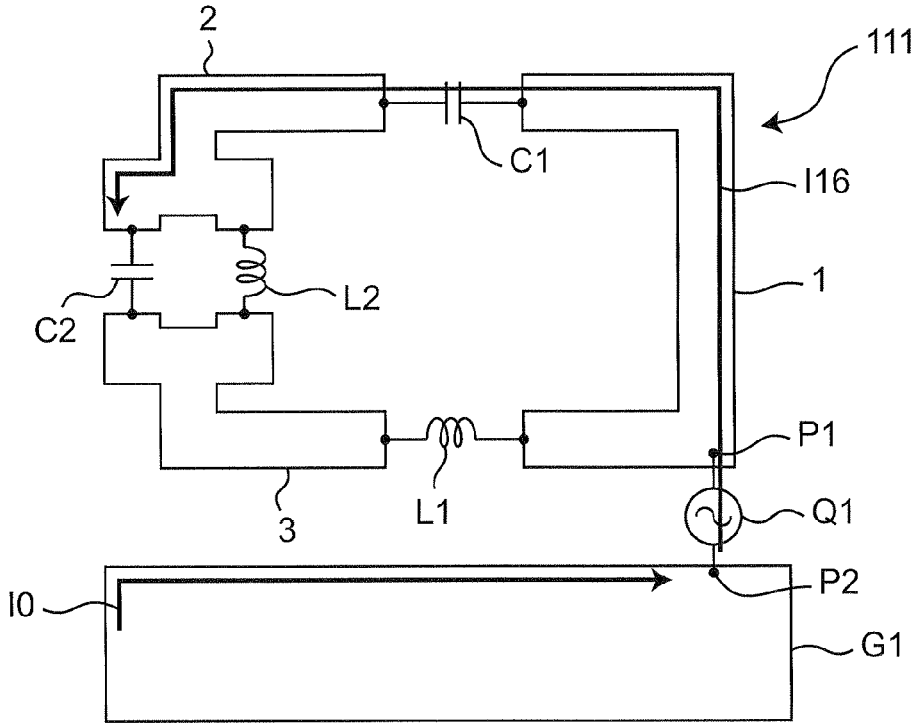
FIG. 16 is a diagram showing a current path for the case where the antenna apparatus of FIG. 12 operates at the high-band resonance frequency f3.

FIG. 16 is a diagram showing a current path for the case where the antenna apparatus of FIG. 12 operates at the high-band resonance frequency f3. A current I16, for the case where the antenna apparatus operates at the high-range resonance frequency f3, flows through a section along a large loop, the section including the capacitor C1, not including the inductor L2 and the capacitor C2, and not including the inductor L1, and the section having its one end at the feed point P1. Specifically, the current I16 flows through a portion of the radiation conductor 1 from the feed point P1 to a point connected to the capacitor C1, passes through the capacitor C1, and flows through a portion of the radiation conductor 2 to a point to which the inductor L2 or the capacitor C2 is connected. The radiator 111 is configured such that the sum of electrical lengths along the current path of the current I16 (i.e., referring to FIG. 12, the sum of the electrical length A11 of the portion of the radiation conductor 1 from the feed point P1 to the point connected to the capacitor C1, the electrical length of the capacitor C1, and the electrical length A13 or A14 of the portion of the radiation conductor 2 from the point connected to the capacitor C1 to the point connected to the inductor L2 or the capacitor C2) is one-quarter of an operating wavelength λ3 of the high-band resonance frequency f3. Alternatively, the current I16 may flow through a portion of the radiation conductor 1 from the feed point P1 to a point connected to the capacitor C1, pass through the capacitor C1, pass through the inductor L2 or the capacitor C2, and flow through a portion of the radiation conductor 3 from a point connected to the inductor L2 or the capacitor C2, to a point connected to the inductor L1. In this case, the radiator 111 is configured such that the sum of electrical lengths along the current path of the current I16 (i.e., referring to FIG. 11, the sum of the electrical length A11 of the portion of the radiation conductor 1 from the feed point P1 to the point connected to the capacitor C1, the electrical length of the capacitor C1, the electrical length A13 or A14 of the portion of the radiation conductor 2 from the point connected to the capacitor C1 to the point connected to the inductor L2 or the capacitor C2, the electrical length of the inductor L2 or the capacitor C2, and the electrical length A16 or A11 of the portion of the radiation conductor 3 from the point connected to the inductor L2 or the capacitor C2 to the point connected to the inductor L1) is one-quarter of the operating wavelength λ3 of the high-band resonance frequency f3. A current I0 flows through a portion of the ground conductor G1 close to the radiator 111, and flows toward the connecting point P2.

Figure 17:
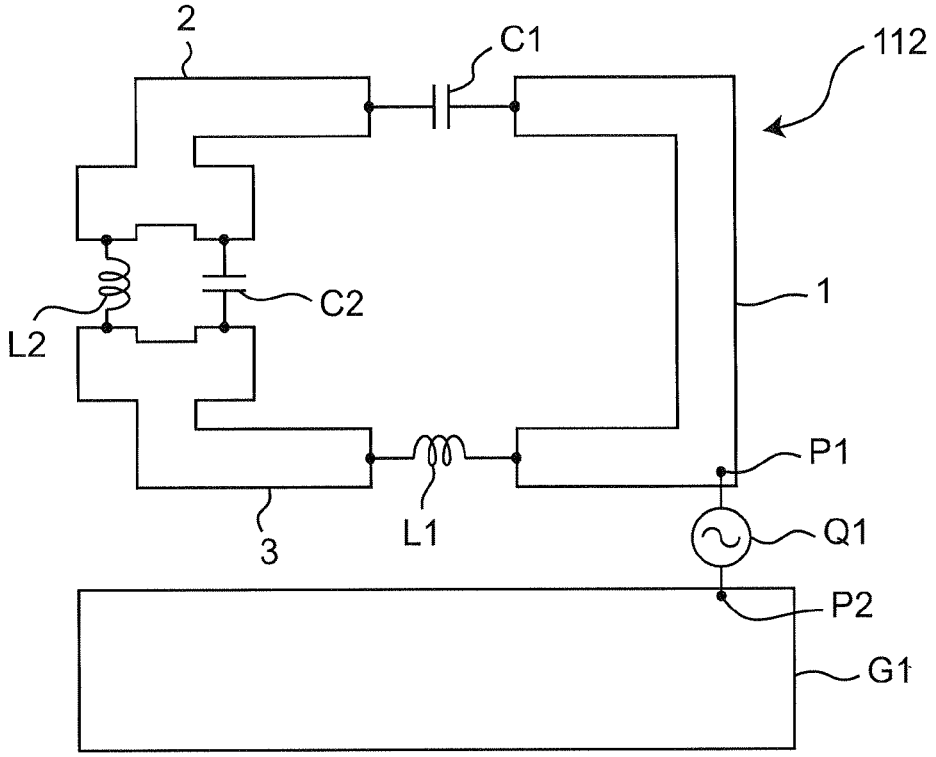
FIG. 17 is a plan view showing an antenna apparatus according to a seventh modified embodiment of the first embodiment of the present invention.

The antenna apparatus of FIG. 12 can also obtain the same advantageous effects as those obtained by the antenna apparatus of FIG. 1. FIG. 17 is a plan view showing an antenna apparatus according to a seventh modified embodiment of the first embodiment of the present invention. The antenna apparatus of FIG. 17 is provided with a radiator 112 in which the positions of an inductor L2 and a capacitor C2 of the antenna apparatus of FIG. 12 are changed with each other. The antenna apparatus with such a configuration can also obtain the same advantageous effects as those obtained by the antenna apparatus of FIG. 12.

Figure 18:
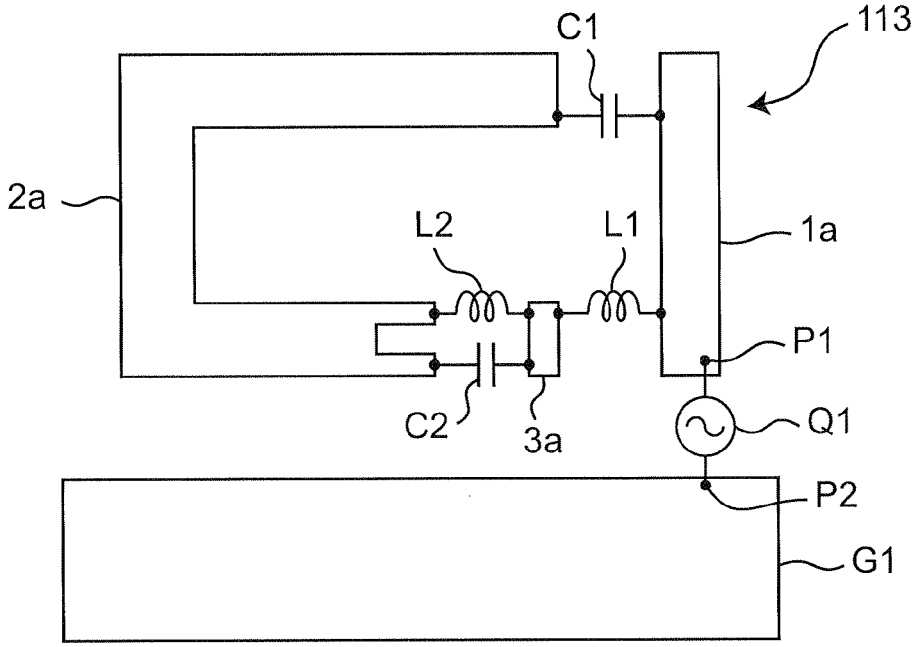
FIG. 18 is a plan view showing an antenna apparatus according to an eighth modified embodiment of the first embodiment of the present invention.
Figure 19:
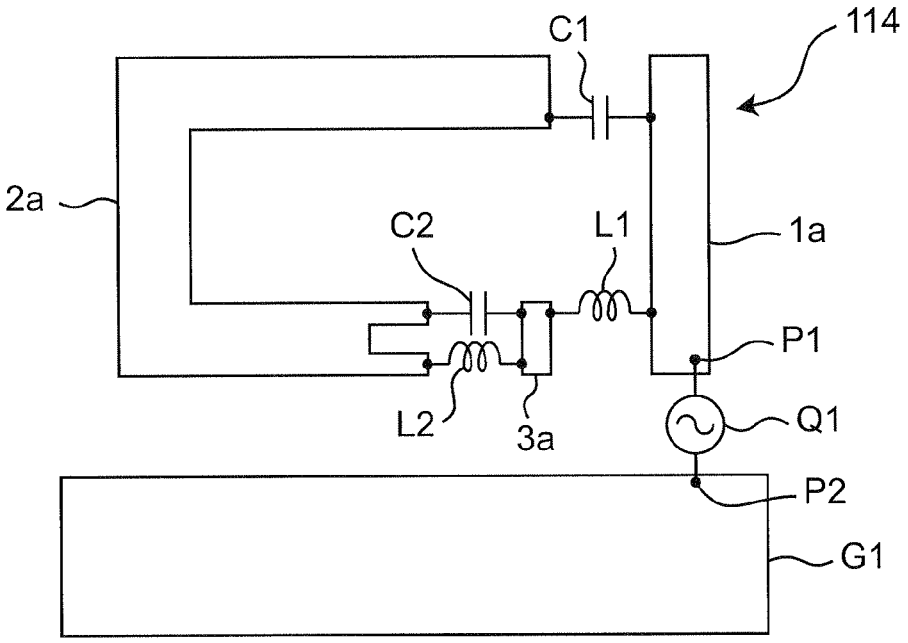
FIG. 19 is a plan view showing an antenna apparatus according to a ninth modified embodiment of the first embodiment of the present invention.
Figure 20:
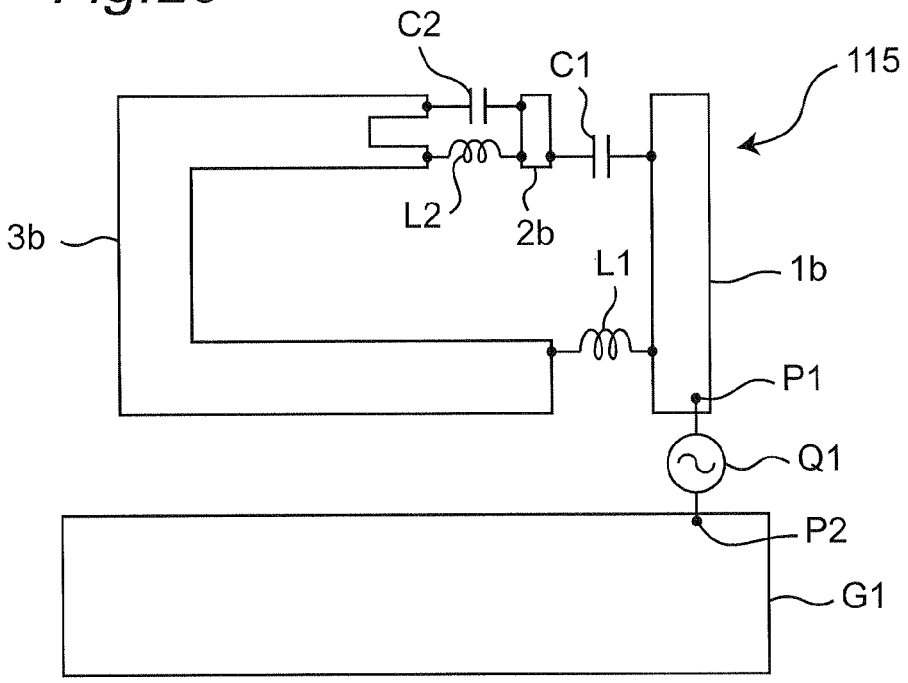
FIG. 20 is a plan view showing an antenna apparatus according to a tenth modified embodiment of the first embodiment of the present invention.
Figure 21:
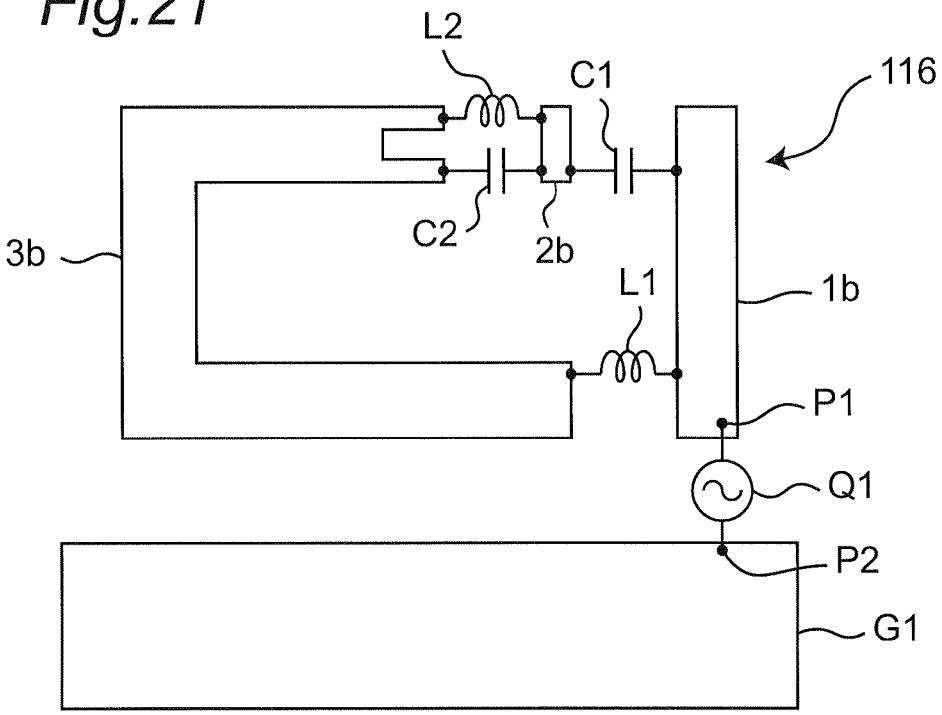
FIG. 21 is a plan view showing an antenna apparatus according to an eleventh modified embodiment of the first embodiment of the present invention.

FIGS. 18 to 21 are plan views showing antenna apparatuses according to eighth to eleventh modified embodiments of the first embodiment of the present invention. The antenna apparatuses of FIGS. 18 to 21 have a capacitor C1 at a position remote from a feed point P1, and have an inductor L1 at a position close to the feed point P1. The antenna apparatuses of FIGS. 18 and 19 are provided with radiators 113 and 114, respectively, in which a small loop is provided close to the inductor L1. Among radiation conductors 1*a*, 2*a*, and 3*a* of the radiators 113 and 114, the radiation conductor 3*a* between the small loop and the inductor L1 is shorter in length than the radiation conductor 3 of FIG. 12. The antenna apparatuses of FIGS. 20 and 21 are provided with radiators 115 and 116, respectively, in which a small loop is provided close to the capacitor C1. Among radiation conductors 1*b*, 2*b*, and 3*b* of the radiators 115 and 116, the radiation conductor 2*b* between the small loop and the capacitor C1 is shorter in length than the radiation conductor 2 of FIG. 12. The antenna apparatuses with such configurations can obtain the same advantageous effects as those obtained by the antenna apparatus of FIG. 1. The inventors of the present application numerically verified that it is possible to achieve triple-band operation in any of the configurations of FIGS. 18 to 21. At the high-band resonance frequency f3, a current flows through the capacitor C1 to the inductor L1, and thus, an open end of the antenna apparatus is close to a ground conductor G1. Hence, there is an effect that when the antenna apparatuses of FIGS. 18 to 21 operate at the high-band resonance frequency f3, radiation resistance decreases as compared to the antenna apparatuses of FIGS. 8 to 11.

Figure 22:
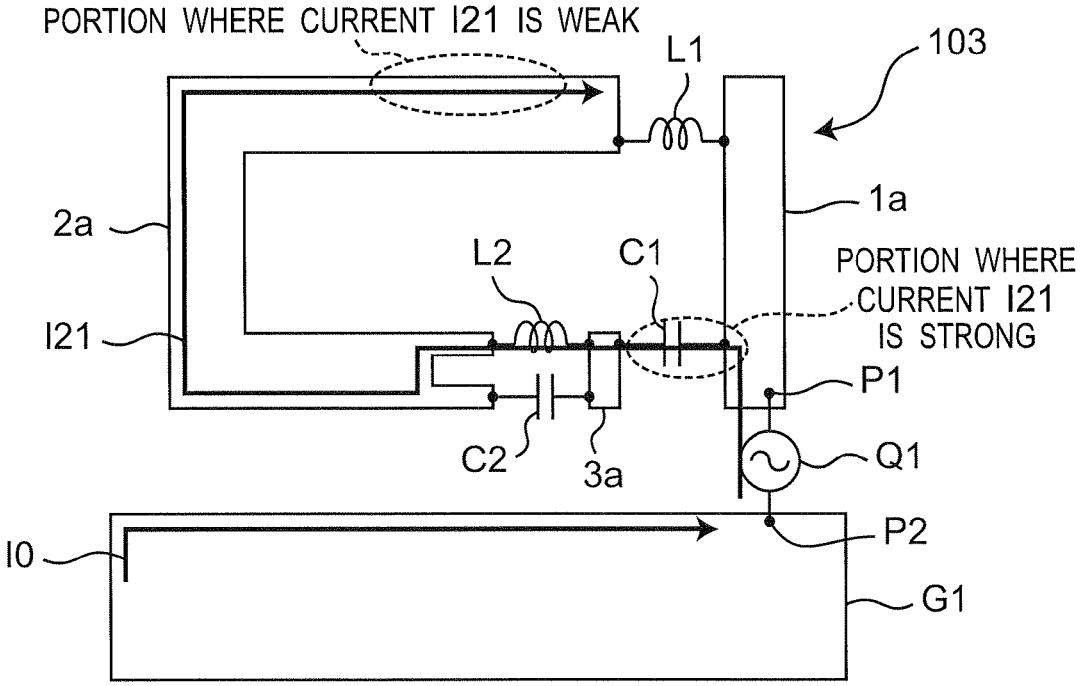
FIG. 22 is a diagram showing a current path for the case where the antenna apparatus of FIG. 8 operates at the high-band resonance frequency f3.
Figure 23:
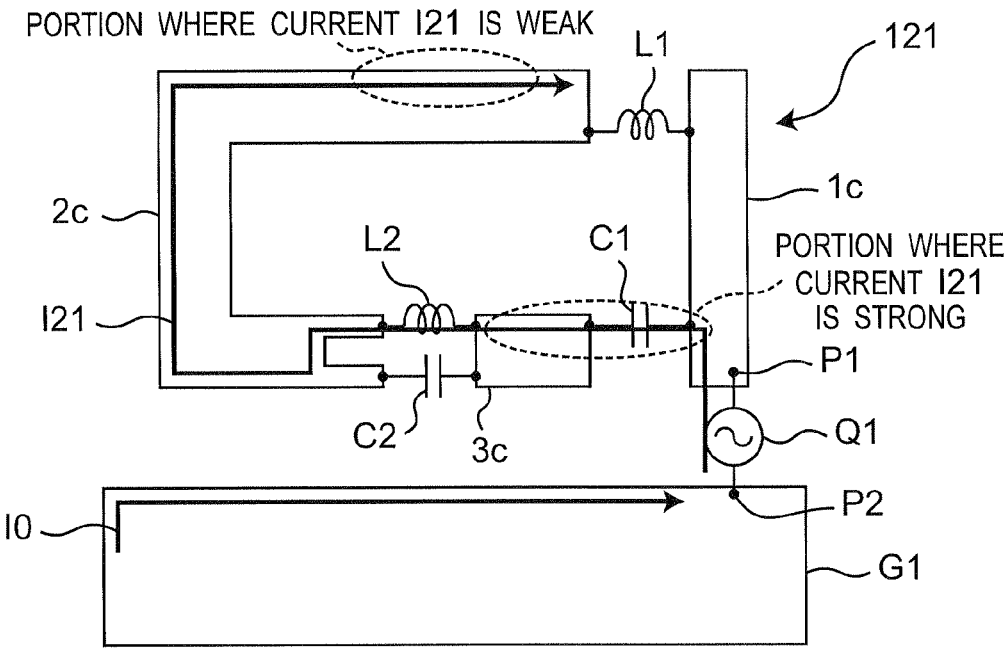
FIG. 23 is a diagram showing a current path for the case where an antenna apparatus according to a twelfth modified embodiment of the first embodiment of the present invention operates at the high-band resonance frequency f3.

Now, with reference to FIGS. 22 and 23, an advantageous effect brought about by adjusting the electrical length of a radiation conductor will be described. FIG. 22 is a diagram showing a current path for the case where the antenna apparatus of FIG. 8 operates at the high-band resonance frequency f3. FIG. 23 is a diagram showing a current path for the case where an antenna apparatus according to a twelfth modified embodiment of the first embodiment of the present invention operates at the high-band resonance frequency f3. Among radiation conductors 1*c*, 2*c*, and 3*c* of a radiator 121 of FIG. 23, the radiation conductor 3*c* between a small loop and a capacitor C1 is longer in length than the radiation conductor 3*a* of FIG. 22. A current is highly concentrated near the feed point P1. Accordingly, if a current path includes, for example, the radiation conductor 3*a* of FIG. 22, then increasing the electrical length of the radiation conductor 3*a* facilitates radiation of radio waves into space, thus providing a special advantageous effect of an increase in radiation resistance. For example, as shown in FIG. 22, a current I21, for the case where the antenna apparatus of FIG. 8 operates at the high-band resonance frequency f3, passes through the capacitor C1 and the inductor L2, and flows to the inductor L1. In this case, the current I21 is highly concentrated on the radiation conductor 3*a* near the feed point P1, and attenuates near the inductor L1 (open end). Thus, there is an advantageous effect that by increasing the electrical length of the radiation conductor 3*c* of the radiator 121 as shown in FIG. 23, radiation resistance increases, thus facilitating to achieve matching. In addition, if the antenna apparatus is designed such that a current passes through the capacitor C1 and then flows along the small loop when the antenna apparatus of FIG. 23 operates at the mid-band resonance frequency f2, then there is an advantageous effect that by using the radiation conductor 3*c* having a large electrical length, radiation resistance increases, thus facilitating to achieve matching, as in the case of the high-band resonance frequency f3.

As to the capacitors C1 and C2 and the inductors L1 and L2, for example, it is possible to use discrete circuit elements, but the capacitors C1 and C2 and the inductors L1 and L2 are not limited thereto. With reference to FIGS. 24 to 29, modified embodiments of the capacitors C1 and C2 and the inductors L1 and L2 will be described below.

Figure 24:
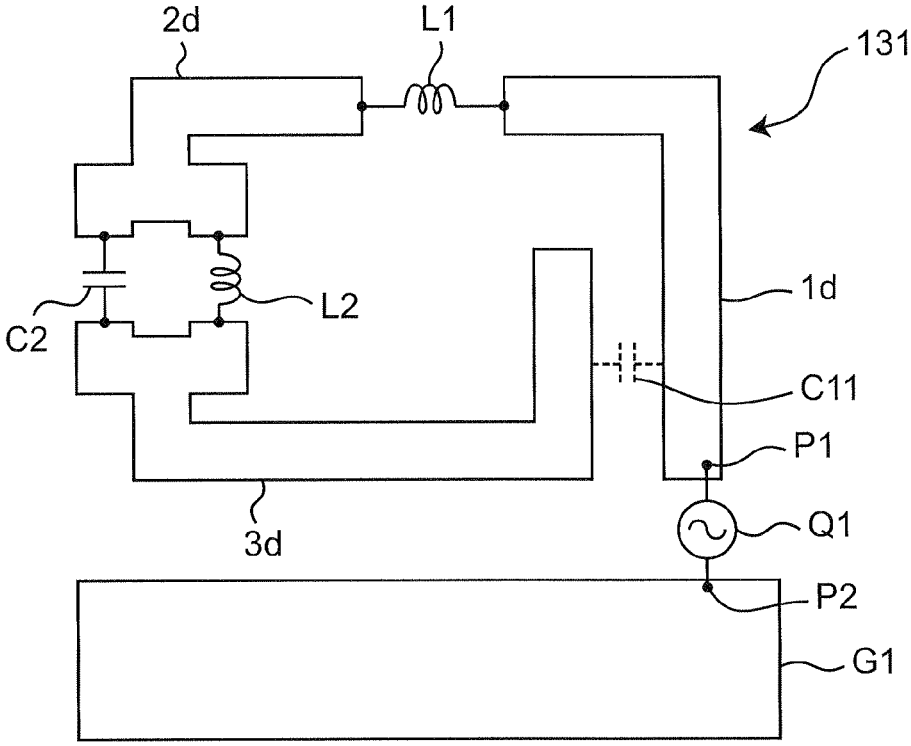
FIG. 24 is a plan view showing an antenna apparatus according to a thirteenth modified embodiment of the first embodiment of the present invention.
Figure 25:
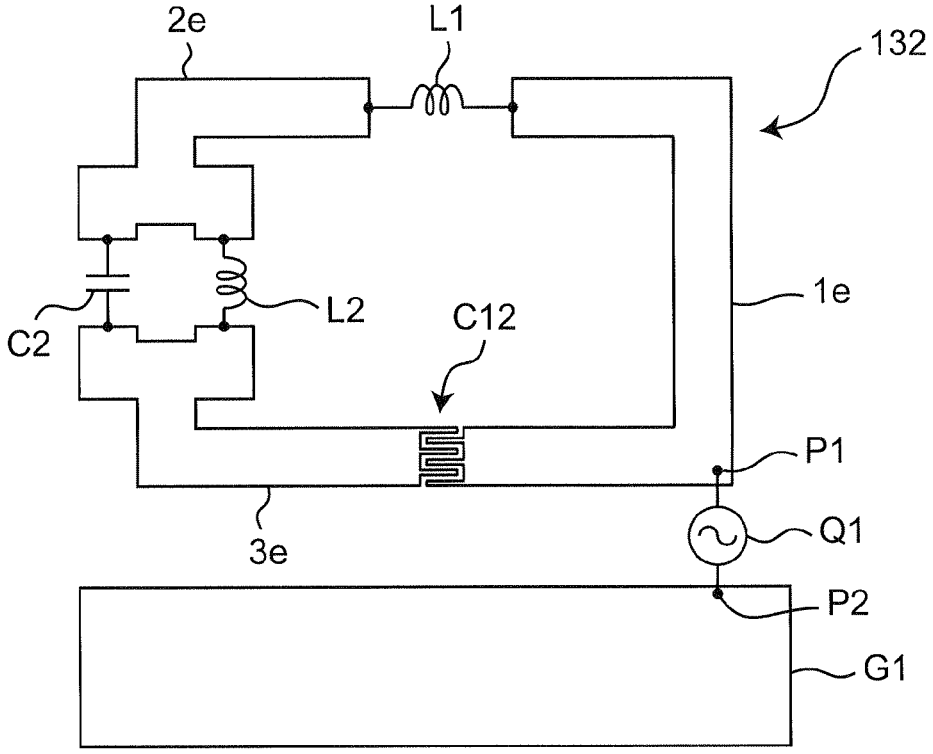
FIG. 25 is a plan view showing an antenna apparatus according to a fourteenth modified embodiment of the first embodiment of the present invention.

FIG. 24 is a plan view showing an antenna apparatus according to a thirteenth modified embodiment of the first embodiment of the present invention. A radiator 131 of the antenna apparatus of FIG. 24 is provided with radiation conductors 1*d*, 2*d*, and 3*d*, instead of the radiation conductors 1, 2, and 3 and the capacitor C1 of FIG. 1. As shown in FIG. 24, a virtual capacitor C11 may be formed between the radiation conductors 1*d* and 3*d*, by arranging the radiation conductors 1*d* and 3*d* close to each other to produce a certain capacitance between the radiation conductors 1*d* and 3*d*. the closer the radiation conductors 1*d* and 3*d* approach to each other, or the wider the area where the radiation conductors 1*d* and 3*d* are close to each other increases, the more the capacitance of the virtual capacitor C11 increases. In addition, FIG. 25 is a plan view showing an antenna apparatus according to a fourteenth modified embodiment of the first embodiment of the present invention. A radiator 132 of the antenna apparatus of FIG. 25 is provided with radiation conductors 1*e*, 2*e*, and 3*e*, instead of the radiation conductors 1, 2, and 3 and the capacitor C1 of FIG. 1, and forms a capacitor C12 made of portions of the radiation conductors 1*e* and 3*e* close to each other. As shown in FIG. 25, when forming a virtual capacitor C12 by a capacitance between the radiation conductors 1*e* and 3*e*, interdigital conductive portions (a configuration in which fingered conductors are engaged alternately) may be formed. The capacitor C12 of FIG. 25 can increase the capacitance as compared to ver the capacitor C11 of FIG. 24. According to the antenna apparatuses of FIGS. 24 and 25, since the capacitors C11 and C12 can be formed as conductive patterns on a dielectric board, there are advantageous effects such as cost reduction, and reduction in variations of manufacture. A capacitor formed by portions of radiation conductors close to each other is not limited to the linear conductive portions as shown in FIG. 24, or the interdigital conductive portions as shown in FIG. 25, and may be formed by conductive portions of other shapes.

Figure 26:
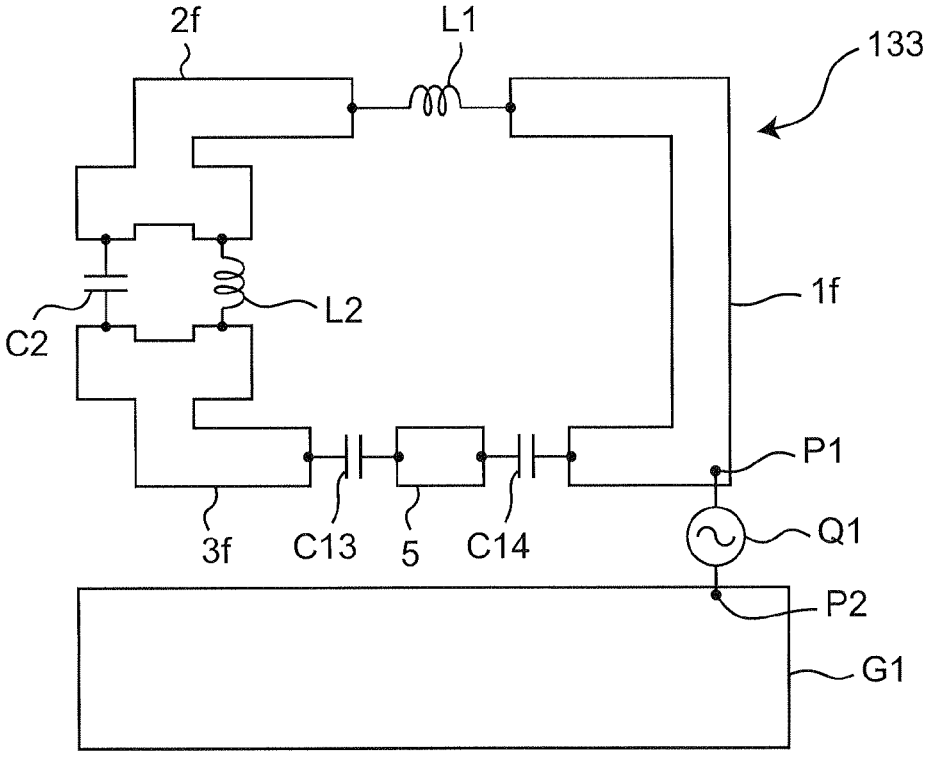
FIG. 26 is a plan view showing an antenna apparatus according to a fifteenth modified embodiment of the first embodiment of the present invention.

FIG. 26 is a plan view showing an antenna apparatus according to a fifteenth modified embodiment of the first embodiment of the present invention. A radiator 133 of the antenna apparatus of FIG. 26 is provided with radiation conductors 1*f*, 2*f*, and 3*f*, instead of the radiation conductors 1, 2, and 3 of FIG. 1, and is provided with capacitors C13 and C14 and a radiation conductor 5, instead of the capacitor C1 of FIG. 1. An antenna apparatus of the present embodiment is not limited to one provided with a single capacitor, and may be provided with concatenated capacitors, including two or more capacitors. Referring to FIG. 26, the capacitors C13 and C14 connected to each other by the radiation conductor 5 having a certain electrical length are inserted, instead of the capacitor C1 of FIG. 1. In other words, the capacitors C13 and C14 are inserted at different positions along a large loop. According to the antenna apparatus of FIG. 26, since capacitors can be inserted at a plurality of different positions in consideration of the current distribution on the radiator, there is an advantageous effect that when designing the antenna apparatus, it is possible to easily achieve fine adjustments of the low-band resonance frequency f1, the mid-band resonance frequency f2, and the high-band resonance frequency f3.

Figure 27:
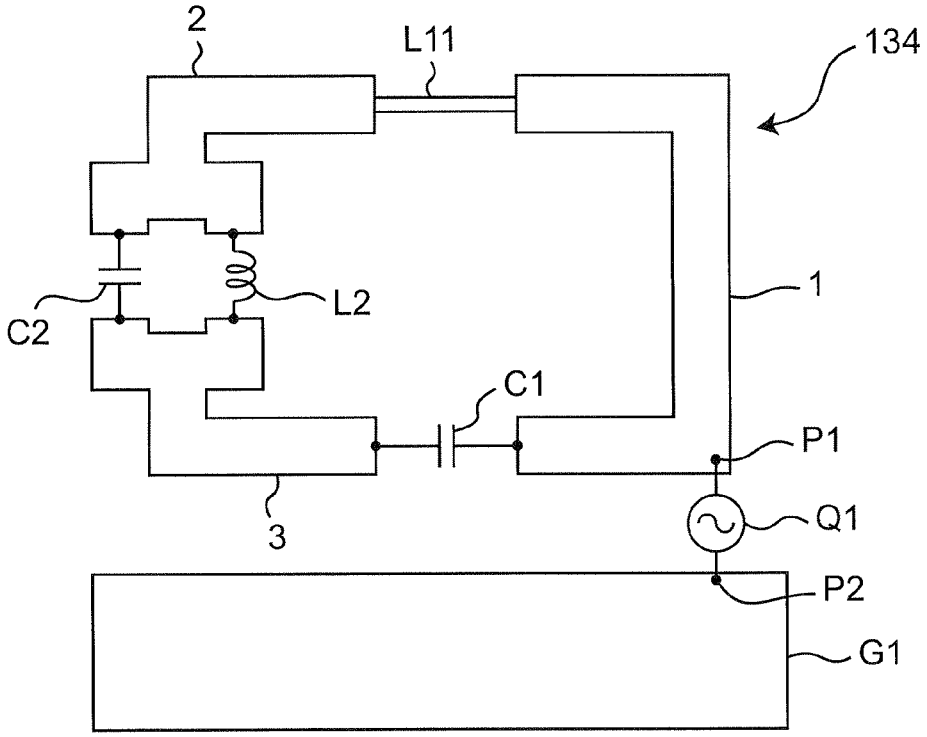
FIG. 27 is a plan view showing an antenna apparatus according to a sixteenth modified embodiment of the first embodiment of the present invention.
Figure 28:
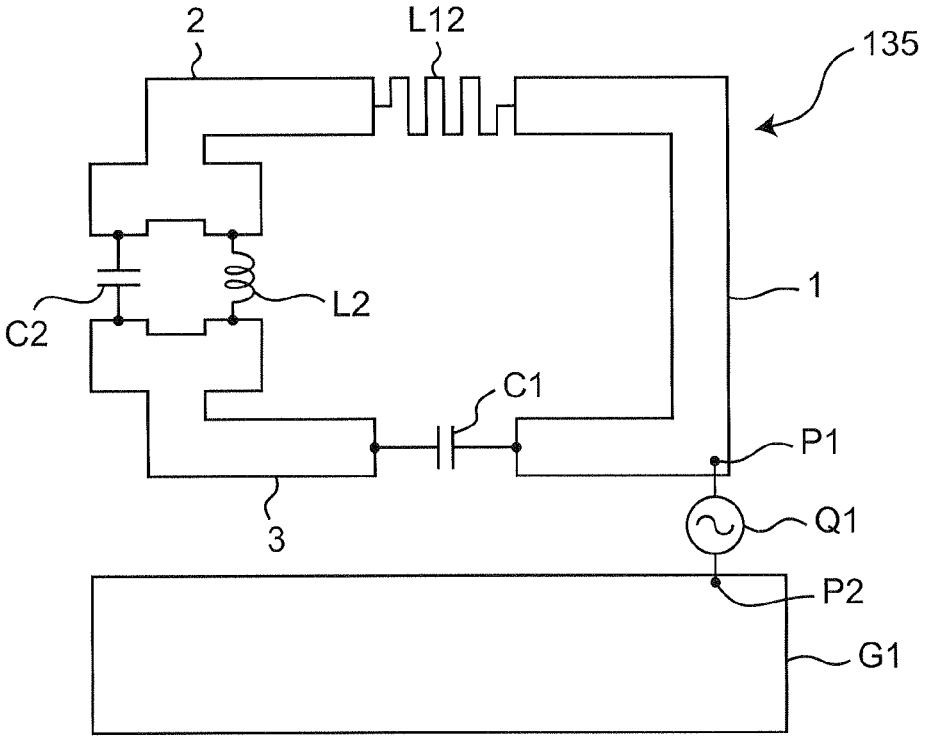
FIG. 28 is a plan view showing an antenna apparatus according to a seventeenth modified embodiment of the first embodiment of the present invention.

FIG. 27 is a plan view showing an antenna apparatus according to a sixteenth modified embodiment of the first embodiment of the present invention. A radiator 134 of the antenna apparatus of FIG. 27 is provided with an inductor L11 made of a strip conductor, instead of the inductor L1 of FIG. 1. FIG. 28 is a plan view showing an antenna apparatus according to a seventeenth modified embodiment of the first embodiment of the present invention. A radiator 135 of the antenna apparatus of FIG. 28 is provided with an inductor L12 made of a meander conductor, instead of the inductor L1 of FIG. 1. The thinner the widths of conductors forming the inductors L11 and L12 are, and the longer the lengths of the conductors are, the more the inductances of the inductors L11 and L12 increase. According to the antenna apparatuses of FIGS. 27 and 28, since the inductors L11 and L12 can be formed as conductive patterns on a dielectric board, there are advantageous effects such as cost reduction and reduction in variations of manufacture.

Figure 29:
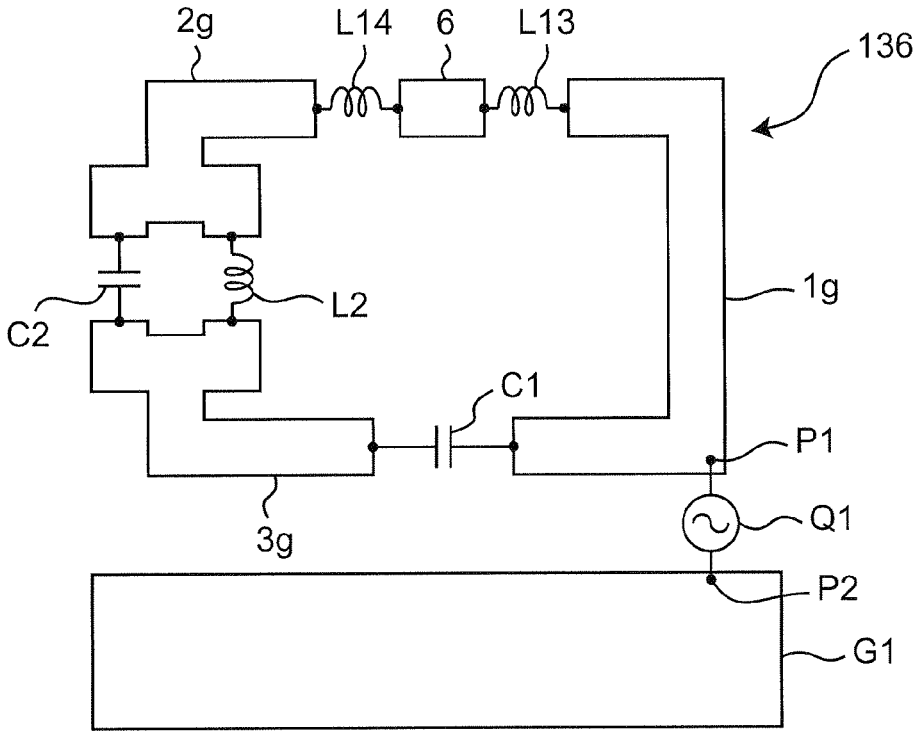
FIG. 29 is a plan view showing an antenna apparatus according to an eighteenth modified embodiment of the first embodiment of the present invention.

FIG. 29 is a plan view showing an antenna apparatus according to an eighteenth modified embodiment of the first embodiment of the present invention. A radiator 136 of the antenna apparatus of FIG. 29 is provided with radiation conductors 1*g*, 2*g*, and 3*g*, instead of the radiation conductors 1, 2, and 3 of FIG. 1, and is provided with inductors L13 and L14 and a radiation conductor 6, instead of the inductor L1 of FIG. 1. An antenna apparatus of the present embodiment is not limited to one provided with a single inductor, and may be provided with concatenated inductors, including two or more inductors. Referring to FIG. 29, the inductors L13 and L14 connected to each other by the radiation conductor 6 having a certain electrical length are inserted, instead of the inductor L1 of FIG. 1. In other words, the inductors L13 and L14 are inserted at different positions along a large loop. According to the antenna apparatus of FIG. 29, since inductors can be inserted at a plurality of different positions in consideration of the current distribution on the radiator, there is an advantageous effect that when designing the antenna apparatus, it is possible to easily achieve fine adjustments of the low-band resonance frequency f1, the mid-band resonance frequency f2, and the high-band resonance frequency f3.

The capacitors and inductors of the modified embodiments shown in FIGS. 24 to 29 may be combined. In addition, the configurations of the modified embodiments shown in FIGS. 24 to 29 may be applied to the inductor L2 and/or the capacitor C2 of the small loop.

Figure 30:
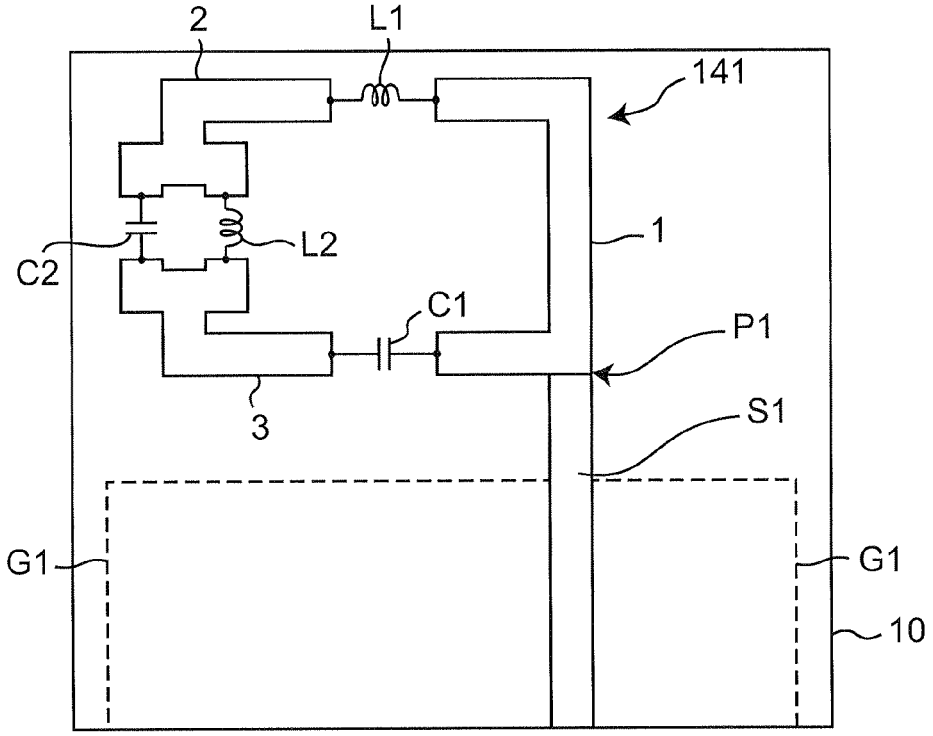
FIG. 30 is a plan view showing an antenna apparatus according to a nineteenth modified embodiment of the first embodiment of the present invention.

FIG. 30 is a plan view showing an antenna apparatus according to a nineteenth modified embodiment of the first embodiment of the present invention. The antenna apparatus of FIG. 30 is provided with a feed line as a microstrip line, including a ground conductor G1, and a strip conductor S1 provided on the ground conductor G1 with a dielectric board 10 therebetween. A radiator 141 of the antenna apparatus of FIG. 30 is configured in a similar manner as that of the radiator 101 of FIG. 1. The antenna apparatus of this modified embodiment may have a planar configuration for reducing the profile of the antenna apparatus, in other words, the ground conductor G1 may be formed on the back side of a printed circuit board, and the strip conductor S1 and the radiator 141 may be integrally formed on the front side of the printed circuit board. The feed line is not limited to a microstrip line, and may be a coplanar line, a coaxial line, etc.

Figure 31:
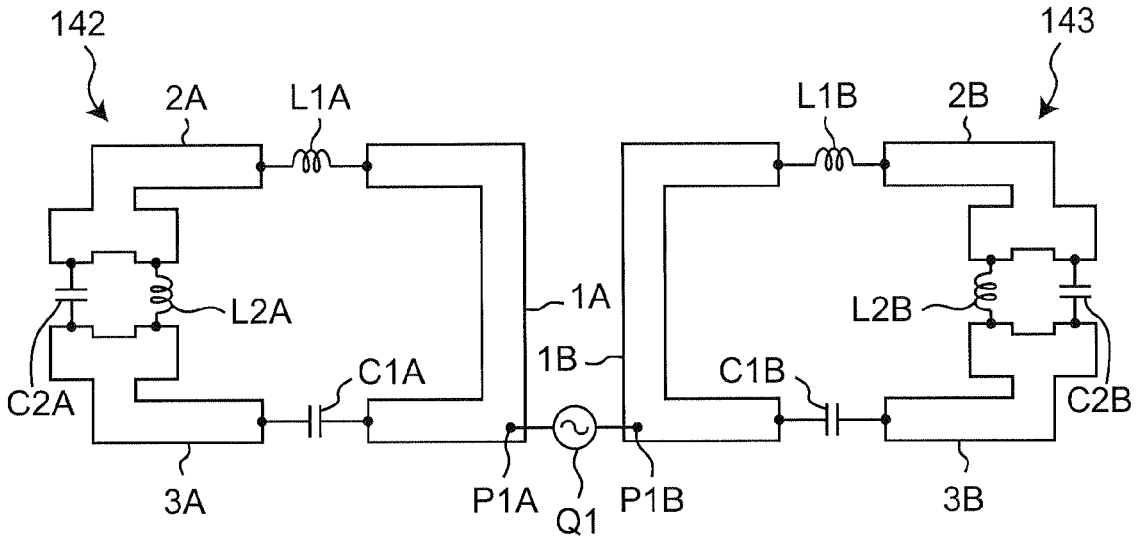
FIG. 31 is a plan view showing an antenna apparatus according to a twentieth modified embodiment of the first embodiment of the present invention.

FIG. 31 is a plan view showing an antenna apparatus according to a twentieth modified embodiment of the first embodiment of the present invention. The antenna apparatus of FIG. 31 is configured as a dipole antenna. The antenna apparatus of FIG. 31 is provided with a pair of radiators 142 and 143, each of which is configured in a similar manner as that of the radiator 101 of FIG. 1. That is, the radiator 142 is configured in a similar manner as that of the radiator 101 of FIG. 1, and has radiation conductors 1A, 2A, and 3A, an inductor L1A connecting the radiation conductors 1A and 2A, a capacitor C1A connecting the radiation conductors 1A and 3A, and a capacitor C2A and an inductor L2A connecting the radiation conductors 2A and 3A. In addition, the radiator 143 is configured in a similar manner as that of the radiator 101 of FIG. 1, and has radiation conductors 1B, 2B, and 3B, an inductor L1B connecting the radiation conductors 1B and 2B, a capacitor C1B connecting the radiation conductors 1B and 3B, and a capacitor C2B and an inductor L2B connecting the radiation conductors 2B and 3B. A signal source Q1 is connected to a feed point P1A of the radiator 142, and to a feed point P1B of the radiator 143. The antenna apparatus of this modified embodiment has a dipole configuration, and accordingly, is operable in a balance mode, thus suppressing unwanted radiation.

Figure 32:
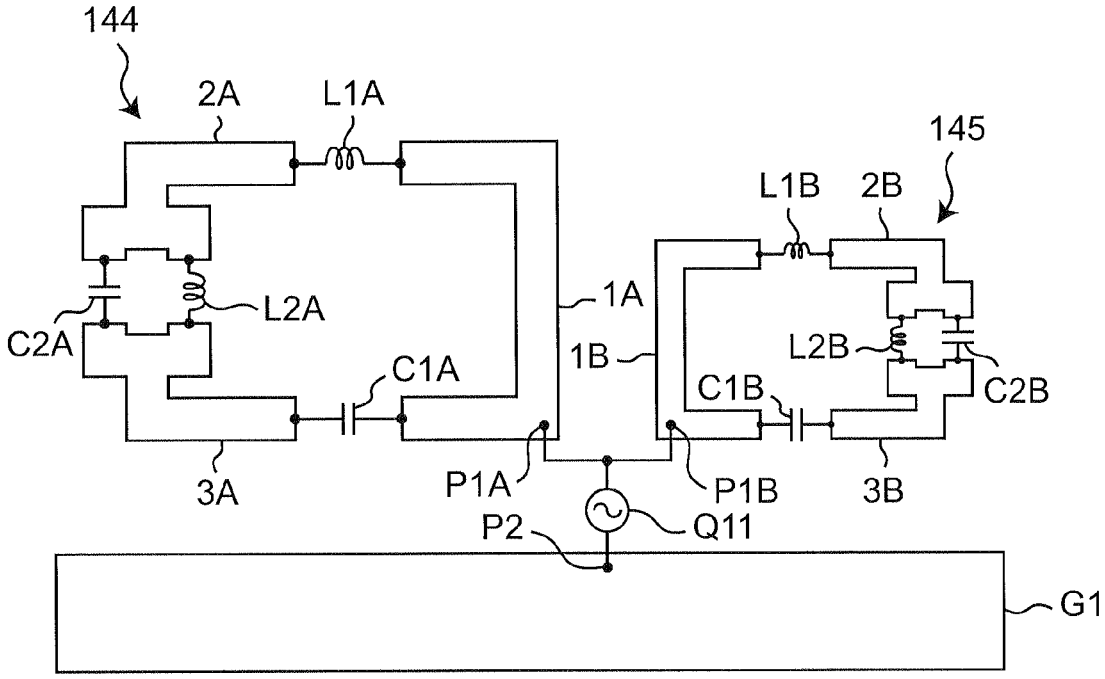
FIG. 32 is a plan view showing an antenna apparatus according to a twenty-first modified embodiment of the first embodiment of the present invention.

FIG. 32 is a plan view showing an antenna apparatus according to a twenty-first modified embodiment of the first embodiment of the present invention. The antenna apparatus of FIG. 32 is configured as a multiband antenna apparatus operable in 6 bands. The antenna apparatus of FIG. 32 is provided with a pair of radiators 144 and 145, each of which is configured in a similar manner as that of the radiator 101 of FIG. 1, except that the radiators 144 and 145 are configured to have different low-band resonance frequencies, different mid-band resonance frequencies, and different high-band resonance frequencies, respectively. That is, at least one of the following parameters differs between the radiators 144 and 145: the electrical lengths of radiation conductors (1A, 2A, and 3A; 1B, 2B, and 3B) along each large loop, the electrical lengths of radiation conductors (2A and 3A; 2B and 3B) along each small loop, the inductances of inductors (L1A; L1B), the capacitances of capacitors (C1A; C1B), the inductances of inductors (L2A; L2B), and the capacitances of capacitors (C2A; C2B). A signal source Q11 is connected to a feed point P1A on the radiation conductor 1A and to a feed point P1B on the radiation conductor 1B, and is connected to a connecting point P2 on a ground conductor G1. The signal source Q11 generates a radio-frequency signal with a low-band resonance frequency f1A, a radio-frequency signal with a mid-band resonance frequency f2A, and a radio-frequency signal with a high-band resonance frequency f3A, and generates a radio-frequency signal with another low-band resonance frequency f1B different from the low-band resonance frequency f1A, a radio-frequency signal with another mid-band resonance frequency f2B different from the mid-band resonance frequency f2A, and a radio-frequency signal with another high-band resonance frequency f3B different from the high-band resonance frequency f3A. When the radiator 144 operates at the low-band resonance frequency f1A, the radiator 144 operates in a loop antenna mode. When the radiator 144 operates at the mid-band resonance frequency f2A, the radiator 144 operates in a hybrid mode of a monopole antenna mode and a loop antenna mode. When the radiator 144 operates at the high-band resonance frequency f3A, the radiator 144 operates in a monopole antenna mode. In addition, when the radiator 145 operates at the low-band resonance frequency f1B, the radiator 145 operates in a loop antenna mode. When the radiator 145 operates at the mid-band resonance frequency f2B, the radiator 145 operates in a hybrid mode of a monopole antenna mode and a loop antenna mode. When the radiator 145 operates at the high-band resonance frequency f3B, the radiator 145 operates in a monopole antenna mode. Thus, the antenna apparatus of this modified embodiment is capable of multiband operation in 6 bands. The antenna apparatus of this modified embodiment can achieve further multiband operation by further providing a radiator.

Figure 82:
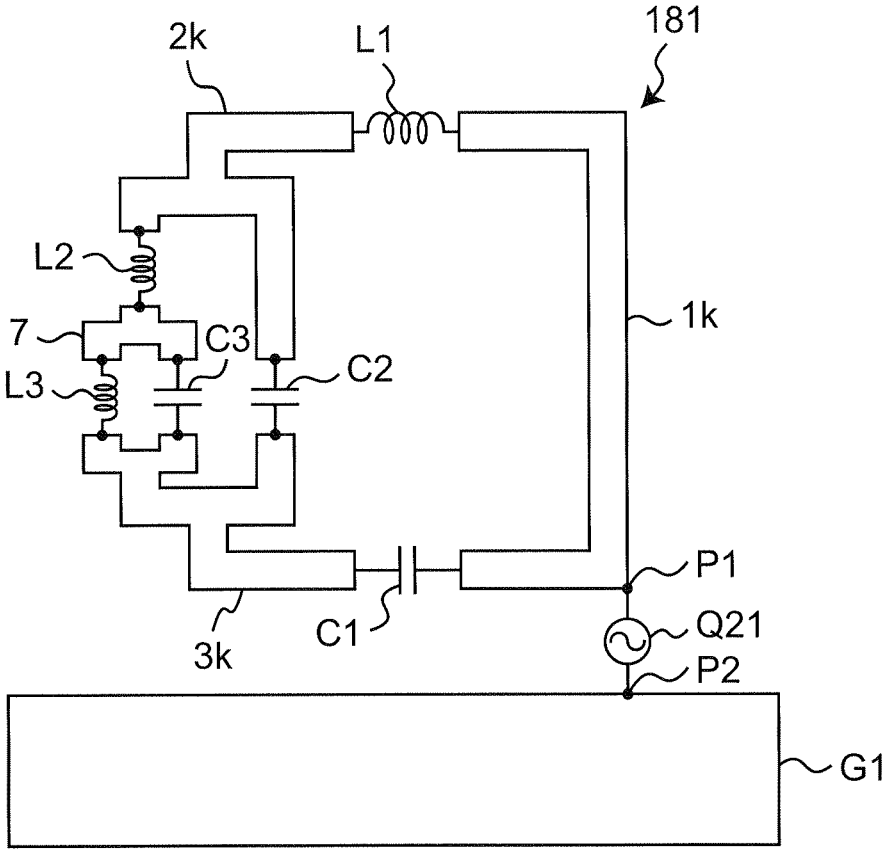
FIG. 82 is a plan view showing an antenna apparatus according to a twenty-second modified embodiment of the first embodiment of the present invention.

FIG. 82 is a plan view showing an antenna apparatus according to a twenty-second modified embodiment of the first embodiment of the present invention. The antenna apparatus of FIG. 82 has a multiloop configuration provided with a further loop in a small loop. A radiator 181 of the antenna apparatus of FIG. 82 is provided with radiation conductors 1*k*, 2*k*, and 3*k*, instead of the radiation conductors 1, 2, and 3 of FIG. 1, and in addition, between an inductor L2 and the radiation conductor 3*k* in a small loop, the radiator 181 further has, a fourth radiation conductor 7 having a certain electrical length, and an inductor L3 and a capacitor C3 connecting the radiation conductors 7 and 3*k*. The capacitor C3 and the inductor L3 are connected in parallel to each other. In the radiator 181, the radiation conductors 1*k*, 2*k*, 3*k*, and 7, the capacitors C1, C2, and C3, and the inductors L1, L2, and L3 form a first loop surrounding a central hollow portion. Portions of the radiation conductors 2*k* and 3*k* close to each other, the radiation conductor 7, the capacitors C2 and C3, and the inductors L2 and L3 form a second loop having a different resonance frequency from that of the first loop. Portions of the radiation conductors 7 and 3*k* close to each other, the capacitor C3, and the inductor L3 form a third loop having a different resonance frequency from those of the first and second loops. Further, a feed point P1 is provided on the radiation conductor 1*k*. A signal source Q21 generates radio-frequency signals at three or more frequencies. The radiator 181 is configured such that its portion including each one of the first to third loops resonates at a certain frequency. A further loop may be provided in the third loop. Since the antenna apparatus of FIG. 82 is provided with a plurality of loops, the current paths for the cases where the radiator 181 is excited at different frequencies differ from one another. Thus, it is possible to effectively achieve multiband operation.

The electrical lengths of current paths described with reference to FIGS. 3 to 6, etc., are not limited to one-quarter of the operating wavelength, and may be configured to be, for example, a multiple of the operating wavelength by (2n+1)/4, where "n" denotes a positive integer. However, from a point of view of size reduction of the antenna apparatus, it is desirable that the electrical length is re configured to be one-quarter of the operating wavelength.

By using radiation conductors made of strip conductors each having a wide width, it is possible to achieve wide-band operation at each of the low-band resonance frequency f1, the mid-band resonance frequency f2, and the high-band resonance frequency f3. In addition, radiation conductors are not limited to be shaped in a strip as shown in FIG. 1, etc., and may have any shape, as long as certain electrical lengths can be obtained among the capacitors C1 and C2 and the inductors L1 and L2.

The connecting point P1 of the signal source Q1 can be provided at any position on the radiation conductor 1.

If necessary, a matching circuit (not shown) may be further connected between the antenna apparatus and the wireless communication circuit.

In order to reduce the size of the antenna apparatus, any of the radiation conductors may be bent at at least one position.

Figure 49:
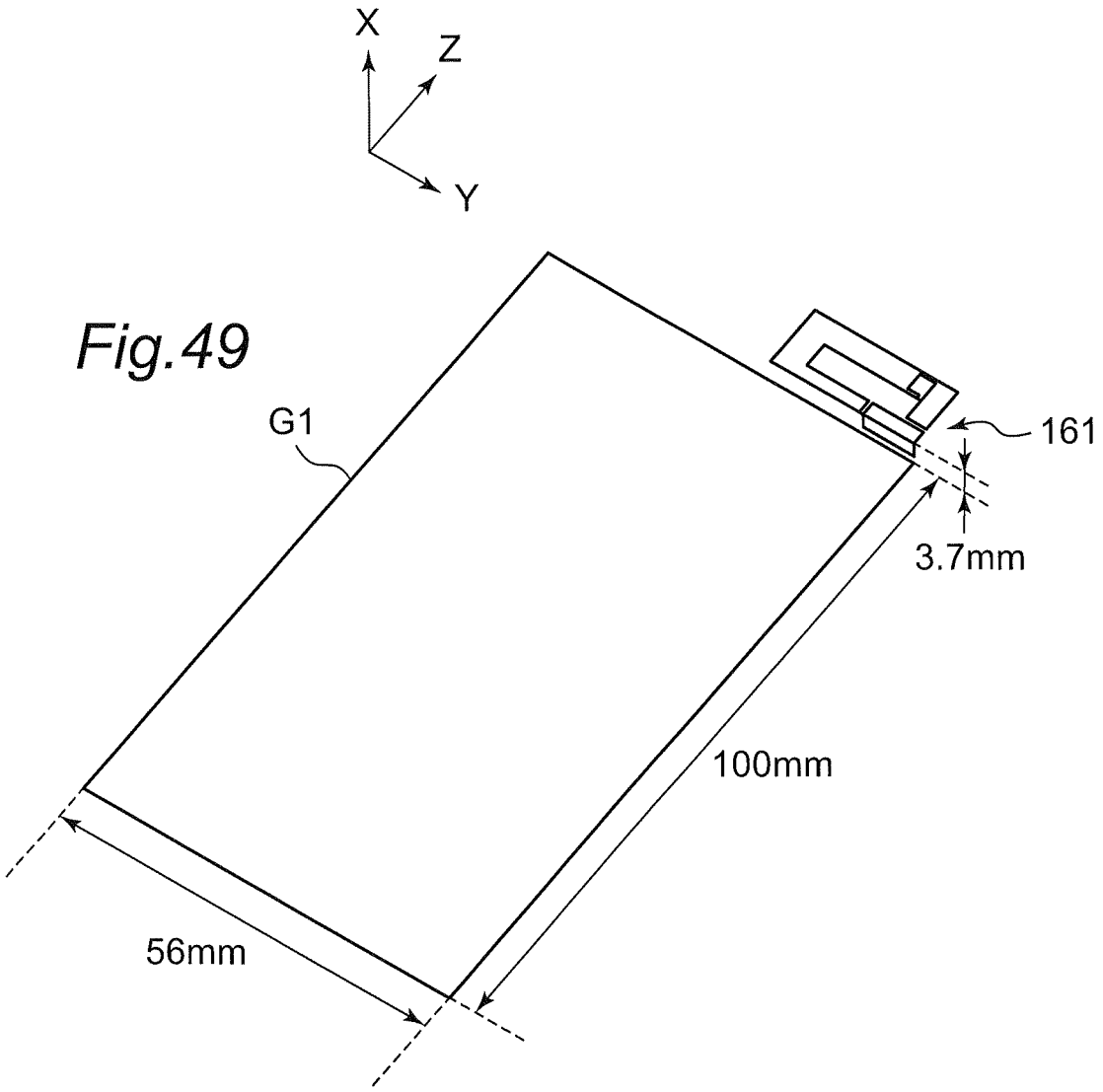
FIG. 49 is a perspective view showing an antenna apparatus according to the first implementation example.

FIG. 1, etc., show a simplified ground conductor G1. However, in practice, the ground conductor G1 is configured to have a certain area as shown in FIG. 49, etc.

Further, as another modified embodiment, an antenna apparatus according to the present embodiment can be configured as an inverted-F antenna apparatus, for example, by providing a radiator including planar or linear radiation conductors in parallel with a ground conductor, and short-circuiting a part of the radiator to the ground conductor (not shown). Short-circuiting a part of the radiator to the ground conductor results in an increased radiation resistance, and it does not impair the basic operating principle of the antenna apparatus according to the present embodiment.

Since the antenna apparatus of the present embodiment is provided with two loops, at least two inductors, and at least two capacitors, the radiator can operate in any of a loop antenna mode, a hybrid mode, and a monopole antenna mode, depending on its operating frequency. Thus, the antenna apparatus can effectively achieve triple-band operation, and reduce its size.

Second Embodiment

Figure 33:
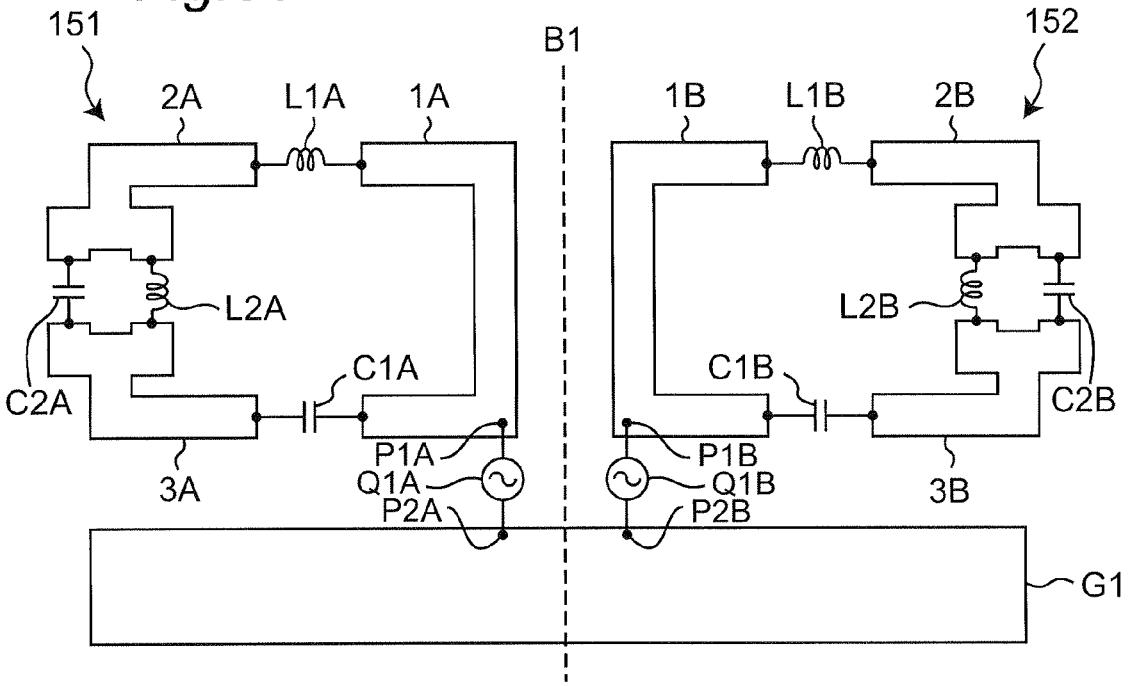
FIG. 33 is a plan view showing an antenna apparatus according to a second embodiment of the present invention.

FIG. 33 is a plan view showing an antenna apparatus according to a second embodiment of the present invention.

The antenna apparatus of the present embodiment is characterized in that the antenna apparatus is provided with two radiators 151 and 152 configured according to the similar principle as that of the radiator 101 of FIG. 1, and the radiators 151 and 152 are independently excited by different signal sources Q1A and Q1B.

Referring to FIG. 33, the radiator 151 is configured in a similar manner as that of the radiator 101 of FIG. 1, and has radiation conductors 1A, 2A, and 3A, an inductor L1A connecting the radiation conductors 1A and 2A, a capacitor C1A connecting the radiation conductors 1A and 3A, and a capacitor C2A and an inductor L2A connecting the radiation conductors 2A and 3A. The signal source Q1A is connected to a feed point P1A on the radiation conductor 1A, and is connected to a connecting point P2A on a ground conductor G1 close to the radiator 151. The radiator 152 is also configured in a similar manner as that of the radiator 101 of FIG. 1, and has radiation conductors 1B, 2B, and 3B, an inductor L1B connecting the radiation conductors 1B and 2B, a capacitor C1B connecting the radiation conductors 1B and 3B, and a capacitor C2B and an inductor L2B connecting the radiation conductors 2B and 3B. The signal source Q1B is connected to a feed point P1B on the radiation conductor 1B, and is connected to a connecting point P2B on the ground conductor G1 close to the radiator 152. The signal sources Q1A and Q1B generate, for example, radio-frequency signals as transmitting signals of MIMO communication scheme, and generate radio-frequency signals with the same low-band resonance frequency f1, radio-frequency signals with the same mid-band resonance frequency f2, and radio-frequency signals with the same high-band resonance frequency f3.

The radiators 151 and 152 are preferably configured symmetrically with respect to a reference axis B1. The radiation conductors 1A and 1B and feed portions (the feed points P1A and P1B and the connecting points P2A and P2B) are provided close to the reference axis B1, and the radiation conductors 2A, 3A, 2B, and 3B are provided remote from the reference axis B1. Since the distance between the two feed points P1A and P1B is small, it is possible to minimize an area for placing traces of feed lines from a wireless communication circuit (not shown). In addition, any of the radiation conductors 1A, 2A, 3A, 1B, 2B, and 3B may be bent at at least one position in order to reduce the size of the antenna apparatus.

Figure 34:
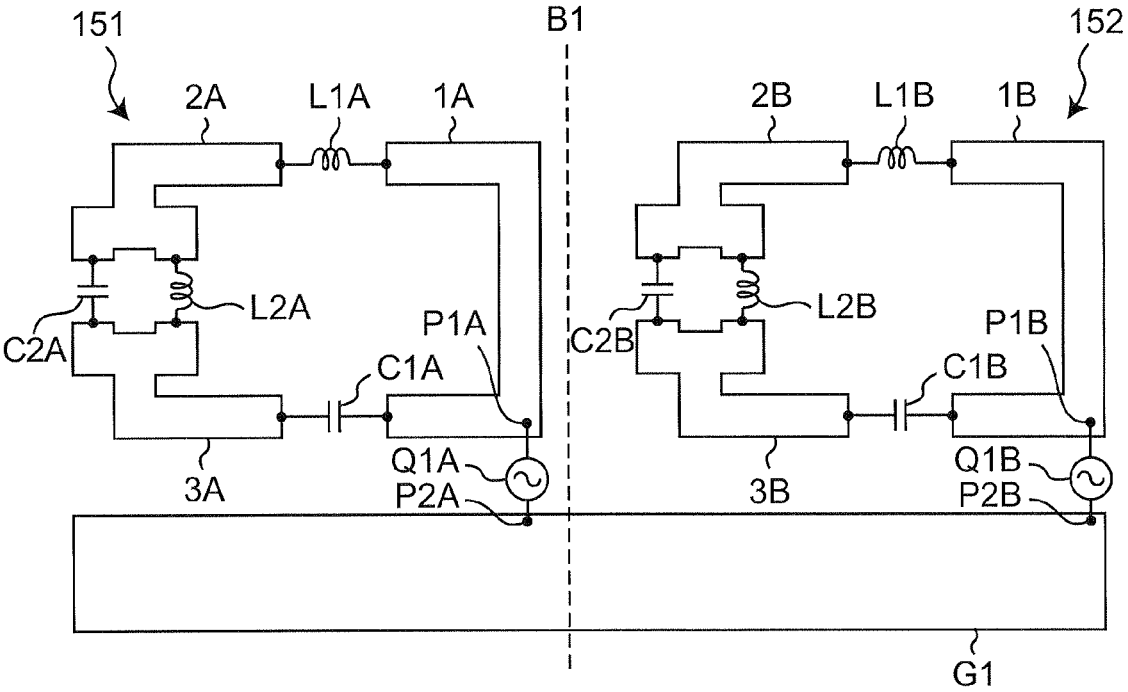
FIG. 34 is a plan view showing an antenna apparatus according to a first modified embodiment of the second embodiment of the present invention.

FIG. 34 is a plan view showing an antenna apparatus according to a first modified embodiment of the second embodiment of the present invention. According to the antenna apparatus of this modified embodiment, radiators 151 and 152 are not disposed symmetrically, but disposed in the same direction (i.e., asymmetrically). Asymmetric disposition of the radiators 151 and 152 results in their asymmetric radiation patterns, thus providing the advantageous effect of a reduced correlation between signals transmitted or received through the radiators 151 and 152. However, since a difference occurs between powers of transmitting signals and between powers of received signals, it is not possible to maximize the transmitting or receiving performance for a MIMO communication scheme. Further, three or more radiators may be disposed in a manner similar to that of the antenna apparatus of this modified embodiment.

Figure 35:
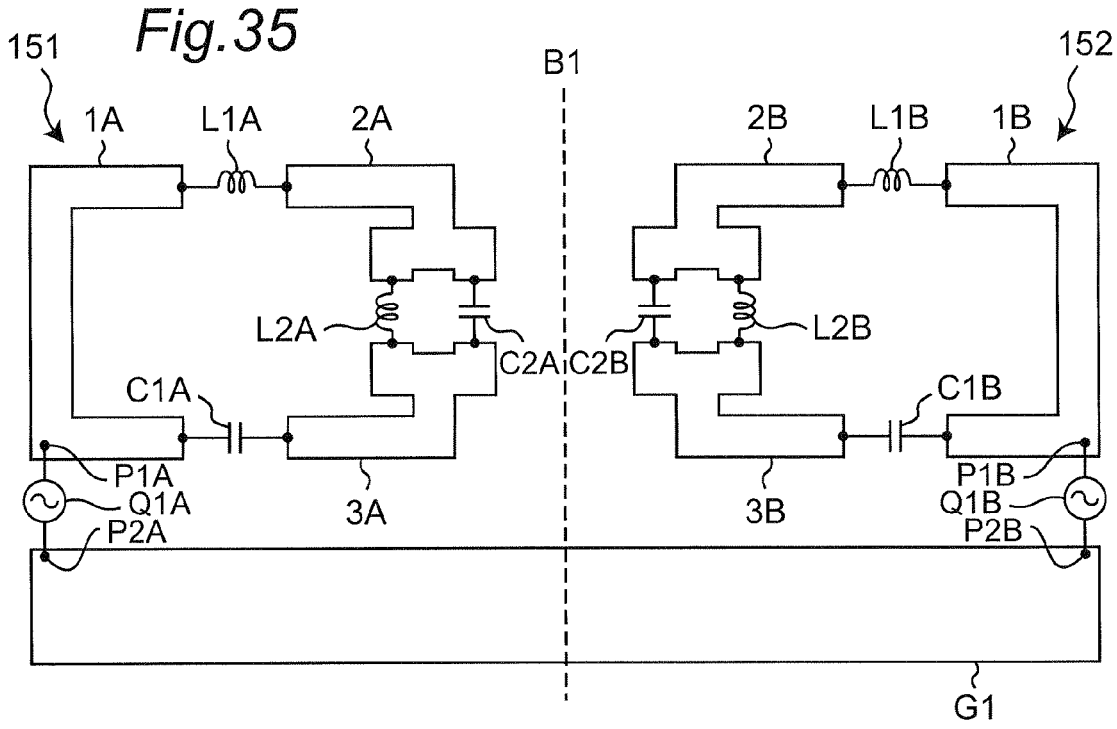
FIG. 35 is a plan view showing an antenna apparatus according to a comparison example of the second embodiment of the present invention.

FIG. 35 is a plan view showing an antenna apparatus according to a comparison example of the second embodiment of the present invention. According to the antenna apparatus of FIG. 35, radiation conductors 2A and 2B not having a feed point, and radiation conductors 3A and 3B not having a feed point are disposed close to each other. By separating feed points P1A and P1B from each other, it is possible to reduce the correlation between signals transmitted or received through radiators 151 and 152. However, since the open ends of the respective radiators 151 and 152 (i.e., the edges of the radiation conductors 2A, 2B, 3A, and 3B) are opposed to each other, the electromagnetic coupling between the radiators 151 and 152 is large.

Figure 36:
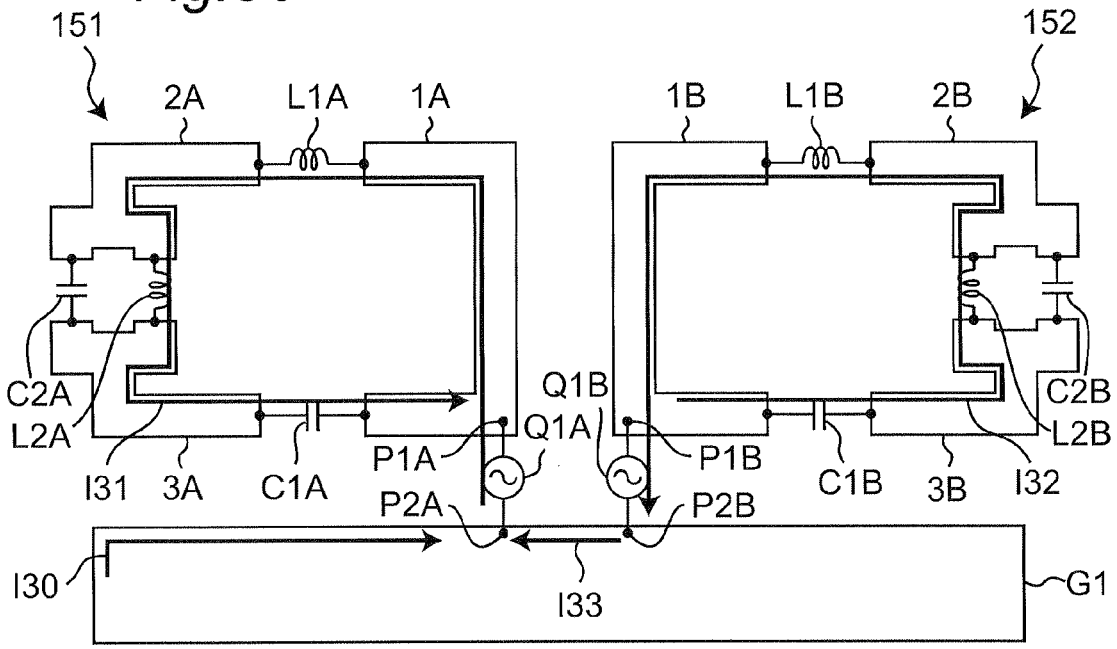
FIG. 36 is a diagram showing current paths for the case where the antenna apparatus of FIG. 33 operates at a low-band resonance frequency f1.
Figure 37:
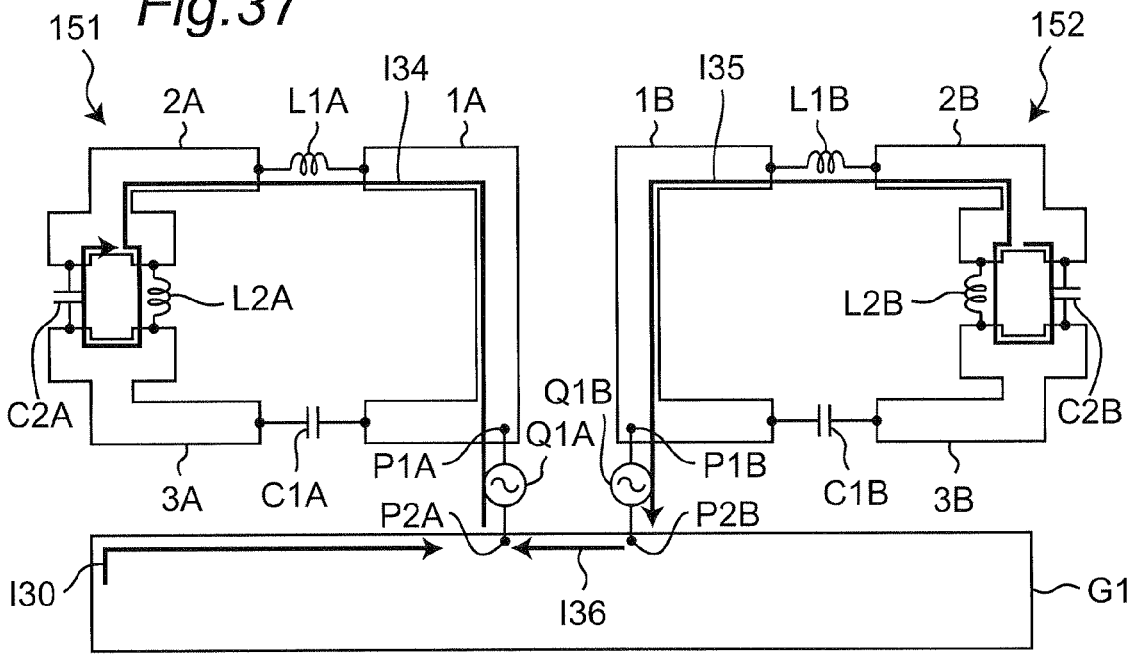
FIG. 37 is a diagram showing current paths for the case where the antenna apparatus of FIG. 33 operates at a mid-band resonance frequency f2.
Figure 38:
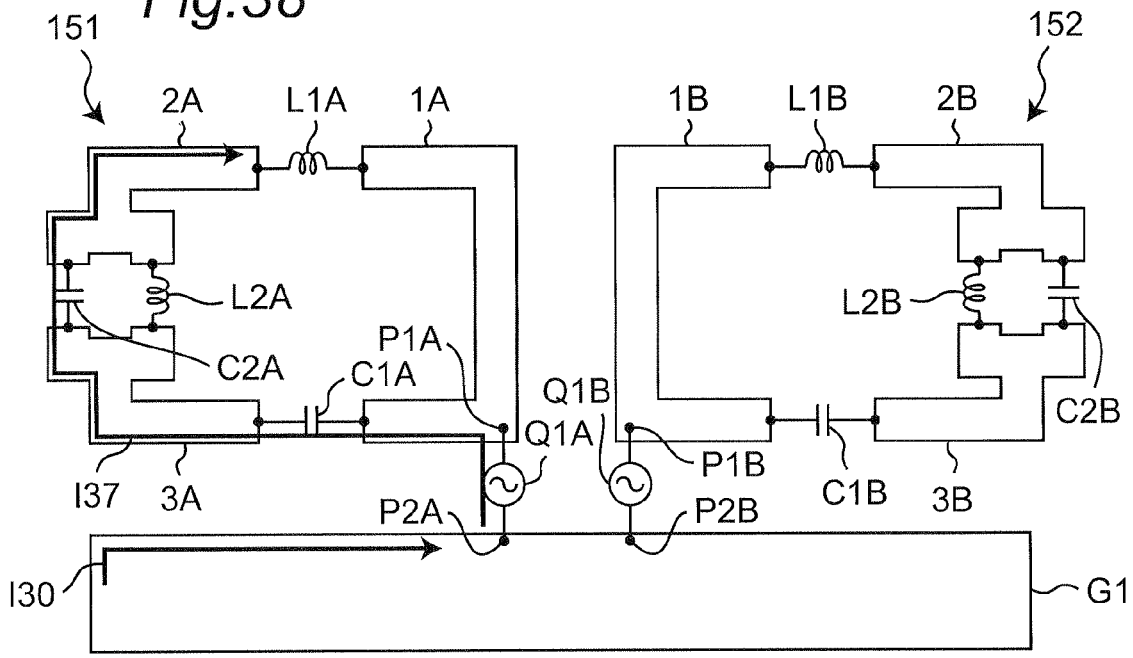
FIG. 38 is a diagram showing a current path for the case where the antenna apparatus of FIG. 33 operates at a high-band resonance frequency f3.

FIG. 36 is a diagram showing current paths for the case where the antenna apparatus of FIG. 33 operates at the low-band resonance frequency f1. Suppose that, for example, only one signal source Q1A operates when the antenna apparatus of FIG. 33 operates at the low-band resonance frequency f1. When the radiator 151 operates in a loop antenna mode by a current I31 inputted from the signal source Q1A, a magnetic field produced by the radiator 151 induces a current I32 in the radiator 152, the current I32 flowing in the same direction as the current I31, and flowing to the signal source Q1B. A current I33 also flows from the connecting point P2B to the connecting point P2A on the ground conductor G1. Since the large current I31 flows, the large electromagnetic coupling between the radiators 151 and 152 occurs. In addition, FIG. 37 is a diagram showing current paths for the case where the antenna apparatus of FIG. 33 operates at the mid-band resonance frequency f2. When the radiator 151 operates in a hybrid mode by a current I34 inputted from the signal source Q1A, a magnetic field produced by the radiator 151 induces a current I35 in the radiator 152, the current I35 flowing from a small loop of the radiator 152 toward the feed point P1B and flowing to the signal source Q1B. In the small loop of the radiator 152, the current I35 flows in the same direction as that in which the current I34 flows along a small loop of the radiator 151. A current I36 also flows from the connecting point P2B to the connecting point P2A on the ground conductor G1. FIG. 38 is a diagram showing a current path for the case where the antenna apparatus of FIG. 33 operates at the high-band resonance frequency f3. In the radiator 151, a current I37 inputted from the signal source Q1A flows in a direction remote from the radiator 152. Therefore, the electromagnetic coupling between the radiators 151 and 152 is small, and an induced current flowing through the radiator 152 and the signal source Q1B is also small.

Figure 39:
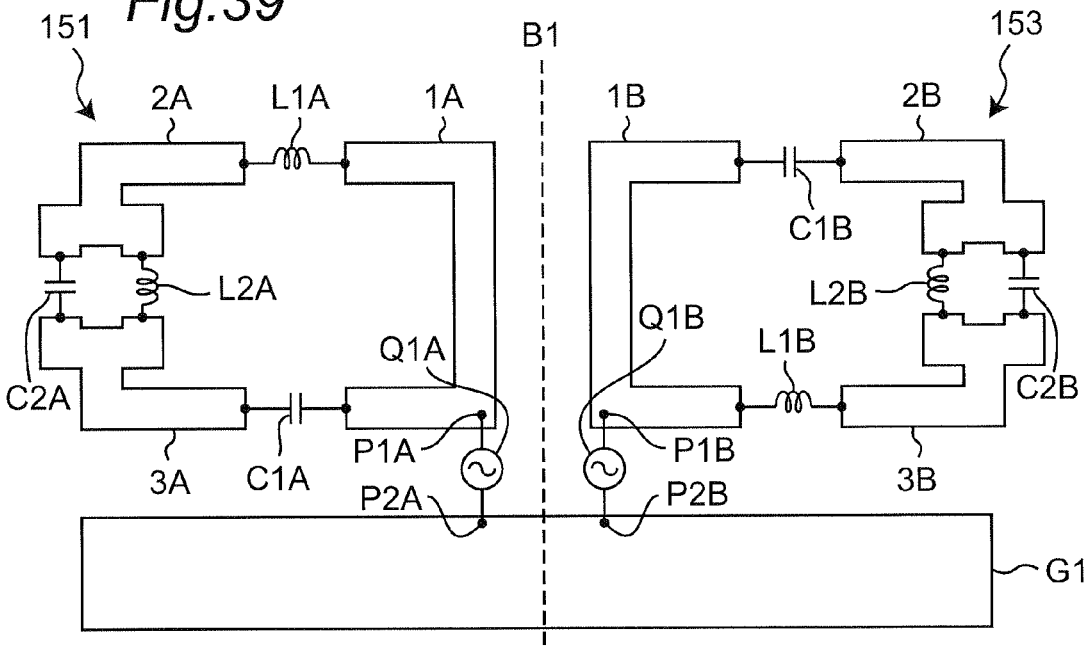
FIG. 39 is a plan view showing an antenna apparatus according to a second modified embodiment of the second embodiment of the present invention.

The configuration of the antenna apparatus of FIG. 33 shows the case in which the radiators 151 and 152 are configured completely symmetrically with respect to the reference line B1. In this case, the current distributions of the two radiators 151 and 152 are the same, and thus, the radiation patterns thereof are also the same. As a result, as described with reference to FIGS. 36 and 37, when the antenna apparatus of FIG. 33 operates at the low-band resonance frequency f1 or the mid-band resonance frequency f2, the large electromagnetic coupling between the radiators 151 and 152 occurs, and it results in the high correlation between transmitted or received signals, thus degrading the transmission and reception performance of MIMO communication scheme. However, in order to perform wireless communication of MIMO communication scheme, it is necessary to reduce the electromagnetic coupling between the radiators 151 and 152. Accordingly, FIG. 39 shows a configuration of an improved antenna apparatus. By changing the positions of an inductor L1B and a capacitor C1B of a radiator 153 with each other, the currents flow asymmetrically between the two radiators 151 and 153 at the low-band resonance frequency f1 and the mid-band resonance frequency f2, and thus, it is possible to obtain different radiation patterns at these frequencies. Thus, it results in the low correlation between transmitted or received signals, thus improving transmission and reception performance of MIMO communication scheme.

FIG. 39 is a plan view showing an antenna apparatus according to a second modified embodiment of the second embodiment of the present invention. The antenna apparatus of this modified embodiment is provided with the radiator 153 in which the positions of the capacitor C1B and the inductor L1B of the radiator 152 of FIG. 33 are changed with each other, in order to reduce the electromagnetic coupling between the radiators 151 and 152 for the case where the antenna apparatus operates at the low-band resonance frequency f1 and the mid-band resonance frequency f2. Therefore, the antenna apparatus of FIG. 39 is provided with the radiators 151 and 153 configured symmetrically with respect to a reference axis B1, and the inductor L1B of the radiator 153 is provided at a position corresponding to that of a capacitor CIA of the radiator 151, and the capacitor C1B of the radiator 153 is provided at a position corresponding to that of an inductor L1A of the radiator 151. Thus, since the capacitors CIA and C1B and the inductors L1A and L1B are disposed asymmetrically between the radiators 151 and 153, the electromagnetic coupling between the radiators 151 and 153 is reduced.

Figure 40:
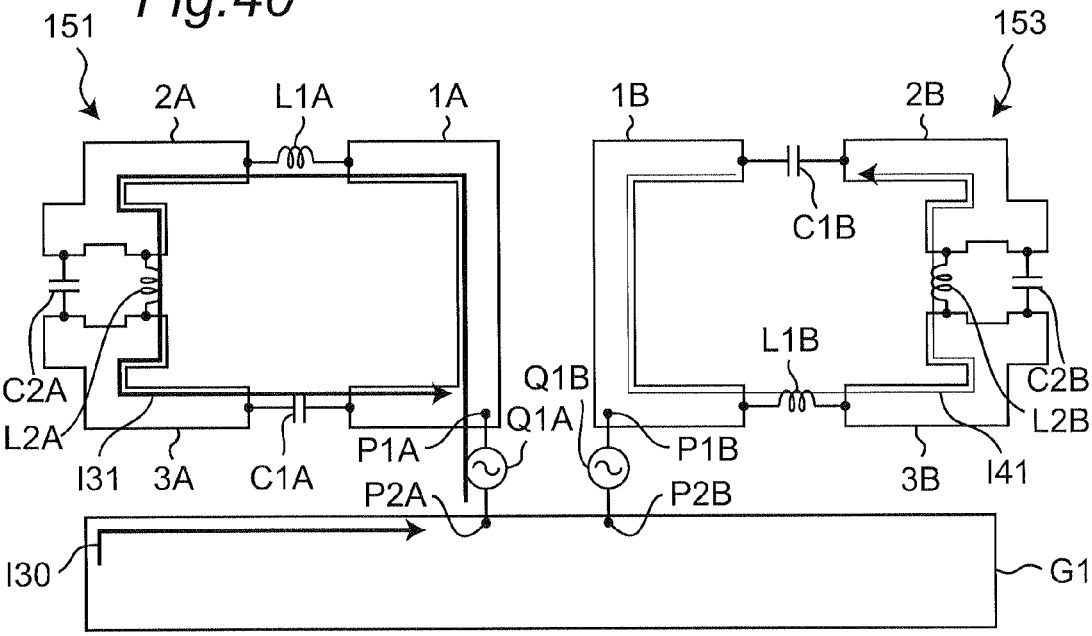
FIG. 40 is a diagram showing a current path for the case where the antenna apparatus of FIG. 39 operates at the low-band resonance frequency f1.
Figure 41:
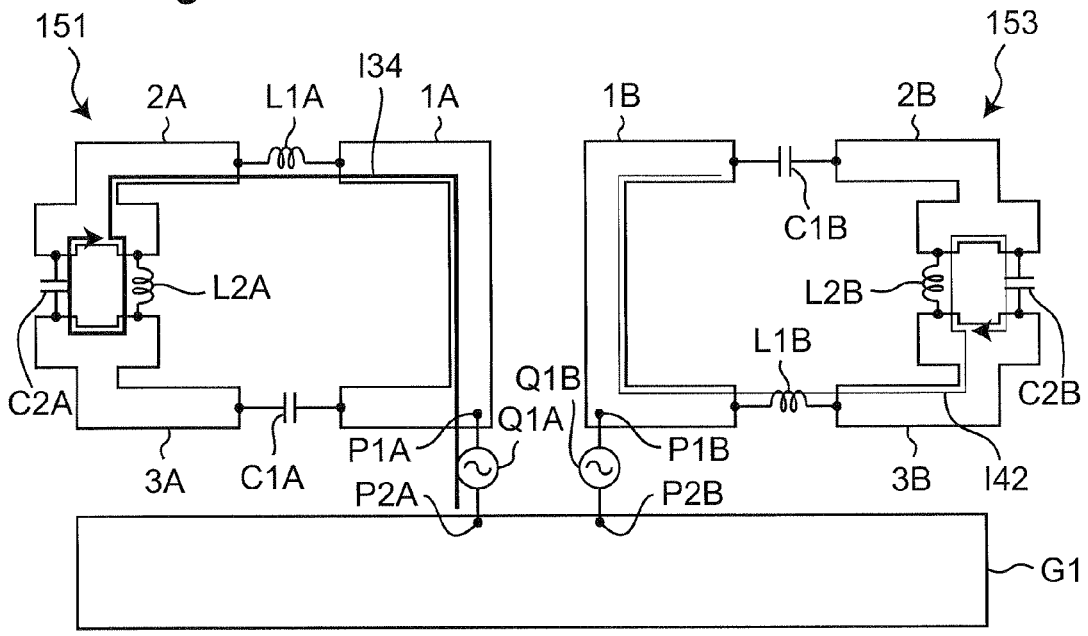
FIG. 41 is a diagram showing a current path for the case where the antenna apparatus of FIG. 39 operates at the mid-band resonance frequency f2.
Figure 42:
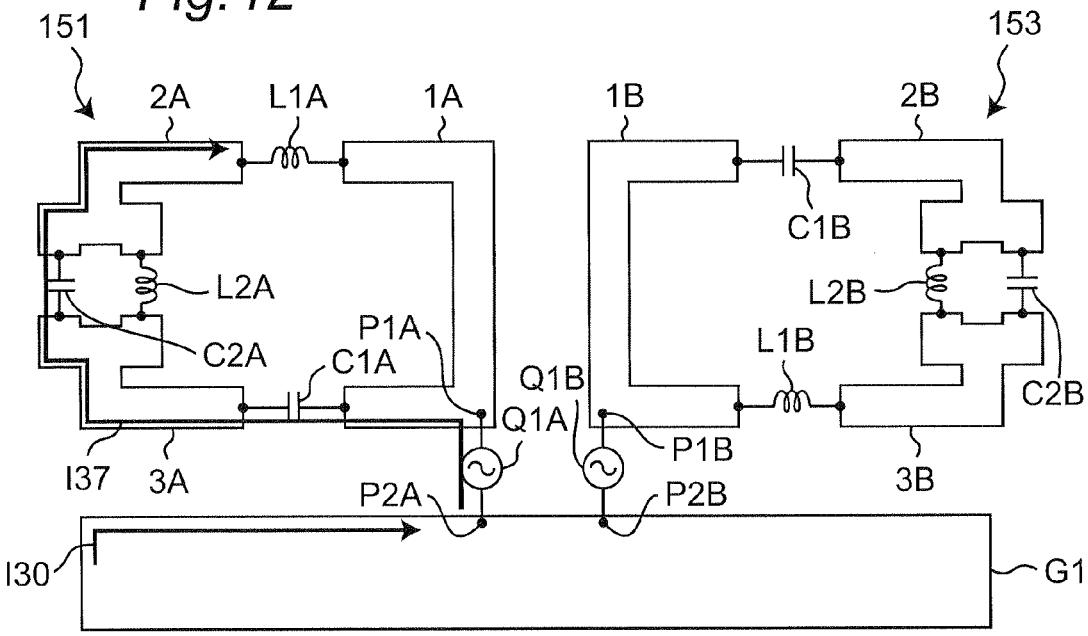
FIG. 42 is a diagram showing a current path for the case where the antenna apparatus of FIG. 39 operates at the high-band resonance frequency f3.

FIG. 40 is a diagram showing a current path for the case where the antenna apparatus of FIG. 39 operates at the low-band resonance frequency f1. As described above, by nature, a current having a low frequency component can pass through an inductor, but is difficult to pass through a capacitor. Therefore, even when the radiator 151 operates in a loop antenna mode by a current I31 inputted from a signal source Q1A, only a small current I41 is induced in the radiator 153, and also, only a small current flows from the radiator 153 to a signal source Q1B. Hence, the electromagnetic coupling between the radiators 151 and 153 for the case where the antenna apparatus of FIG. 39 operates at the low-band resonance frequency f1 decreases. In addition, FIG. 41 is a diagram showing a current path for the case where the antenna apparatus of FIG. 39 operates at the mid-band resonance frequency f2. Even when the radiator 151 operates in a hybrid mode by a current I34 inputted from the signal source Q1A, only a small current I42 is induced in the radiator 153, and also, only a small current flows from the radiator 153 to the signal source Q1B. Hence, the electromagnetic coupling between the radiators 151 and 153 for the case where the antenna apparatus of FIG. 39 operates at the mid-band resonance frequency f2 also decreases. In addition, FIG. 42 is a diagram showing a current path for the case where the antenna apparatus of FIG. 39 operates at the high-band resonance frequency f3. In this case, the electromagnetic coupling between the radiators 151 and 153 is small as in the case of FIG. 38.

Figure 43:
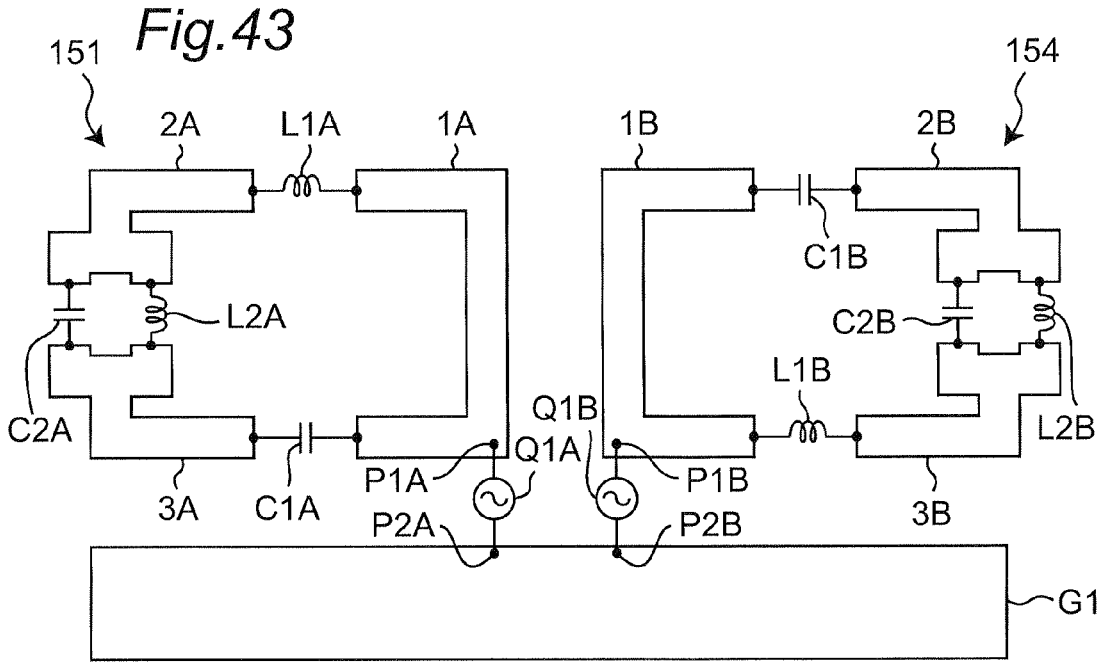
FIG. 43 is a plan view showing an antenna apparatus according to a third modified embodiment of the second embodiment of the present invention.

According to the antenna apparatus of FIG. 39, although the inductors L1A and L1B and the capacitors CIA and C1B are disposed asymmetrically with respect to the reference line B1 between the radiators 151 and 153, inductors L2A and L2B and capacitors C2A and C2B of small loops are disposed symmetrically with respect to the reference line B1. Therefore, when the antenna apparatus of FIG. 39 operates at the mid-band resonance frequency f2, the current distributions of the small loops of the two radiators 151 and 153 are the same, and thus, radiation patterns resulting from currents flowing through the respective small loops are also the same. Hence, electromagnetic coupling between the small loops of the radiators 151 and 153 occurs, the electromagnetic coupling contributes to the high correlation between transmitted or received signals, thus degrading the transmission and reception performance of MIMO communication scheme. FIG. 43 shows a configuration of an improved antenna apparatus. By changing the positions of an inductor L2B and a capacitor C2B of a radiator 154 with each other, the currents in the small loops flow asymmetrically between the two radiators 151 and 154 for the case where the antenna apparatus operates at the mid-band resonance frequency f2, it is possible to obtain different radiation patterns. Thus, it results in the low correlation between transmitted or received signals, thus improving transmission and reception performance of MIMO communication scheme.

FIG. 43 is a plan view showing an antenna apparatus according to a third modified embodiment of the second embodiment of the present invention. The antenna apparatus of FIG. 43 is provided with the radiator 154 in which the positions of the capacitor C2B and the inductor L2B of the radiator 153 of FIG. 39 are changed with each other. Therefore, in the antenna apparatus of FIG. 43, the inductor L2B of the radiator 154 is provided at a position corresponding to that of a capacitor C2A of the radiator 151, and the capacitor C2B of the radiator 154 is provided at a position corresponding to that of an inductor L2A of the radiator 151.

Figure 44:
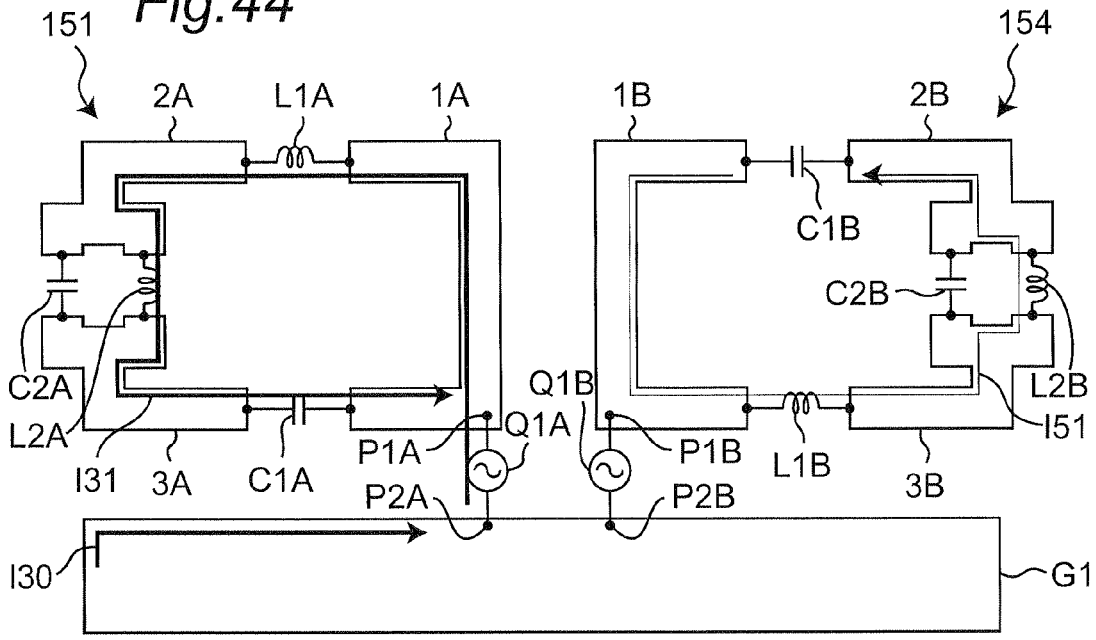
FIG. 44 is a diagram showing a current path for the case where the antenna apparatus of FIG. 43 operates at the low-band resonance frequency f1.
Figure 45:
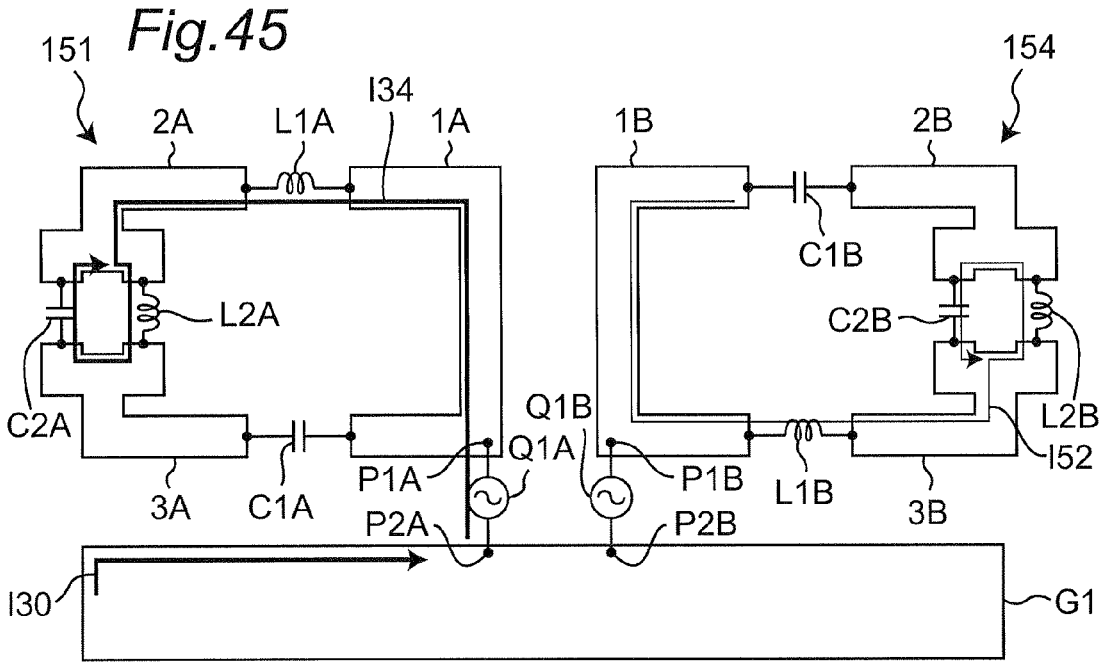
FIG. 45 is a diagram showing a current path for the case where the antenna apparatus of FIG. 43 operates at the mid-band resonance frequency f2.
Figure 46:
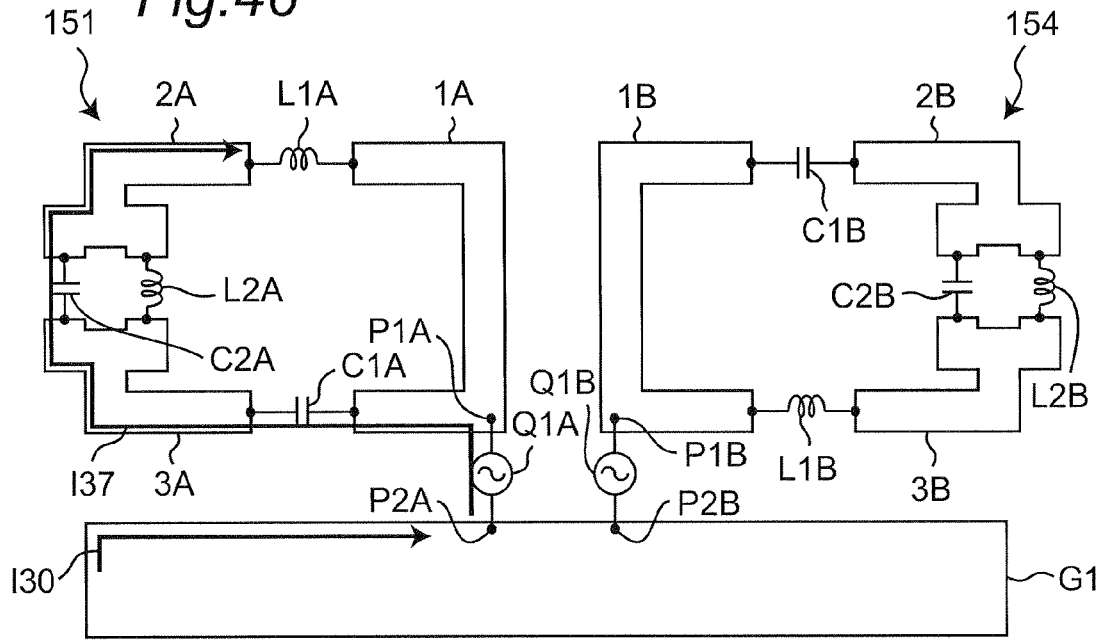
FIG. 46 is a diagram showing a current path for the case where the antenna apparatus of FIG. 43 operates at the high-band resonance frequency f3.

FIG. 44 is a diagram showing a current path for the case where the antenna apparatus of FIG. 43 operates at the low-band resonance frequency f1. Even when the radiator 151 operates in a loop antenna mode by a current I31 inputted from a signal source Q1A, only a small current I51 is induced in the radiator 154, and also, only a small current flowing from the radiator 154 to a signal source Q1B. Hence, the electromagnetic coupling between the radiators 151 and 154 for the case where the antenna apparatus of FIG. 43 operates at the low-band resonance frequency f1 decreases. In addition, FIG. 45 is a diagram showing a current path for the case where the antenna apparatus of FIG. 43 operates at the mid-band resonance frequency f2. Even when the radiator 151 operates in a hybrid mode by a current I34 inputted from the signal source Q1A, only a small current I52 is induced in the radiator 154, and also, only a small current flowing from the radiator 154 to the signal source Q1B. Further, in a small loop of the radiator 154, the current I52 flows in an opposite direction to that in which the current I34 flows along a small loop of the radiator 151. Thus, the electromagnetic coupling between the small loops of the radiators 151 and 154 decreases. In addition, FIG. 46 is a diagram showing a current path for the case where the antenna apparatus of FIG. 43 operates at the high-band resonance frequency f3. In this case, the electromagnetic coupling between the radiators 151 and 154 is small as in the case of FIGS. 38 and 42.

The antenna apparatus of FIG. 43 can form different current paths in the two radiators 151 and 154, and thus, obtain different radiation patterns, at any of the low-band resonance frequency f1, the mid-band resonance frequency f2, and the high-band resonance frequency f3. Thus, it results in the low correlation between transmitted or received signals, thus improving transmission and reception performance of MIMO communication scheme.

Figure 47:
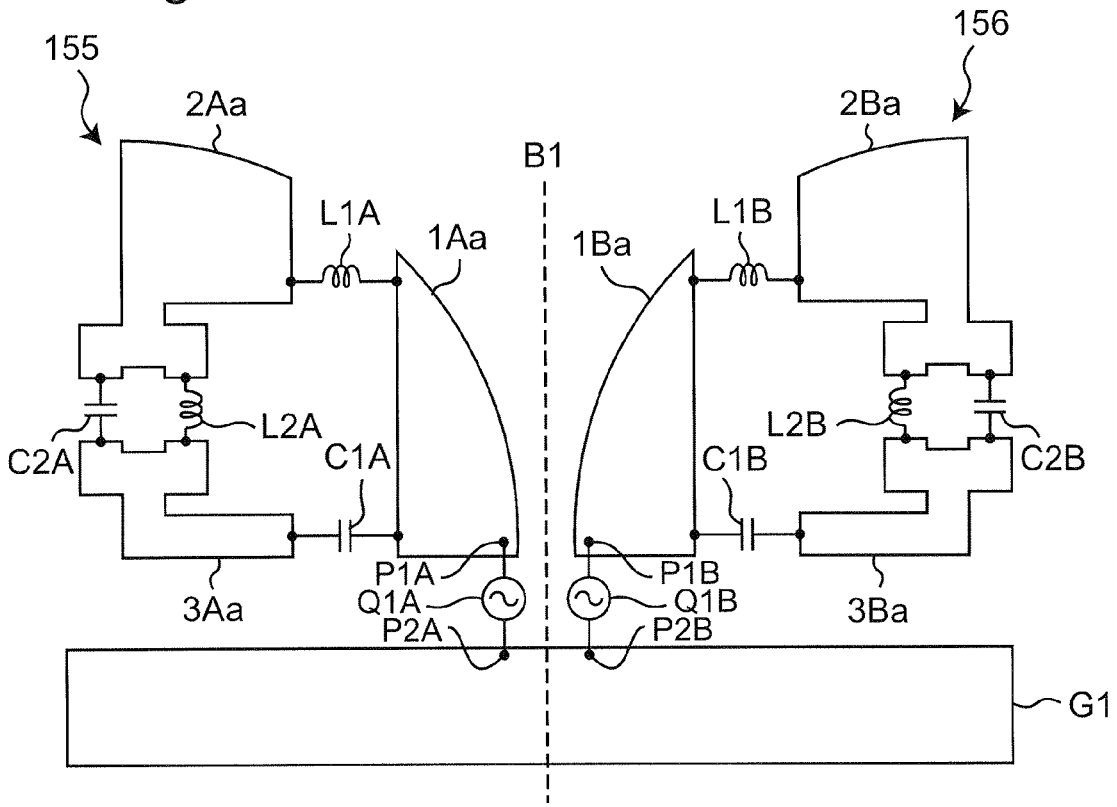
FIG. 47 is a plan view showing an antenna apparatus according to a fourth modified embodiment of the second embodiment of the present invention.

FIG. 47 is a plan view showing an antenna apparatus according to a fourth modified embodiment of the second embodiment of the present invention. It is possible to reduce the electromagnetic coupling between the radiators 155 and 156, by shaping radiators 155 and 156 such that a distance between the radiators 155 and 156 gradually increases as a distance from feed points P1A and P1B increases. The radiator 155 is provided with radiation conductors 1Aa, 2Aa, and 3Aa, instead of the radiation conductors 1A, 2A, and 3A of the radiator 151 of FIG. 33, and the radiator 156 is provided with radiation conductors 1Ba, 2Ba, and 3Ba, instead of the radiation conductors 1B, 2B, and 3B of the radiator 152 of FIG. 33. Further, in the case in which any of the radiation conductors has a protrusion as shown in FIG. 47 (e.g., the top ends of the radiation conductors 2Aa and 2Ba), a current may flow from a small loop not toward an inductor L1A or LIB, but toward the protruding portion, when the antenna apparatus operates at the high-band resonance frequency f3.

Figure 48:
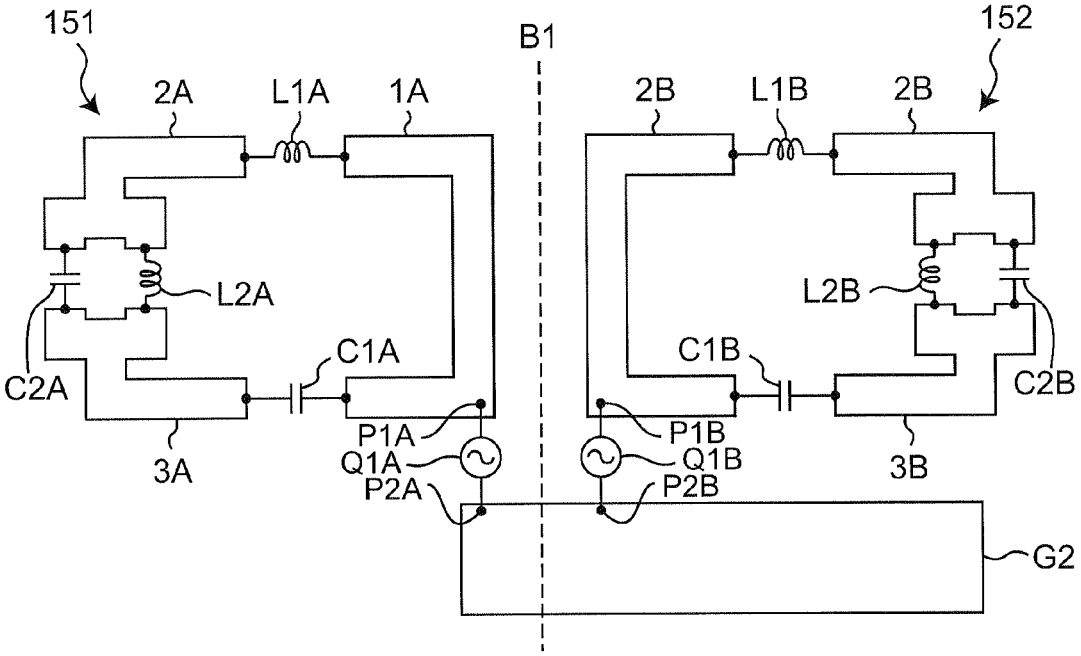
FIG. 48 is a plan view showing an antenna apparatus according to a fifth modified embodiment of the second embodiment of the present invention.

FIG. 48 is a plan view showing an antenna apparatus according to a fifth modified embodiment of the second embodiment of the present invention. A method for reducing the electromagnetic coupling between two radiators is not limited to that of FIGS. 39 and 43, in which inductors and capacitors are disposed asymmetrical. The antenna apparatus of FIG. 48 is provided with an asymmetrical ground conductor G2 in order to reduce the electromagnetic coupling between two radiators. Further, it is also possible to reduce the electromagnetic coupling between the two radiators 151 and 152 of the antenna apparatus of FIG. 33, by using corresponding inductors with different inductances and using corresponding capacitors with different capacitances, or using corresponding radiation conductors with different electrical lengths, or disposing the radiators 151 and 152 remote from each other. Further, the two radiators do not necessarily need to be provided symmetrically with respect to the reference line, and may also be provided asymmetrically. The two radiators may be connected to any position of the ground conductor G1 or G2. In any of the above-described cases, triple-band operation is not impaired.

Third Embodiment

Figure 83:
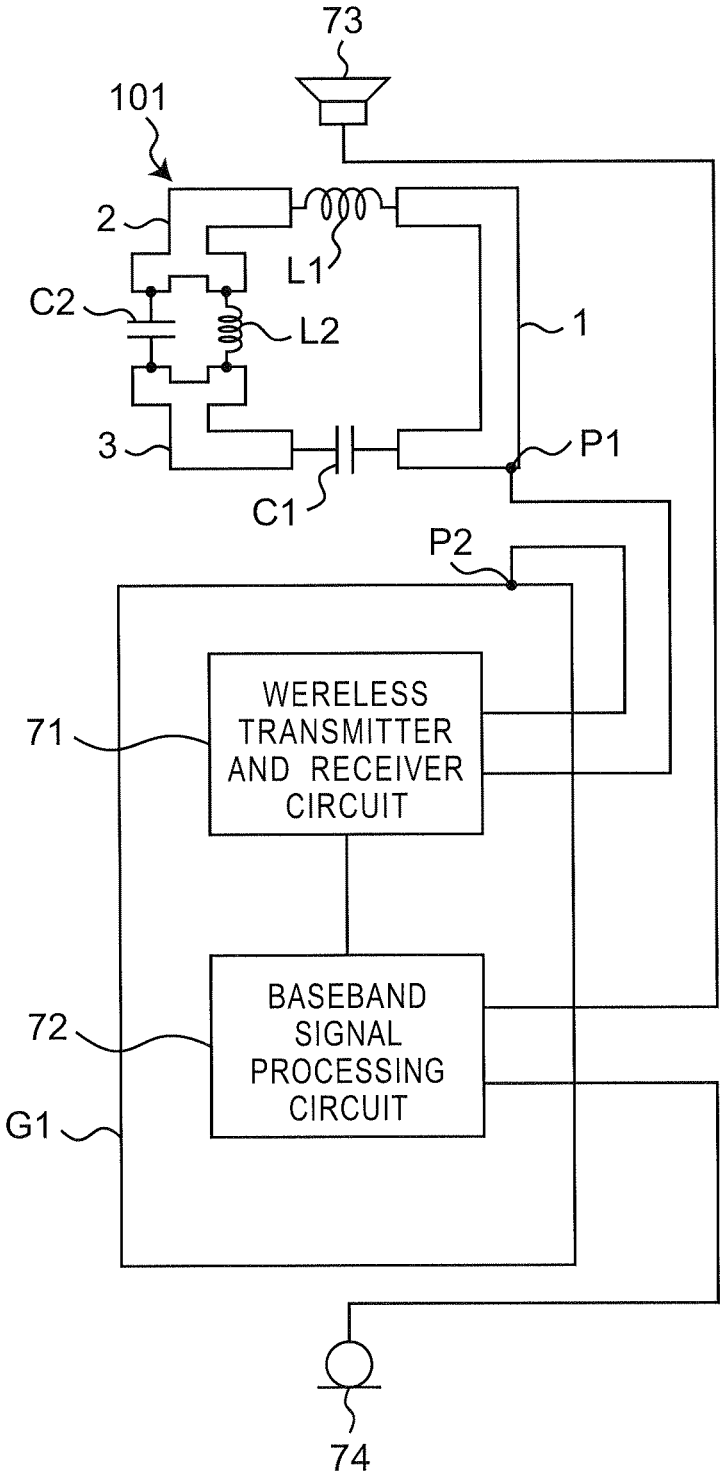
FIG. 83 is a block diagram showing a configuration of a wireless communication apparatus according to a third embodiment of the present invention, the wireless communication apparatus being provided with an antenna apparatus of FIG. 1.

FIG. 83 is a block diagram showing a configuration of a wireless communication apparatus according to a third embodiment of the present invention, the wireless communication apparatus being provided with an antenna apparatus of FIG. 1. A wireless communication apparatus according to an embodiment of the present invention may be configured as, for example, a mobile phone as shown in FIG. 83. The wireless communication apparatus of FIG. 83 is provided with an antenna apparatus of FIG. 1, a wireless transmitter and receiver circuit 71, a baseband signal processing circuit 72 connected to the wireless transmitter and receiver circuit 71, and a speaker 73 and a microphone 74 which are connected to the baseband signal processing circuit 72. A feed point P1 of a radiator 101 and a connecting point P2 of a ground conductor G1 of the antenna apparatus are connected to the wireless transmitter and receiver circuit 71, instead of a signal source Q1 of FIG. 1. when a wireless broadband router apparatus, a high-speed wireless communication apparatus for M2M (Machine-to-Machine), or the like, is implemented as a wireless communication apparatus, it is not necessary to have a speaker, a microphone, etc., and alternatively, an LED (Light-Emitting Diode), etc., may be used to check the communication status of the wireless communication apparatus. Wireless communication apparatuses to which antenna apparatuses of FIG. 1, etc., are applicable are not limited to those exemplified above.

According to the wireless communication apparatus of the present embodiment, it is possible to effectively achieve triple-band operation and reduce size of the wireless communication apparatus, by using the radiator 101 operable in one of a loop antenna mode, a hybrid mode, and a monopole antenna mode, depending on operating frequency.

The embodiments and modified embodiments described above may be combined with each other.

First Implementation Example

With reference to FIGS. 49 to 55, simulation results for a first implementation example of the first embodiment of the present invention will be described below.

In the simulations, a transient analysis was performed using the FDTD method. A point at which reflection energy at the feed point P1 is −40 dB or less with respect to input energy was used as a threshold value for determining convergence. A portion where a current flows strongly was finely modeled using the sub-mesh method.

Figure 50:
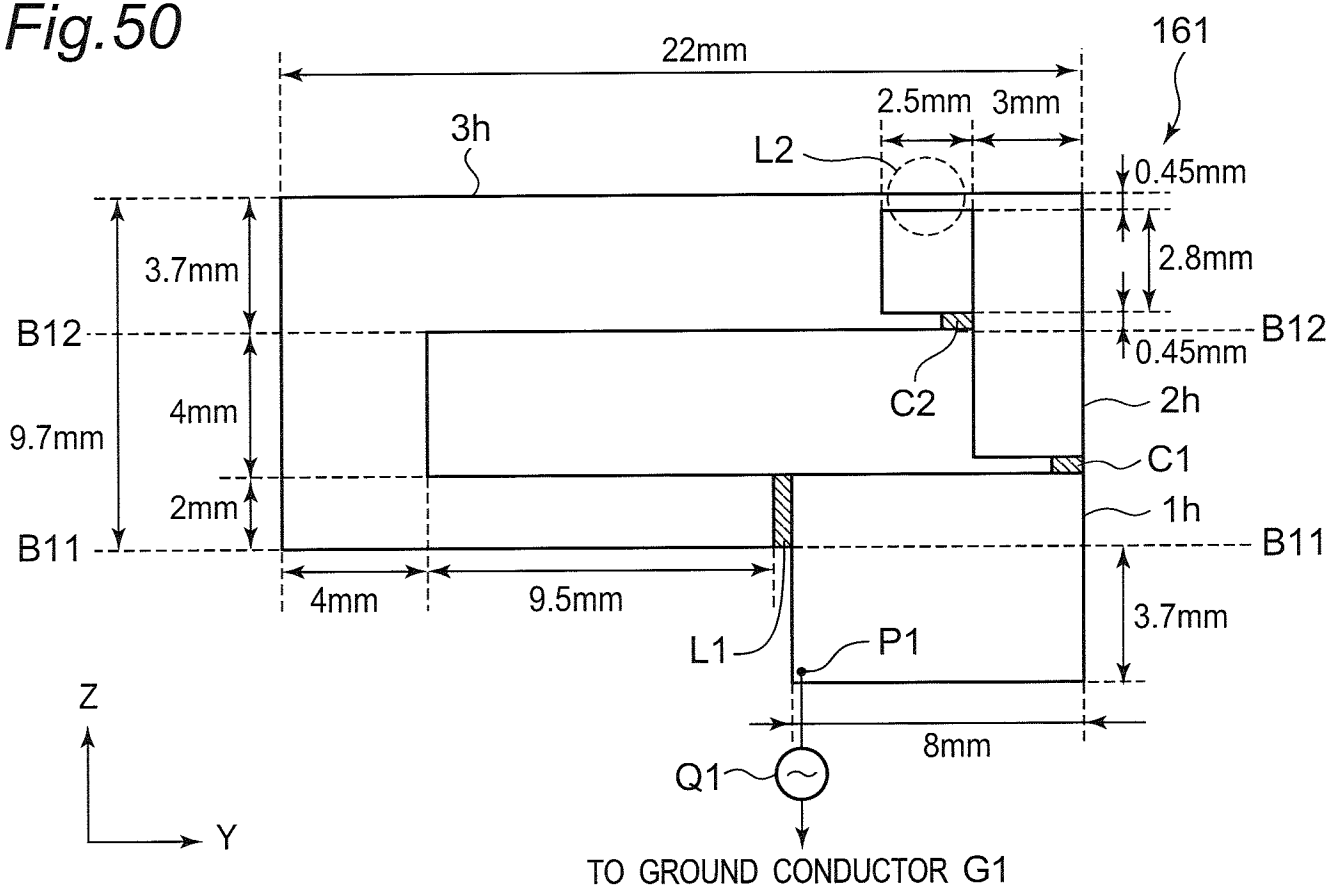
FIG. 50 is a developed view showing a detailed configuration of a radiator 161 of FIG. 49.

FIG. 49 is a perspective view showing an antenna apparatus according to the first implementation example. FIG. 50 is a developed view showing a detailed configuration of a radiator 161 of FIG. 49. The radiator 161 is provided with radiation conductors 1*h*, 2*h*, and 3*h*, inductors L1 and L2, and capacitors C1 and C2. Referring to FIG. 50, the capacitor C1 has a capacitance of 1.2 pF, the inductor L1 has an inductance of 5.2 nH, and the capacitor C2 has a capacitance of 5.0 pF, and the inductor L2 is made of a strip conductor. The radiation conductor 1*h* is bent in a −X direction at line B11 in FIG. 50.

Figure 51:
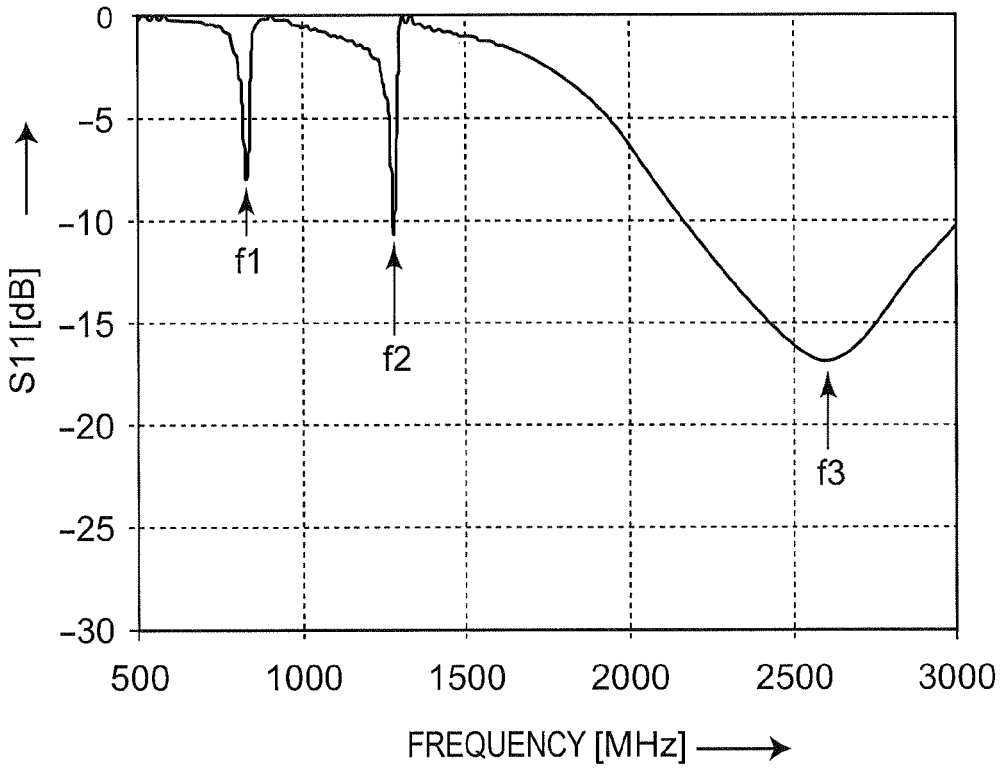
FIG. 51 is a graph showing a frequency characteristic of a reflection coefficient S11 for the antenna apparatus of FIG. 49.

FIG. 51 is a graph showing a frequency characteristic of a reflection coefficient S11 for the antenna apparatus of FIG. 49. According to the computation results, it can be seen that the antenna apparatus of the first implementation example resonates at three frequencies: f1=817 MHz, f2=1272 MHz, and f3=2592 MHz.

Figure 52:
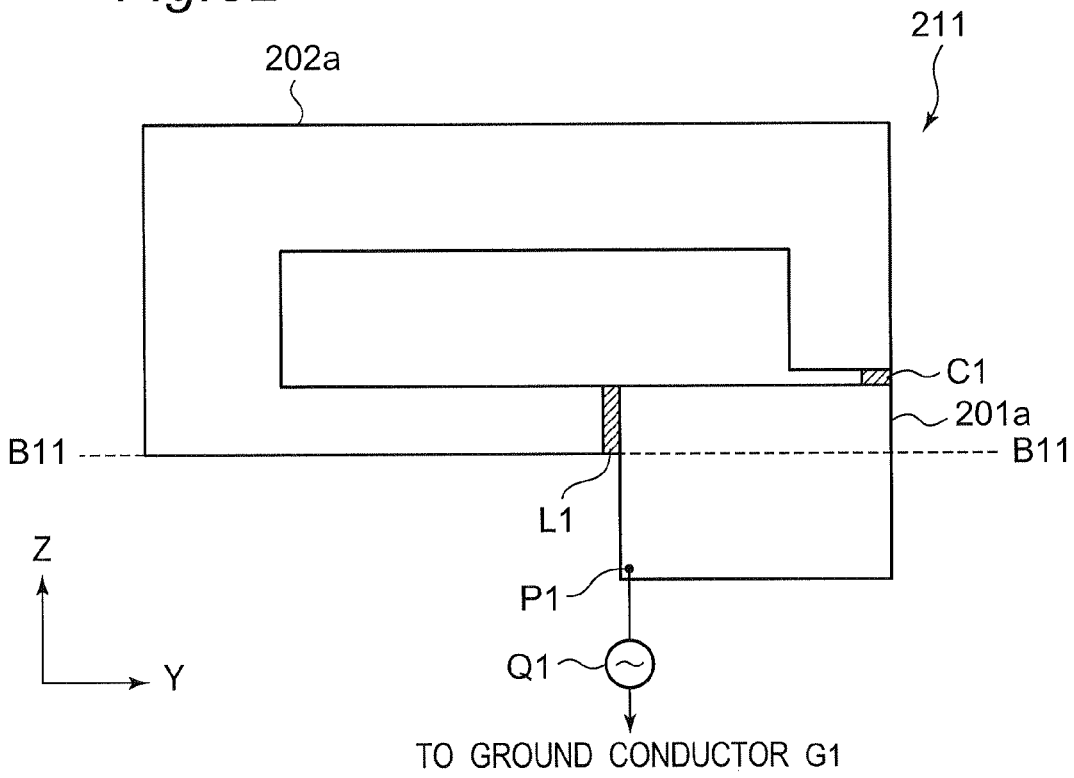
FIG. 52 is a developed view showing a detailed configuration of a radiator 211 as a comparison example of the first implementation example.

FIG. 52 is a developed view showing a detailed configuration of a radiator 211 as a comparison example of the first implementation example. The radiator 211 of FIG. 52 is provided with radiation conductors 201*a* and 202*a*, an inductor L1, and a capacitor C1. The radiator 211 is configured with the same dimensions as the radiator 161 of FIG. 49 except that the radiator 211 does not have a small loop, and is provided on a ground conductor G1, instead of the radiator 161 of FIG. 49.

Figure 53:
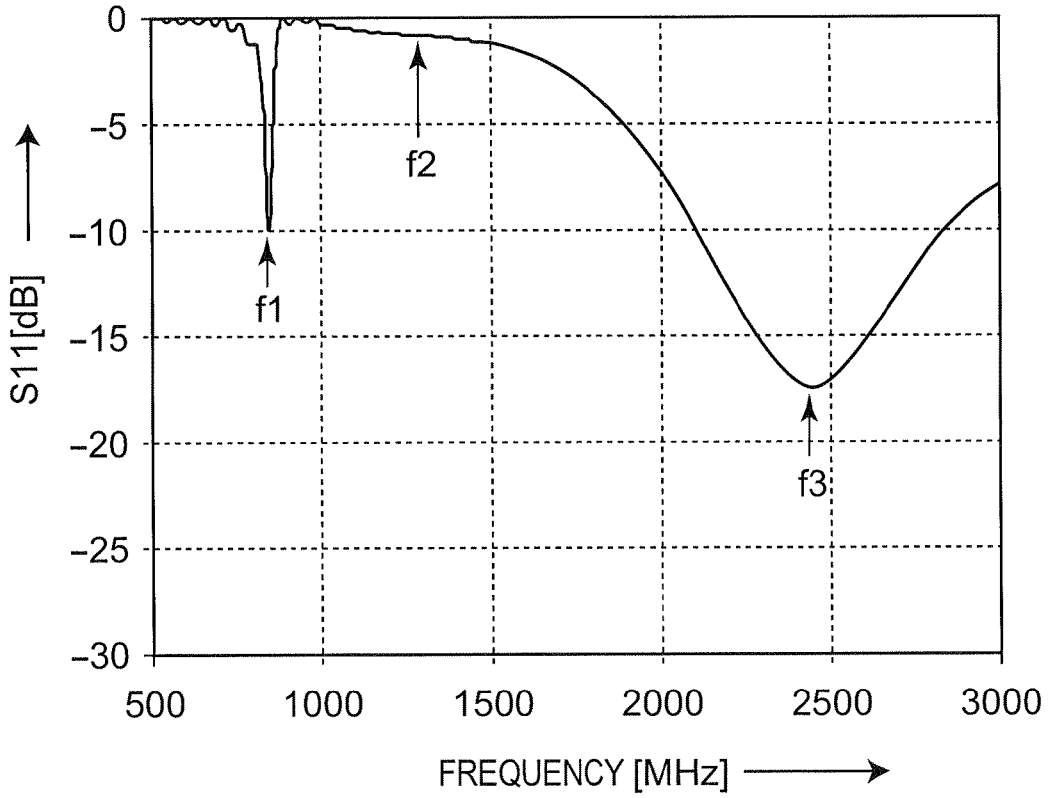
FIG. 53 is a graph showing a frequency characteristic of a reflection coefficient S11 for an antenna apparatus of FIG. 52.

FIG. 53 is a graph showing a frequency characteristic of a reflection coefficient S11 for the antenna apparatus of FIG. 52. According to the computation results, the antenna apparatus of the comparison example resonates at two frequencies: f1=837 MHz and f3=2437 MHz. In addition, the comparison of the radiation efficiencies for the low-band resonance frequency f1, the mid-band resonance frequency f2, and the high-band resonance frequency f3 is shown in the following table 1.

TABLE 1

| | First implementation example | Comparison example |
|---|---|---|
| f1 | −1.3 | −1.5 |
| f2 | −1.0 | −7.6 |
| f3 | −0.1 | −0.1 |

According to Table 1, both the antenna apparatuses of the first implementation example and the comparison example resonate at the low-band resonance frequency f1 and the high-band resonance frequency f3, and exhibit high radiation efficiency. However, the antenna apparatus of the comparison example does not resonate at the mid-band resonance frequency f2=1272 MHz, and thus, the radiation efficiency exhibits a value as low as −7.6 [dB]. On the other hand, the antenna apparatus of the first implementation example exhibits a value as high as −1.0 [dB] at the mid-band resonance frequency f2 due to the advantageous effect of triple-band operation.

The antenna apparatuses of the first implementation example and the comparison example have the same dimensions, and also have substantially the same low-band resonance frequency f1 and substantially the same high-band resonance frequency f3. That is, it can be seen that the present invention provides an advantageous effect that based on an antenna apparatus provided with a looped radiation conductor and operable in dual bands including the low-band resonance frequency f1 and the high-band resonance frequency f3 (see FIG. 2, etc.), it is possible to independently design resonance of the antenna apparatus at the mid-band resonance frequency f2, by providing the looped radiation conductor with a plurality of branches, without impairing the characteristics of the low-band resonance frequency f1 and the high-band resonance frequency f3.

Figure 54:
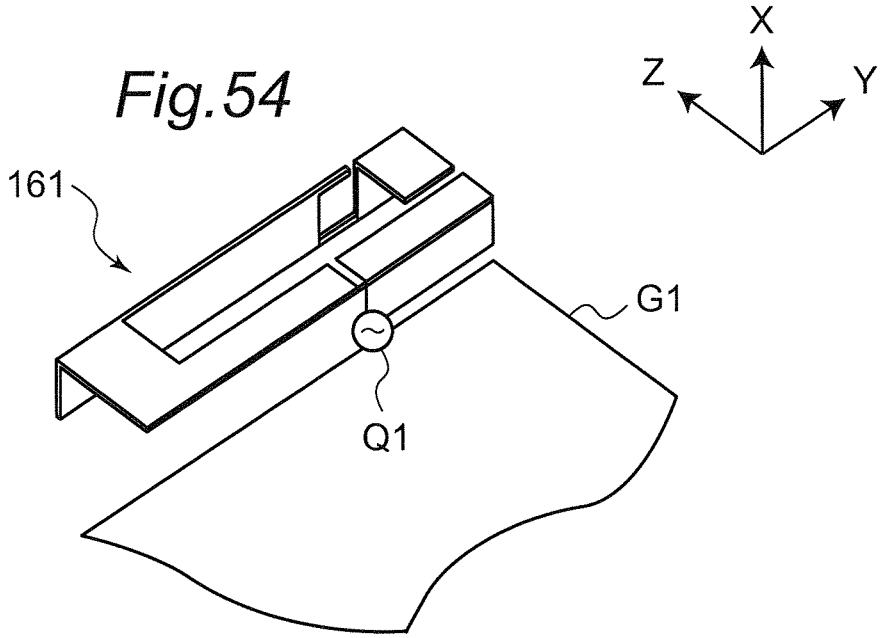
FIG. 54 is a perspective view showing an antenna apparatus according to a modified embodiment of the first implementation example.

FIG. 54 is a perspective view showing an antenna apparatus according to a modified embodiment of the first implementation example. According to the antenna apparatus of FIG. 54, the radiation conductors 2*h* and 3*h* of the radiator 161 of FIG. 50 are bent in the −X direction at line B12 in FIG. 50.

Figure 55:
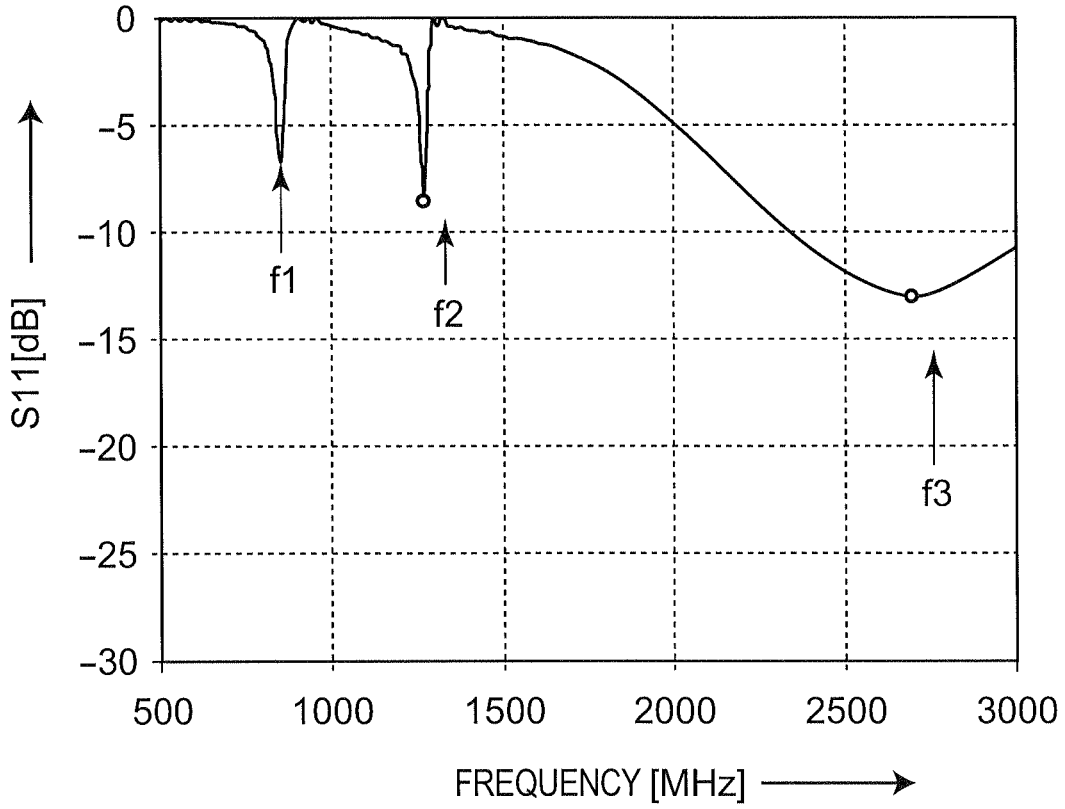
FIG. 55 is a graph showing a frequency characteristic of a reflection coefficient S11 for the antenna apparatus of FIG. 54.

FIG. 55 is a graph showing a frequency characteristic of a reflection coefficient S11 for the antenna apparatus of FIG. 54. According to the computation results, it can be seen that the antenna apparatus is matched at three frequencies: f1=855 MHz (−7.2 dB), f2=1273 MHz (−8.8 dB), and f3=2690 MHz (−13.1 dB). In addition, comparing radiation efficiency between the case without bending and the case with bending as shown in Table 2, both cases can achieve high radiation efficiency. According to this results, it can be said that the antenna apparatus according to the embodiment of the present invention has good features that the antenna apparatus can achieve both size reduction and triple-band operation, and can also meet demands for reducing size and thickness of portable wireless terminal apparatuses.

TABLE 2

| | With bending | Without bending |
|---|---|---|
| f1 | −1.5 | −1.3 |
| f2 | −1.4 | −1.0 |
| f3 | −0.2 | −0.1 |

Second Implementation Example

With reference to FIGS. 56 to 81, simulation results for a second implementation example of the first embodiment of the present invention will be described below. In the simulations, computation was performed using the FDTD method.

Figure 56:
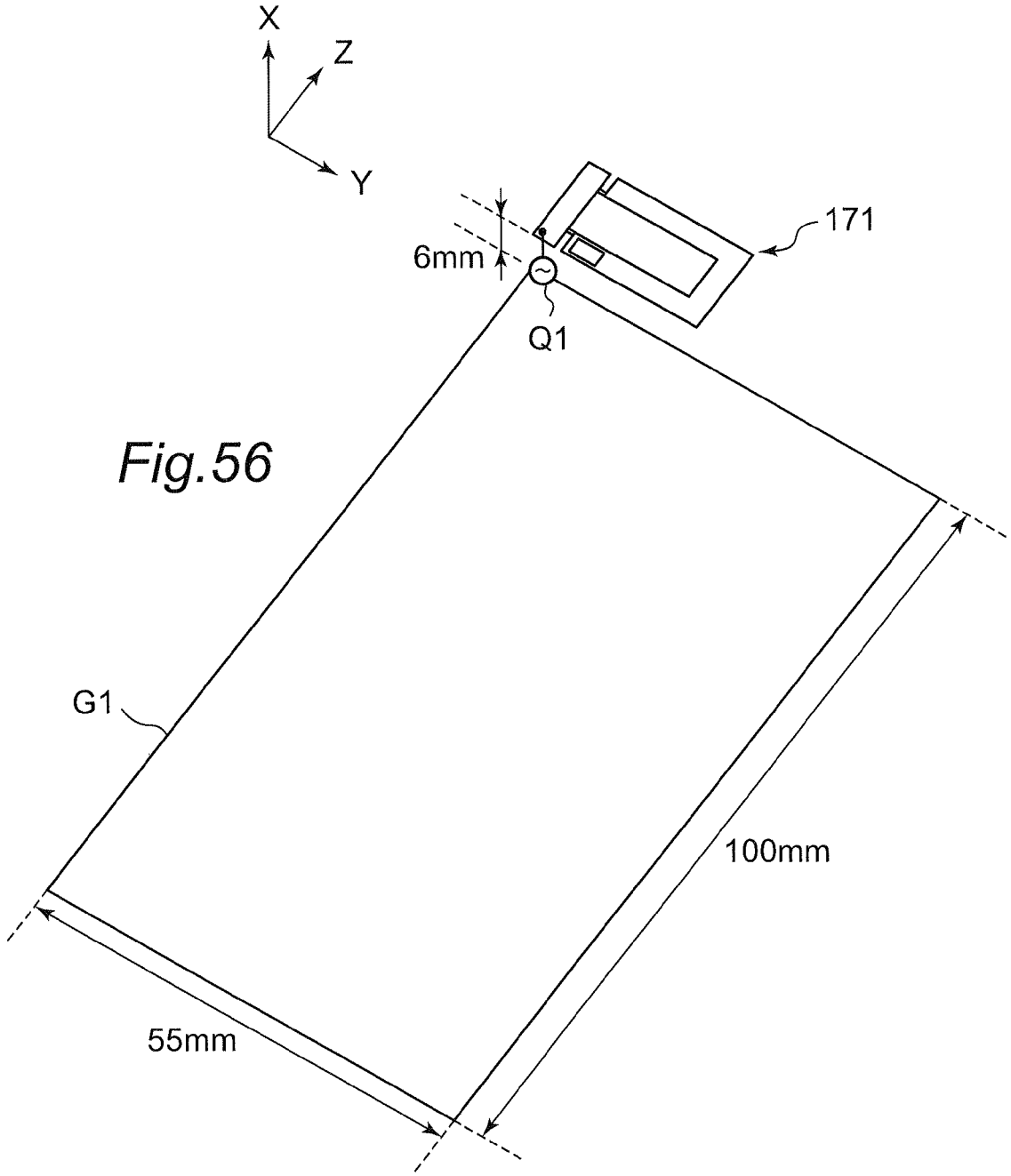
FIG. 56 is a perspective view showing an antenna apparatus according to a second implementation example.
Figure 57:
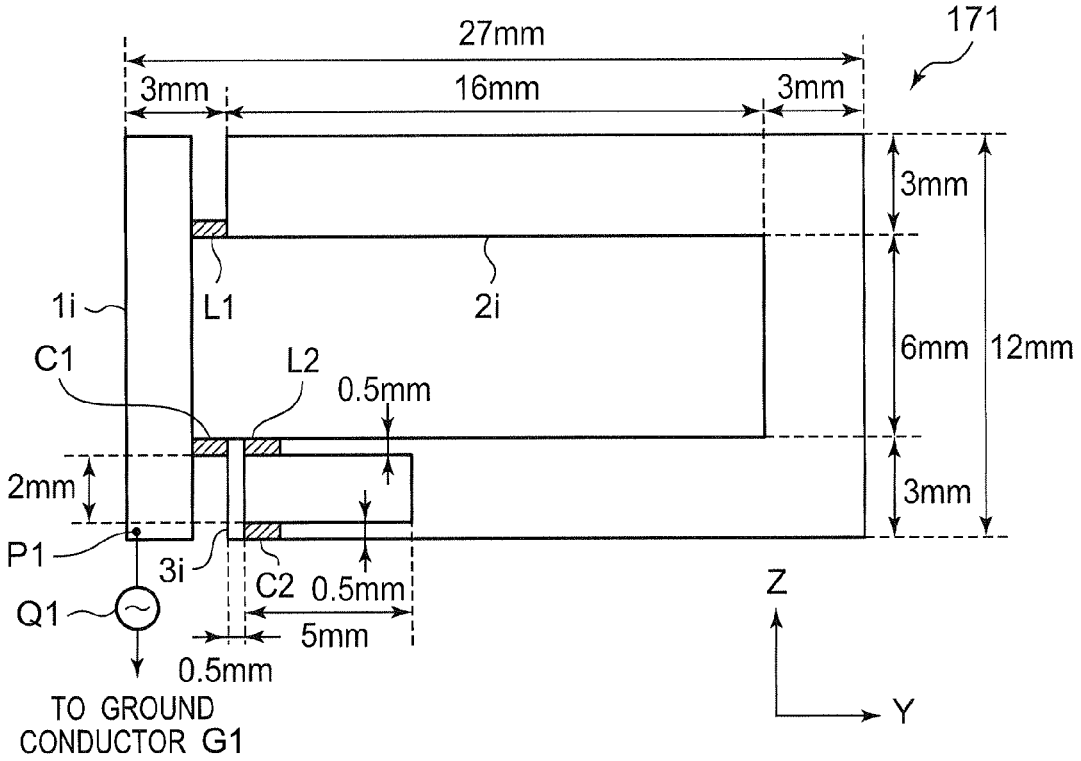
FIG. 57 is a top view showing a detailed configuration of a radiator 171 of FIG. 56.

FIG. 56 is a perspective view showing an antenna apparatus according to the second implementation example. FIG. 57 is a top view showing a detailed configuration of a radiator 171 of FIG. 56. The antenna apparatus shown in FIGS. 56 and 57 are an implementation example of the antenna apparatus shown in FIG. 8. The radiator 171 is provided with radiation conductors 1*i*, 2*i*, and 3*i*, inductors L1 and L2, and capacitors C1 and C2. Referring to FIG. 57, the inductor L1 has an inductance of 3 nH, the capacitor C1 has a capacitance of 1 pF, the inductor L2 is a thin wire inductor made of a strip conductor having a cross section of 0.3 mm×0.5 mm and a length of 5.5 mm, and the capacitor C2 has a capacitance of 7 pF.

Figure 58:
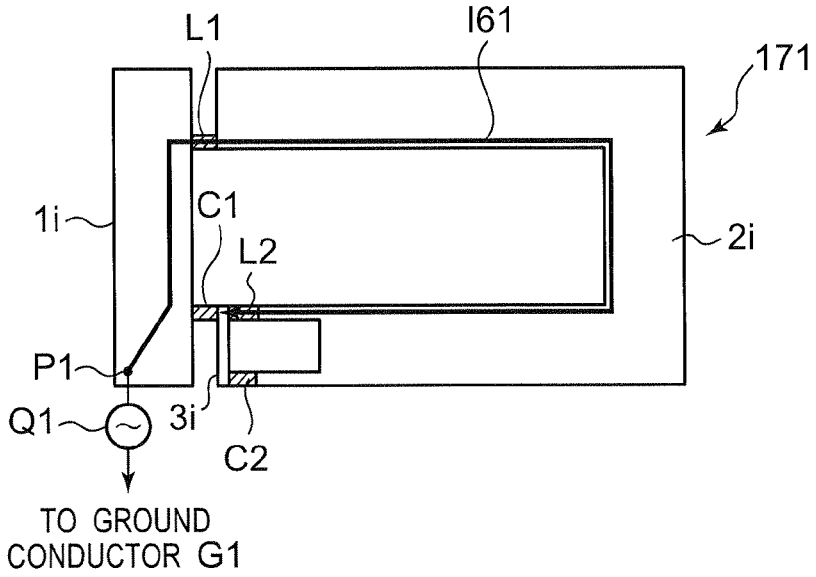
FIG. 58 is a diagram showing a current path for the case where the antenna apparatus of FIG. 56 operates at the low-band resonance frequency f1.
Figure 59:
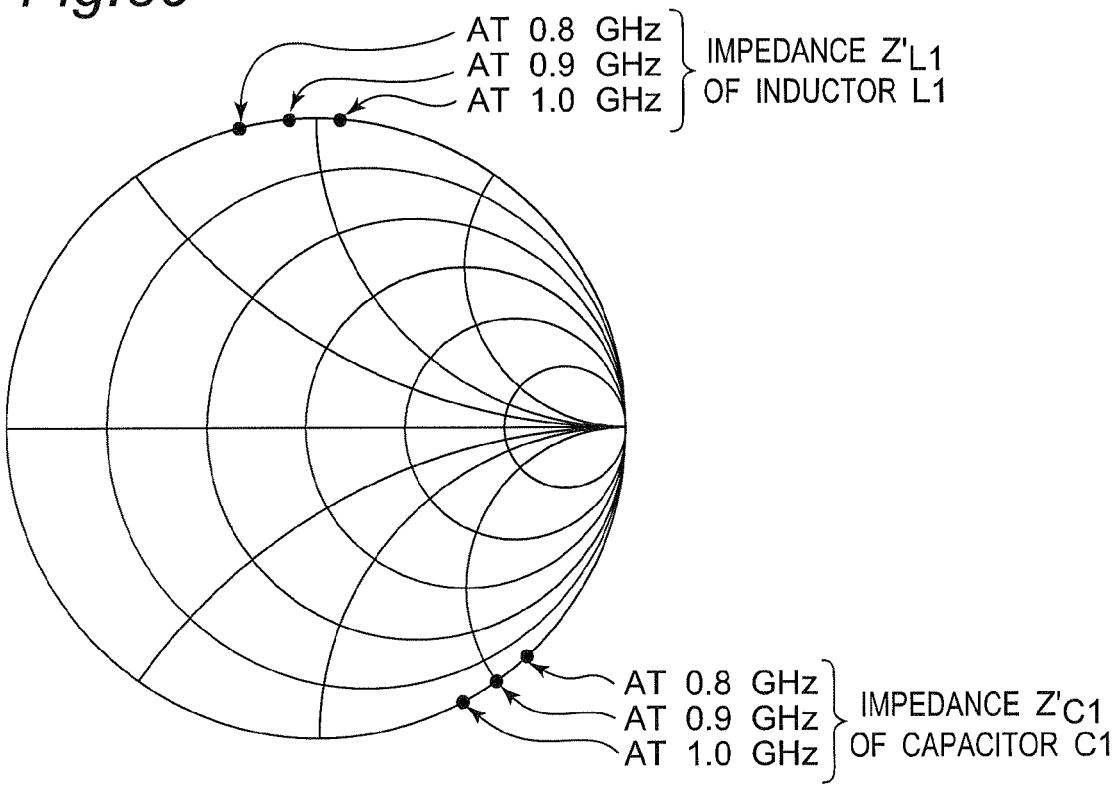
FIG. 59 is a Smith chart showing an impedance of an inductor L1 seen from a feed point P1, and an impedance $Z'_{C1}$ of a capacitor C1 seen from the feed point P1, for the case where the antenna apparatus of FIG. 56 operates at the low-band resonance frequency f1.

FIG. 58 is a diagram showing a current path for the case where the antenna apparatus of FIG. 56 operates at the low-band resonance frequency f1. FIG. 59 is a Smith chart showing an impedance $Z'_{L1}$ of the inductor L1 seen from a feed point P1, and an impedance $Z'_{C1}$ of the capacitor C1 seen from the feed point P1, for the case where the antenna apparatus of FIG. 56 operates at the low-band resonance frequency f1. At the low-band resonance frequency f1=about 900 MHz, since $|Z'_{L1}|<|Z'_{C1}|$, a current I61 passes not through the capacitor C1, but through the inductor L1, and since $|Z'_{L2}|<|Z'_{C2}|$, the current I61 further passes not through the capacitor C2, but through the inductor L2.

Figure 60:
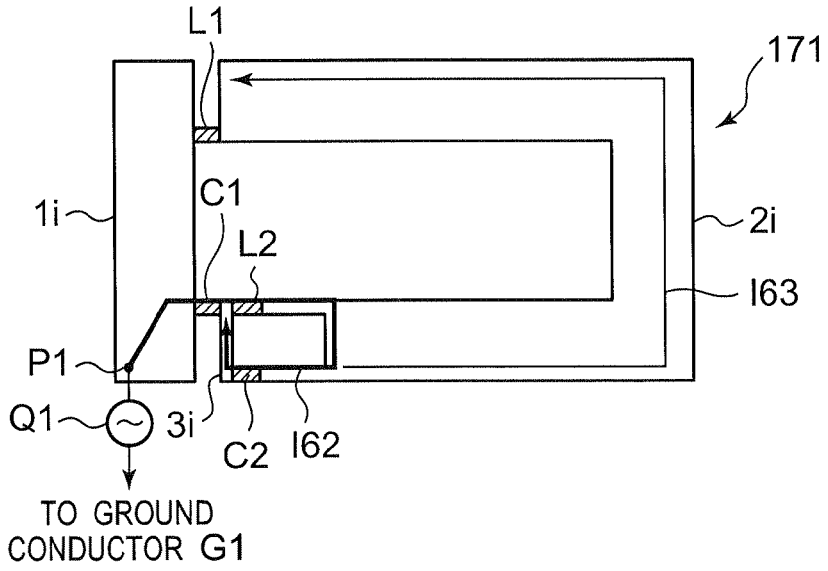
FIG. 60 is a diagram showing a current path for the case where the antenna apparatus of FIG. 56 operates at the mid-band resonance frequency f2.
Figure 61:
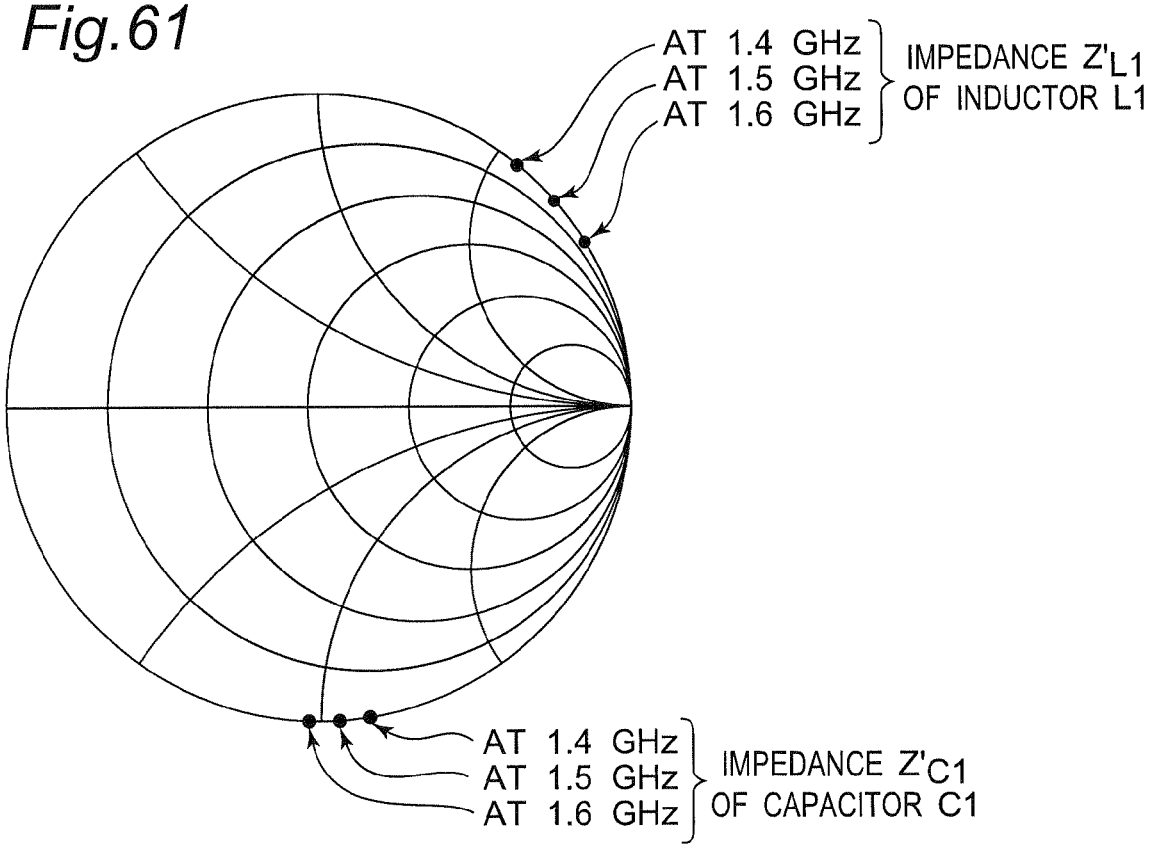
FIG. 61 is a Smith chart showing an impedance $Z'_{L1}$ of the inductor L1 seen from the feed point P1, and an impedance $Z'_{c1}$ of the capacitor C1 seen from the feed point P1, for the case where the antenna apparatus of FIG. 56 operates at the mid-band resonance frequency f2.

FIG. 60 is a diagram showing a current path for the case where the antenna apparatus of FIG. 56 operates at the mid-band resonance frequency f2. FIG. 61 is a Smith chart showing an impedance $Z'_{L1}$ of the inductor L1 seen from the feed point P1, and an impedance $Z'_{C1}$ of the capacitor C1 seen from the feed point P1, for the case where the antenna apparatus of FIG. 56 operates at the mid-band resonance frequency f2. At the mid-band resonance frequency f2=about 1500 MHz, since $|Z'_{L1}|>|Z'_{C1}|$, a current I62 passes not through the inductor L1, but through the capacitor C1, and since $|Z'_{L2}|<|Z'_{C2}|$, the current I62 further passes through the inductor L2. Due to a voltage difference across the radiation conductors 2*i* and 3*i*, a current is connected at the capacitor C2, and thus, a current path along a small loop is formed. At this time, a partial current I63 flows from the small loop toward the inductor L1.

Figure 62:
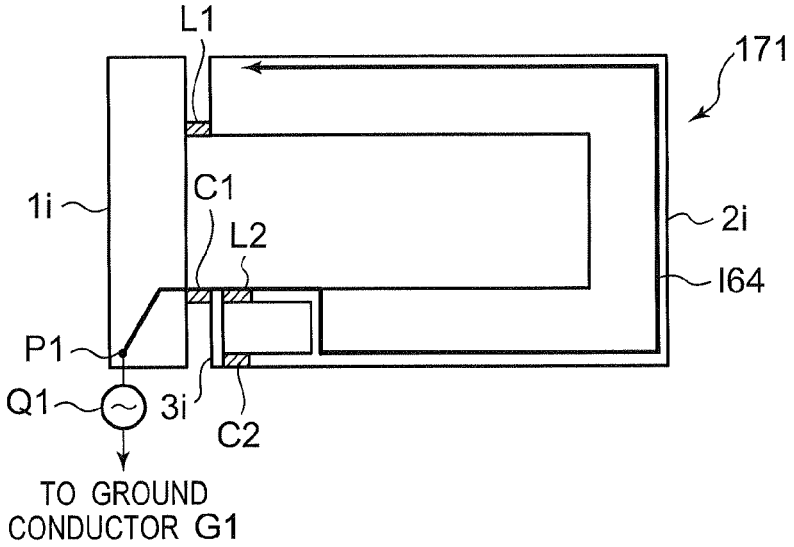
FIG. 62 is a diagram showing a current path for the case where the antenna apparatus of FIG. 56 operates at the high-band resonance frequency f3.
Figure 63:
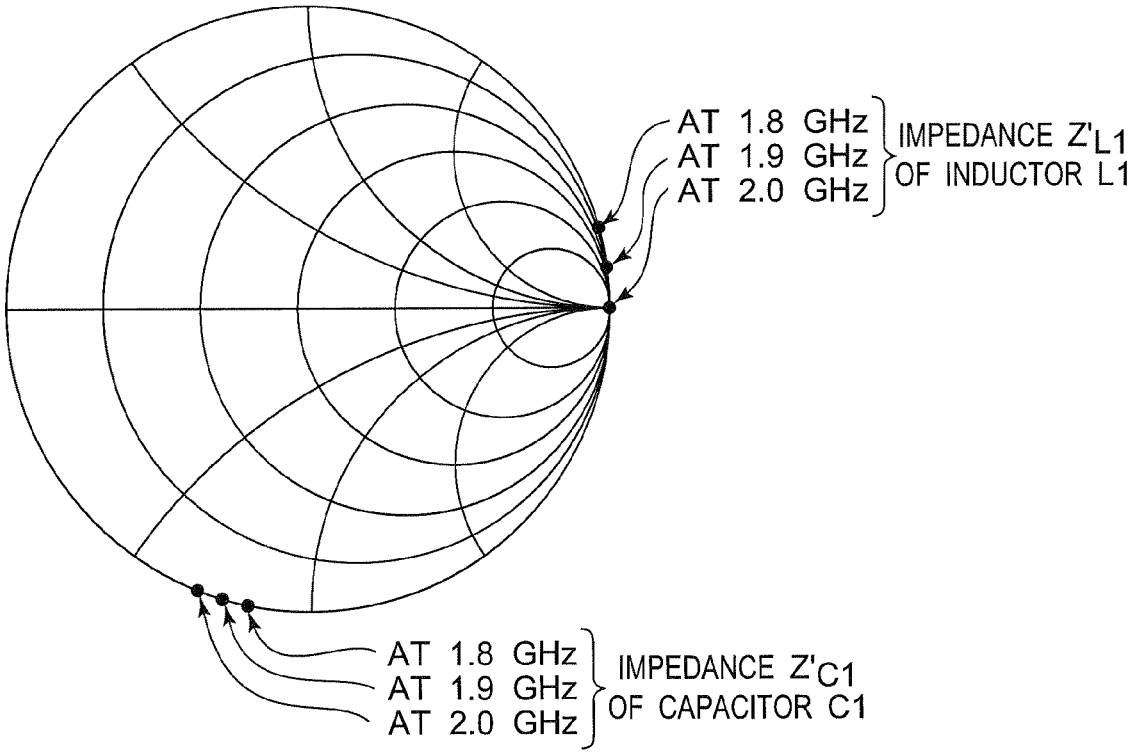
FIG. 63 is a Smith chart showing an impedance $Z'_{L1}$ of the inductor L1 seen from the feed point P1, and an impedance $Z'_{C1}$ of the capacitor C1 seen from the feed point P1, for the case where the antenna apparatus of FIG. 56 operates at the high-band resonance frequency f3.

FIG. 62 is a diagram showing a current path for the case where the antenna apparatus of FIG. 56 operates at the high-band resonance frequency f3. FIG. 63 is a Smith chart showing an impedance of the inductor L1 seen from the feed point P1, and an impedance $Z'_{C1}$ of the capacitor C1 seen from the feed point P1, for the case where the antenna apparatus of FIG. 56 operates at the high-band resonance frequency f3. At the high-band resonance frequency f3=about 1900 MHz, since $|Z'_{L1}|>|Z'_{C1}|$, a current I64 passes not through the inductor L1, but through the capacitor C1, and since $|Z'_{L2}|<|Z'_{C2}|$, the current I64 further passes not through the capacitor C2, but through the inductor L2.

Figure 64:
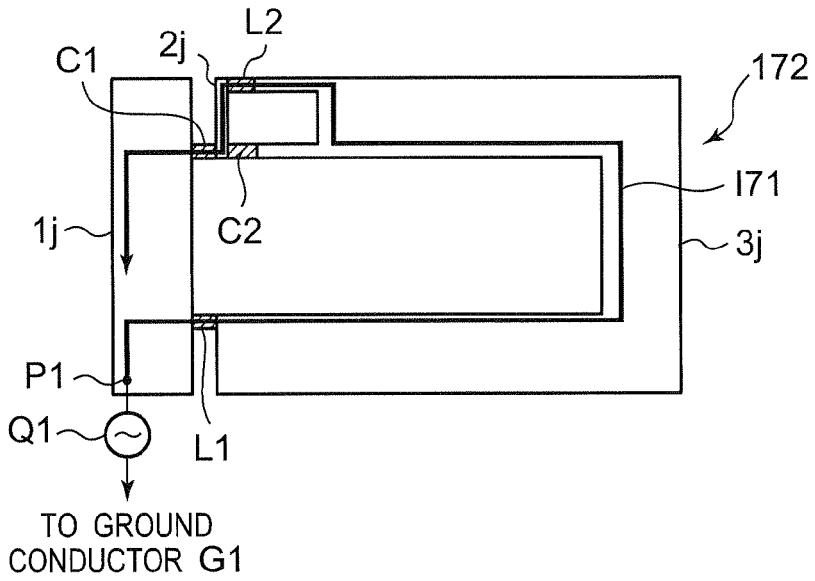
FIG. 64 is a diagram showing a current path for the case where an antenna apparatus according to a first modified embodiment of the second implementation example operates at the low-band resonance frequency f1.
Figure 65:
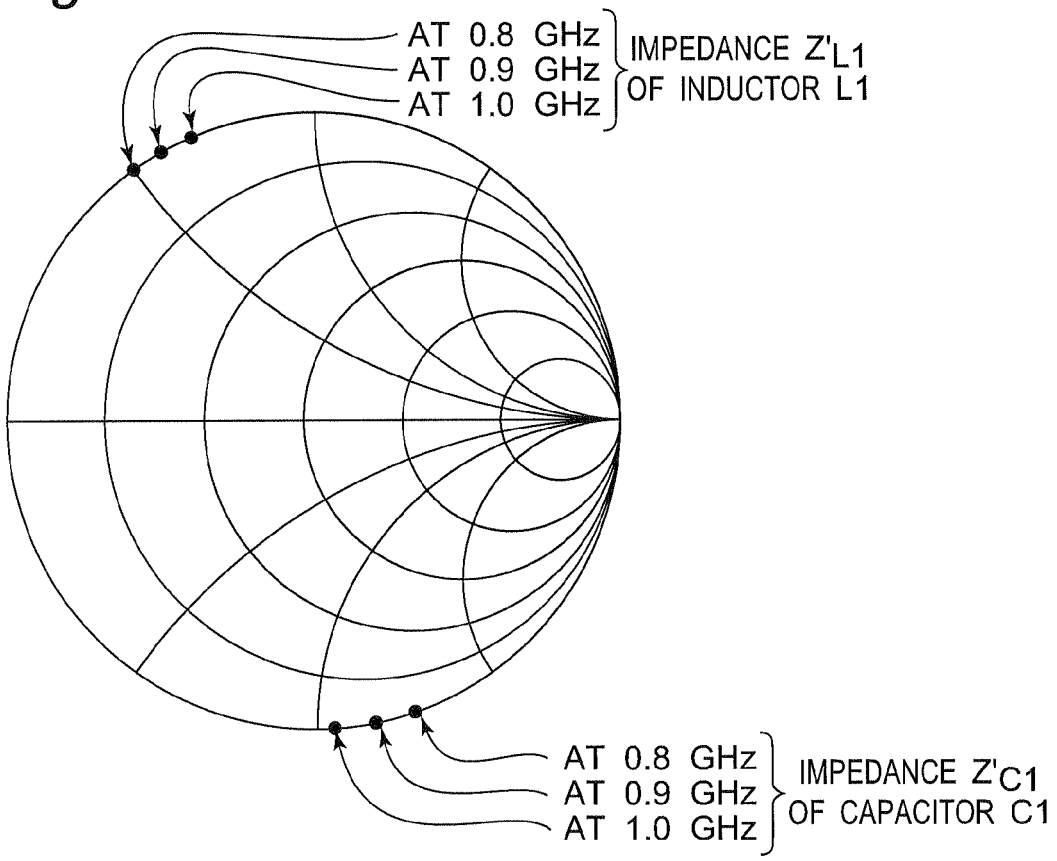
FIG. 65 is a Smith chart showing an impedance $Z'_{L1}$ of an inductor L1 seen from a feed point P1, and an impedance $Z'_{C1}$ of a capacitor C1 seen from the feed point P1, for the case where the antenna apparatus according to the first modified embodiment of the second implementation example operates at the low-band resonance frequency f1.

FIG. 64 is a diagram showing a current path for the case where an antenna apparatus according to a first modified embodiment of the second implementation example operates at the low-band resonance frequency f1. The antenna apparatus shown in FIG. 64 is an implementation example of the antenna apparatus shown in FIG. 21, and a radiator 172 of the antenna apparatus shown in FIG. 64 is provided with radiation conductors 1*j*, 2*j*, and 3*j*, inductors L1 and L2, and capacitors C1 and C2. The radiator 172 is configured in a similar manner as that of the radiator 171 of FIG. 57 except for the positions of the inductors L1 and L2 and the capacitors C1 and C2. FIG. 65 is a Smith chart showing an impedance of the inductor L1 seen from a feed point P1, and an impedance $Z'_{C1}$ of the capacitor C1 seen from the feed point P1, for the case where the antenna apparatus according to the first modified embodiment of the second implementation example operates at the low-band resonance frequency f1. At the low-band resonance frequency f1=about 900 MHz, since $|Z'_{L1}|<|Z'_{C1}|$, a current I71 passes not through the capacitor C1, but through the inductor L1, and since $|Z'_{L2}|<|Z'_{C2}|$, the current I71 further passes not through the capacitor C2, but through the inductor L2.

Figure 66:
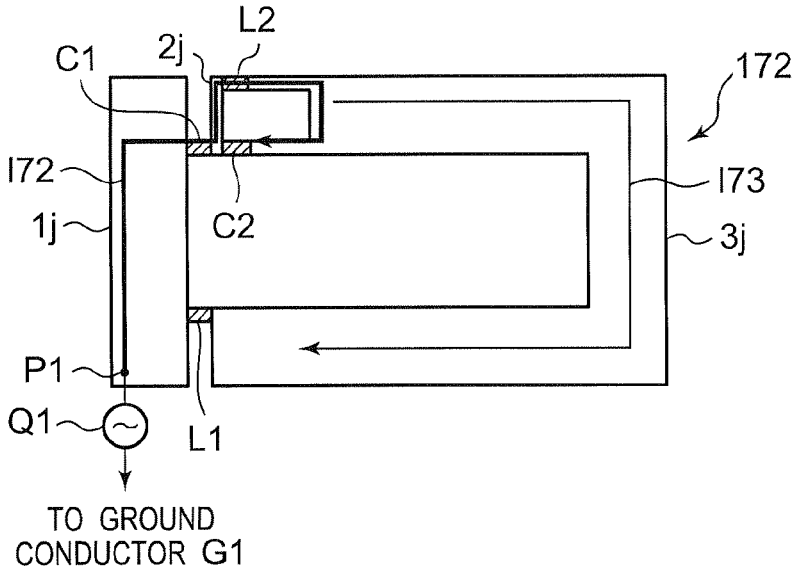
FIG. 66 is a diagram showing a current path for the case where the antenna apparatus according to the first modified embodiment of the second implementation example operates at the mid-band resonance frequency f2.
Figure 67:
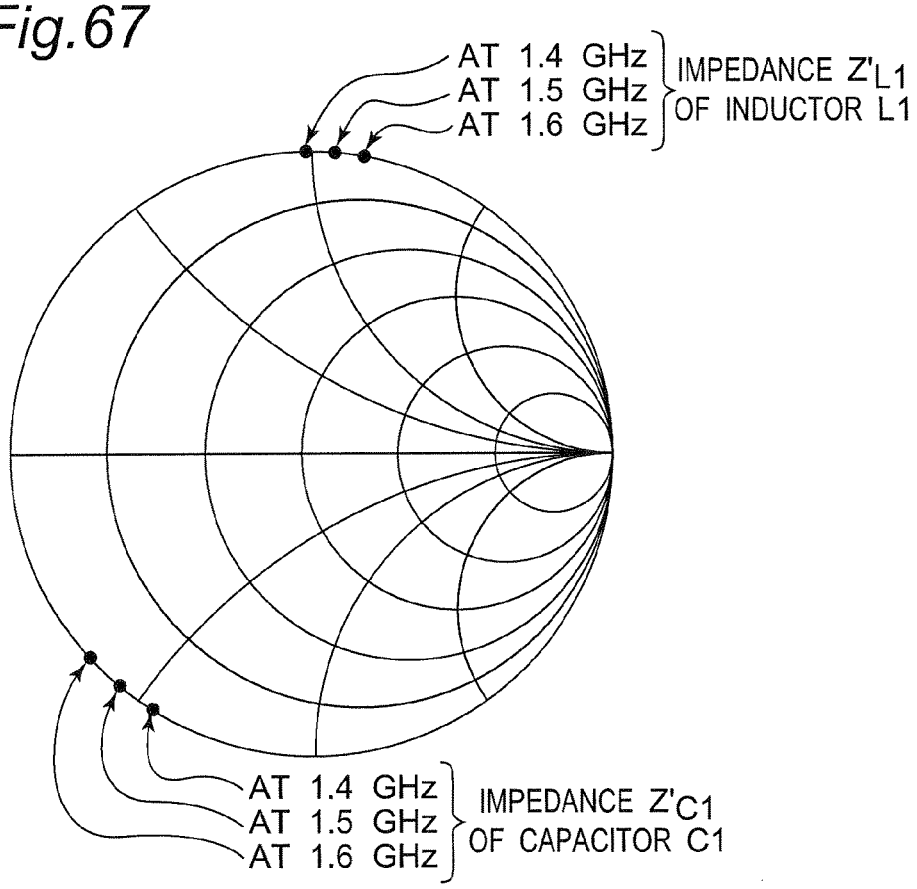
FIG. 67 is a Smith chart showing an impedance $Z'_{L1}$ of the inductor L1 seen from the feed point P1, and an impedance $Z'_{C1}$ of the capacitor C1 seen from the feed point P1, for the case where the antenna apparatus according to the first modified embodiment of the second implementation example operates at the mid-band resonance frequency f2.

FIG. 66 is a diagram showing a current path for the case where the antenna apparatus according to the first modified embodiment of the second implementation example operates at the mid-band resonance frequency f2. FIG. 67 is a Smith chart showing an impedance $Z'_{L1}$ of the inductor L1 seen from the feed point P1, and an impedance $Z'_{C1}$ of the capacitor C1 seen from the feed point P1, for the case where the antenna apparatus according to the first modified embodiment of the second implementation example operates at the mid-band resonance frequency f2. At the mid-band resonance frequency f2=about 1500 MHz, since $|Z'_{L1}|>|Z'_{C1}|$, a current I72 passes not through the inductor L1, but through the capacitor C1, and since $|Z'_{L2}|<|Z'_{C2}|$, the current I72 further passes through the inductor L2. Due to a voltage difference across the radiation conductors 2*i* and 3*i*, a current is connected at the capacitor C2, and thus, a current path along a small loop is formed. At this time, a partial current I73 flows from the small loop toward the inductor L1.

Figure 68:
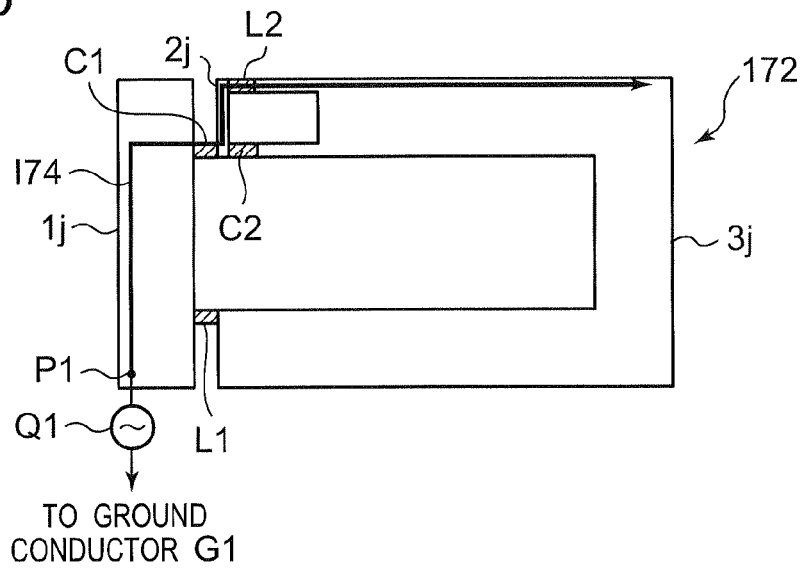
FIG. 68 is a diagram showing a current path for the case where the antenna apparatus according to the first modified embodiment of the second implementation example operates at the high-band resonance frequency f3.
Figure 69:
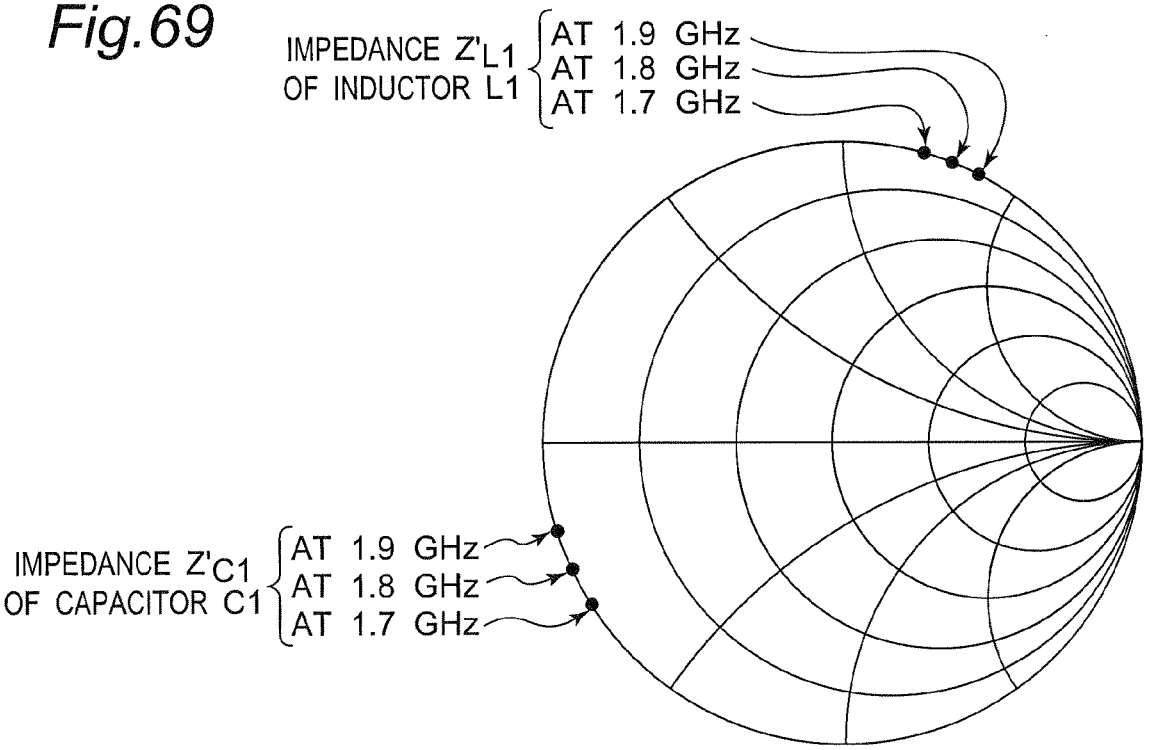
FIG. 69 is a Smith chart showing an impedance of the inductor L1 seen from the feed point P1, and an impedance $Z'_{C1}$ of the capacitor C1 seen from the feed point P1, for the case where the antenna apparatus according to the first modified embodiment of the second implementation example operates at the high-band resonance frequency f3.

FIG. 68 is a diagram showing a current path for the case where the antenna apparatus according to the first modified embodiment of the second implementation example operates at the high-band resonance frequency f3. FIG. 69 is a Smith chart showing an impedance of the inductor L1 seen from the feed point P1, and an impedance $Z'_{C1}$ of the capacitor C1 seen from the feed point P1, for the case where the antenna apparatus according to the first modified embodiment of the second implementation example operates at the high-band resonance frequency f3. At the high-band resonance frequency f3=about 1800 MHz, since $|Z'_{L1}|>|Z'_{C1}|$, a current I74 passes not through the inductor L1, but through the capacitor C1, and since $|Z'_{L2}|<|Z'_{C2}|$, the current I74 further passes not through the capacitor C2, but through the inductor L2.

Figure 70:
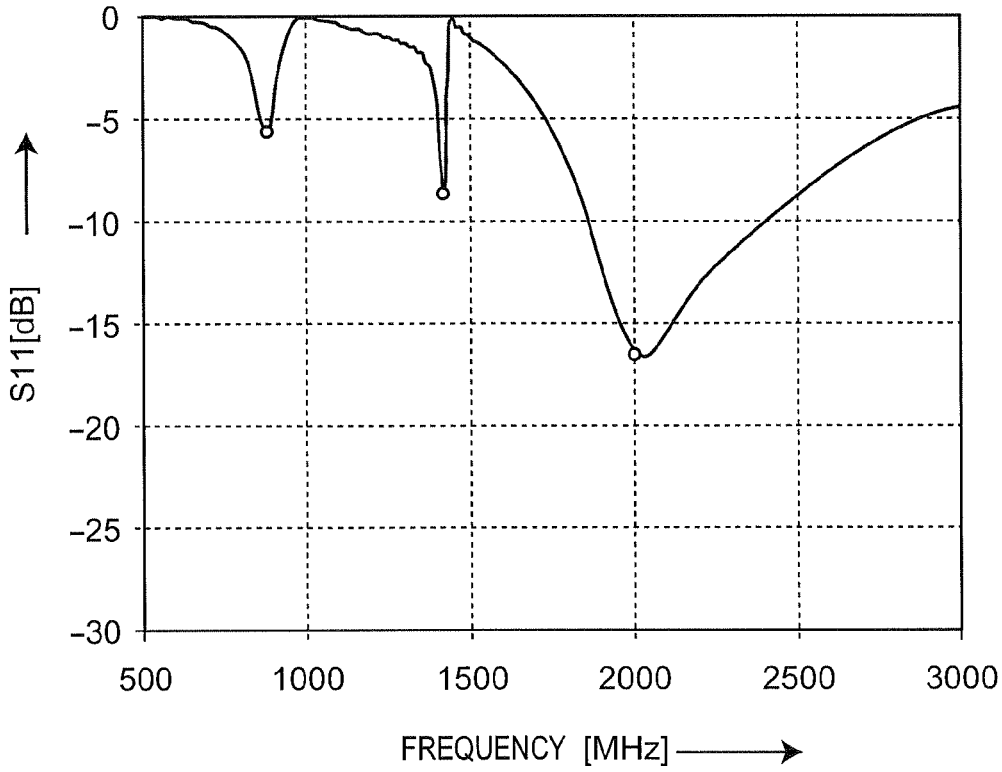
FIG. 70 is a graph showing a frequency characteristic of a reflection coefficient S11 for the antenna apparatus of FIG. 56.

FIG. 70 is a graph showing a frequency characteristic of a reflection coefficient S11 for the antenna apparatus of FIG. 56. According to the computation results, it can be seen that the antenna apparatus is matched at three frequencies: f1=883 MHz (−5.6 dB), f2=1417 MHz (−8.7 dB), and f3=2001 MHz (−16.5 dB).

Figure 71:
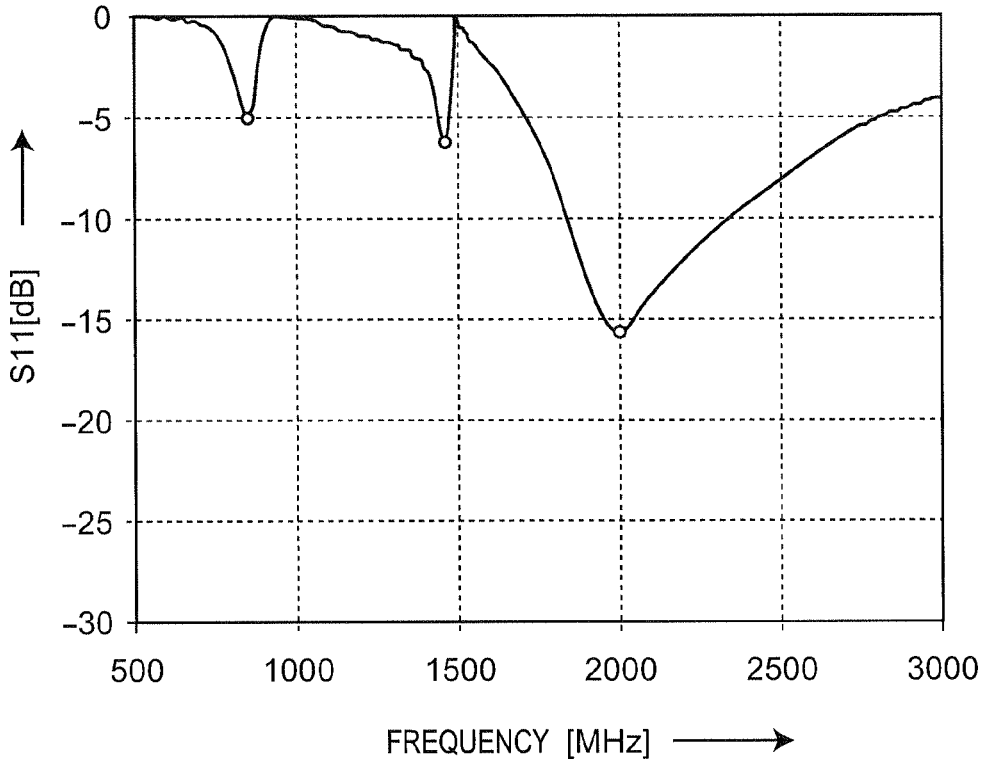
FIG. 71 is a graph showing a frequency characteristic of a reflection coefficient S11 for an antenna apparatus according to a second modified embodiment of the second implementation example.

FIG. 71 is a graph showing a frequency characteristic of a reflection coefficient S11 for an antenna apparatus according to a second modified embodiment of the second implementation example. FIG. 71 shows a frequency characteristic of a reflection coefficient S11 for an antenna apparatus according to an implementation example of the antenna apparatus shown in FIG. 9. A radiator of the antenna apparatus according to FIG. 71 is configured in a similar manner as that of the radiator 171 of FIG. 57 except for the positions of inductors L1 and L2 and capacitors C1 and C2. According to the computation results, it can be seen that the antenna apparatus is matched at three frequencies: f1=860 MHz (−5.1 dB), f2=1466 MHz (−6.5 dB), and f3=1998 MHz (−15.4 dB).

Figure 72:
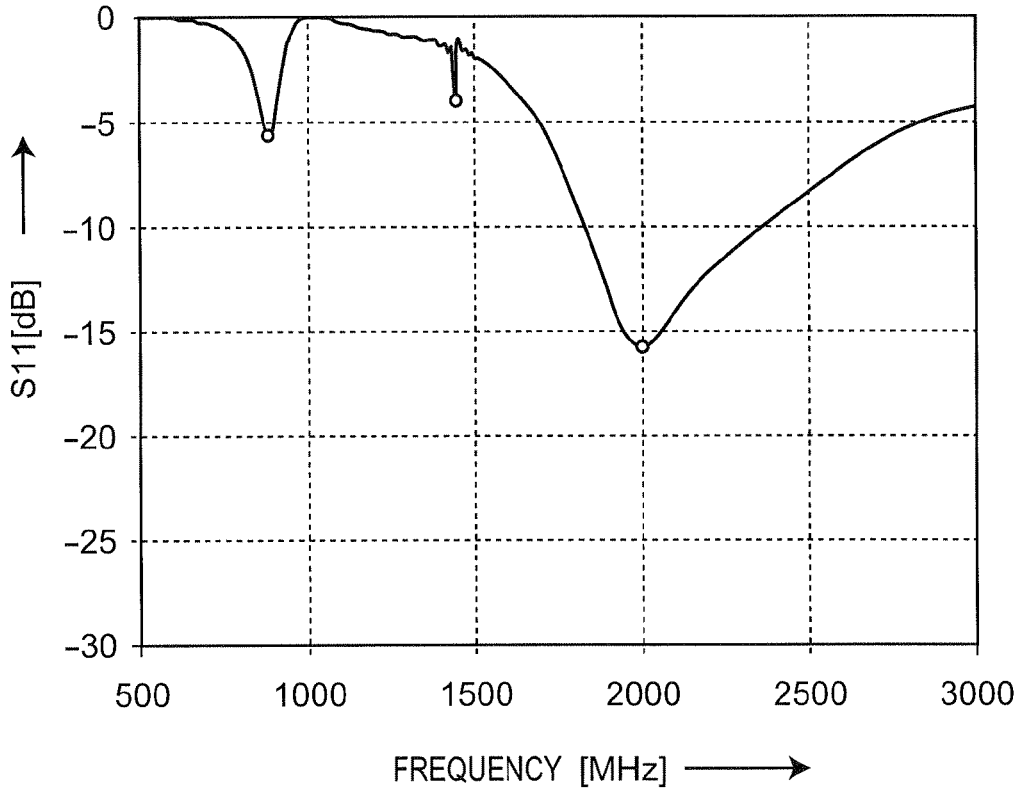
FIG. 72 is a graph showing a frequency characteristic of a reflection coefficient S11 for an antenna apparatus according to a third modified embodiment of the second implementation example.

FIG. 72 is a graph showing a frequency characteristic of a reflection coefficient S11 for an antenna apparatus according to a third modified embodiment of the second implementation example. FIG. 72 shows a frequency characteristic of a reflection coefficient S11 for an antenna apparatus according to an implementation example of the antenna apparatus shown in FIG. 10. A radiator of the antenna apparatus according to FIG. 72 is configured in a similar manner as that of the radiator 171 of FIG. 57 except for the positions of inductors L1 and L2 and capacitors C1 and C2. According to the computation results, it can be seen that the antenna apparatus is matched at three frequencies: f1=885 MHz (−5.8 dB), f2=1448 MHz (−4.1 dB), and f3=2003 MHz (−15.7 dB).

Figure 73:
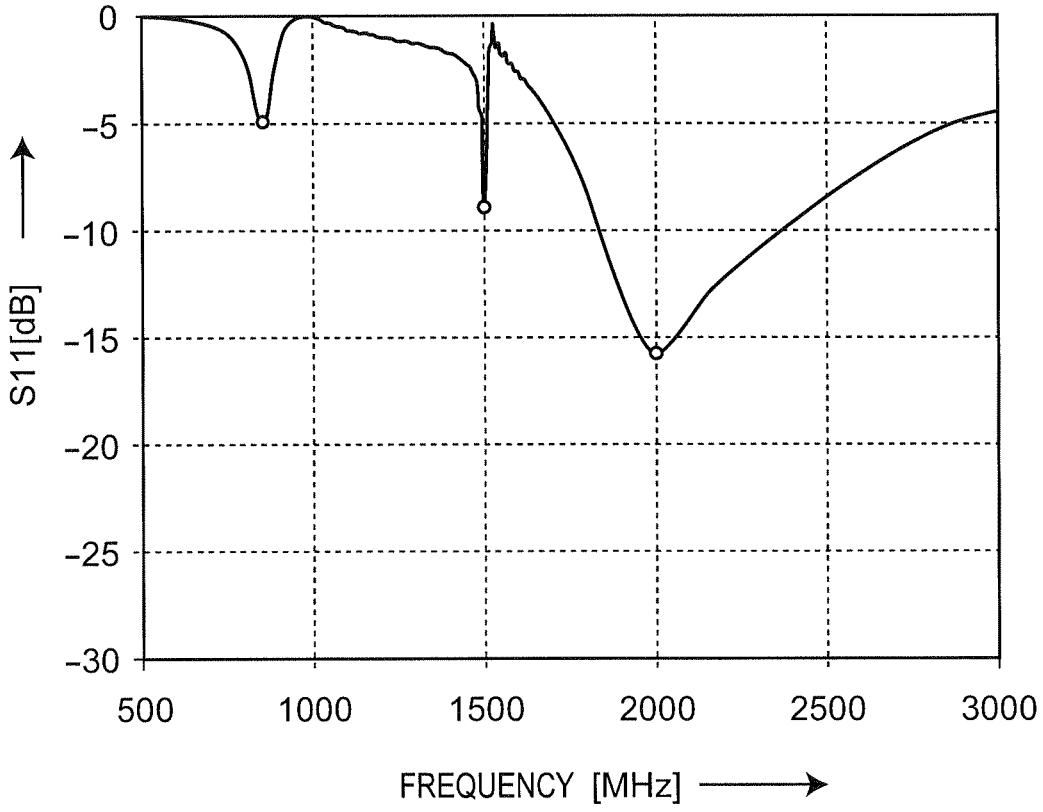
FIG. 73 is a graph showing a frequency characteristic of a reflection coefficient S11 for an antenna apparatus according to a fourth modified embodiment of the second implementation example.

FIG. 73 is a graph showing a frequency characteristic of a reflection coefficient S11 for an antenna apparatus according to a fourth modified embodiment of the second implementation example. FIG. 73 shows a frequency characteristic of a reflection coefficient S11 for an antenna apparatus according to an implementation example of the antenna apparatus shown in FIG. 11. A radiator of the antenna apparatus according to FIG. 73 is configured in a similar manner as that of the radiator 171 of FIG. 57 except for the positions of inductors L1 and L2 and capacitors C1 and C2. According to the computation results, it can be seen that the antenna apparatus is matched at three frequencies: f1=855 MHz (−5.1 dB), f2=1505 MHz (−9.2 dB), and f3=1990 MHz (−15.8 dB).

Figure 74:
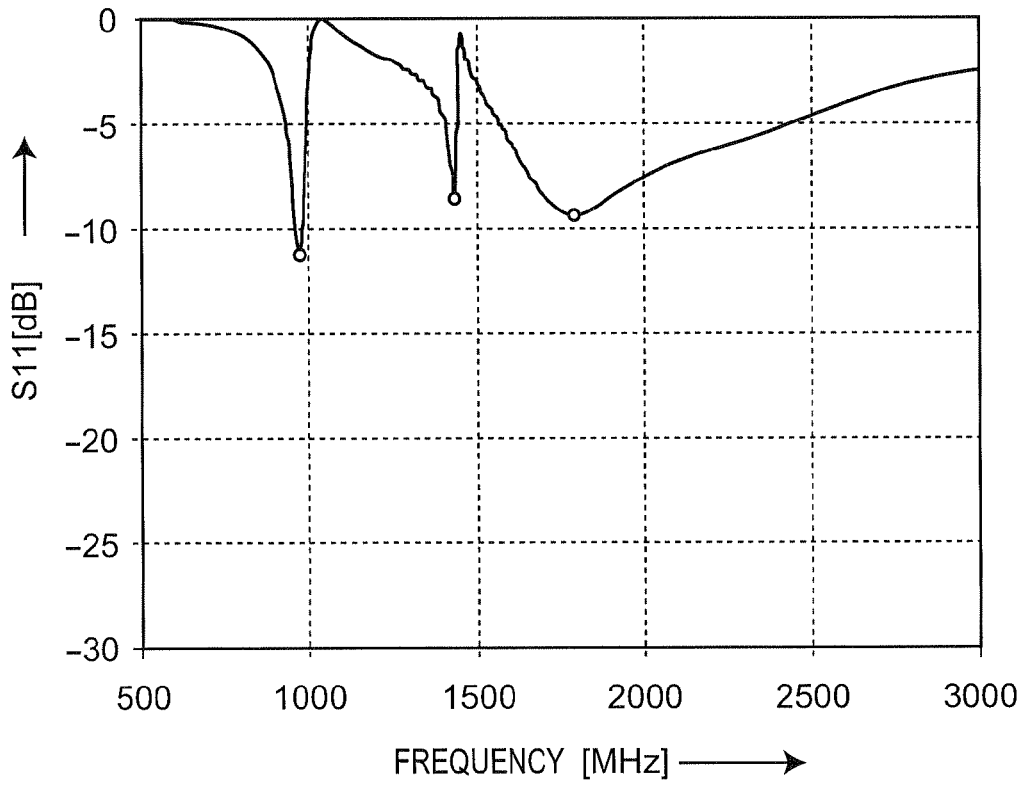
FIG. 74 is a graph showing a frequency characteristic of a reflection coefficient S11 for an antenna apparatus according to a fifth modified embodiment of the second implementation example.

FIG. 74 is a graph showing a frequency characteristic of a reflection coefficient S11 for an antenna apparatus according to a fifth modified embodiment of the second implementation example. FIG. 74 shows a frequency characteristic of a reflection coefficient S11 for an antenna apparatus according to an implementation example of the antenna apparatus shown in FIG. 18. A radiator of the antenna apparatus according to FIG. 74 is configured in a similar manner as that of the radiator 171 of FIG. 57 except for the positions of inductors L1 and L2 and capacitors C1 and C2. According to the computation results, it can be seen that the antenna apparatus is matched at three frequencies: f1=970 MHz (−11.4 dB), f2=1435 MHz (−8.8 dB), and f3=1795 MHz (−9.4 dB).

Figure 75:
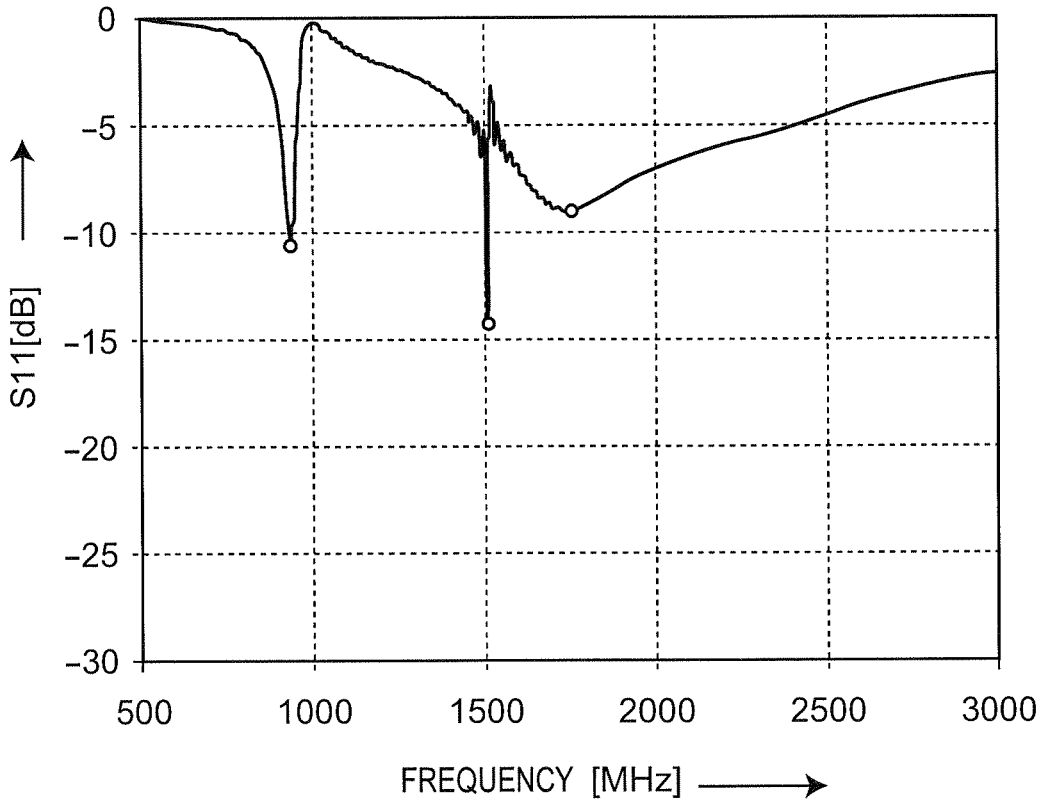
FIG. 75 is a graph showing a frequency characteristic of a reflection coefficient S11 for an antenna apparatus according to a sixth modified embodiment of the second implementation example.

FIG. 75 is a graph showing a frequency characteristic of a reflection coefficient S11 for an antenna apparatus according to a sixth modified embodiment of the second implementation example. FIG. 75 shows a frequency characteristic of a reflection coefficient S11 for an antenna apparatus according to an implementation example of the antenna apparatus shown in FIG. 19. A radiator of the antenna apparatus according to FIG. 75 is configured in a similar manner as that of the radiator 171 of FIG. 57 except for the positions of inductors L1 and L2 and capacitors C1 and C2. According to the computation results, it can be seen that the antenna apparatus is matched at three frequencies: f1=938 MHz (−10.7 dB), f2=1513 MHz (−14.3 dB), and f3=1760 MHz (−8.9 dB).

Figure 76:
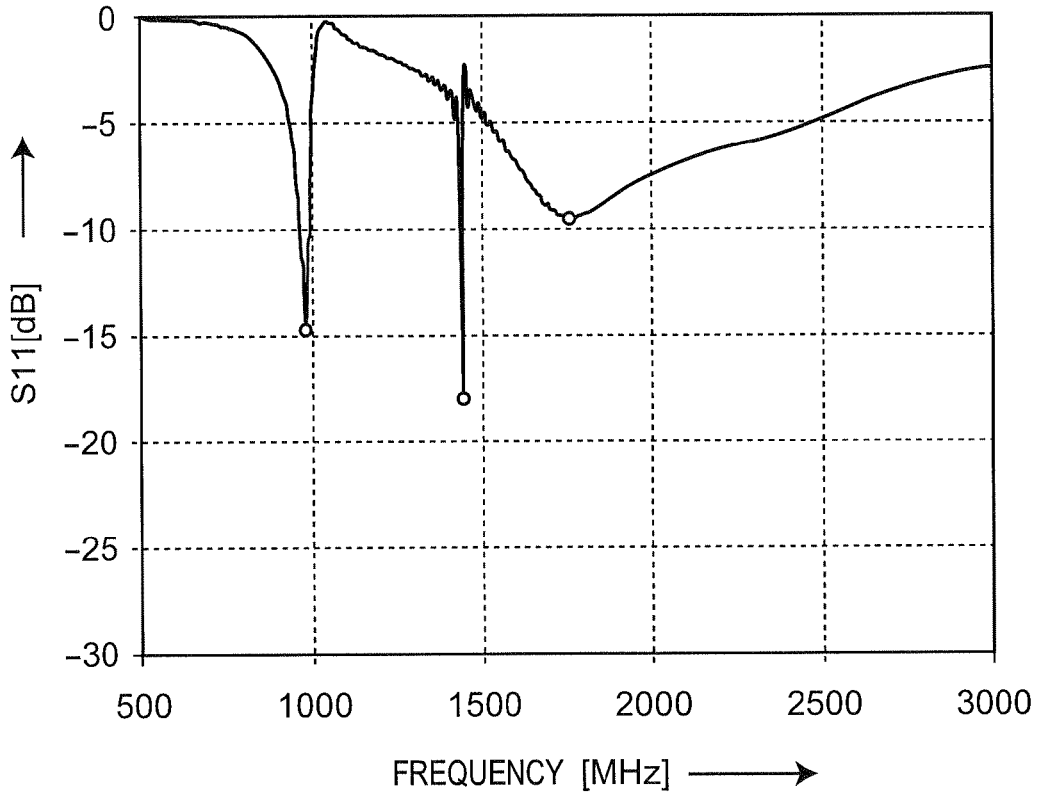
FIG. 76 is a graph showing a frequency characteristic of a reflection coefficient S11 for an antenna apparatus according to a seventh modified embodiment of the second implementation example.

FIG. 76 is a graph showing a frequency characteristic of a reflection coefficient S11 for an antenna apparatus according to a seventh modified embodiment of the second implementation example. FIG. 76 shows a frequency characteristic of a reflection coefficient S11 for an antenna apparatus according to an implementation example of the antenna apparatus shown in FIG. 20. A radiator of the antenna apparatus according to FIG. 76 is configured in a similar manner as that of the radiator 171 of FIG. 57 except for the positions of inductors L1 and L2 and capacitors C1 and C2. According to the computation results, it can be seen that the antenna apparatus is matched at three frequencies: f1=975 MHz (−14.8 dB), f2=1440 MHz (−18.2 dB), and f3=1760 MHz (−9.6 dB).

Figure 77:
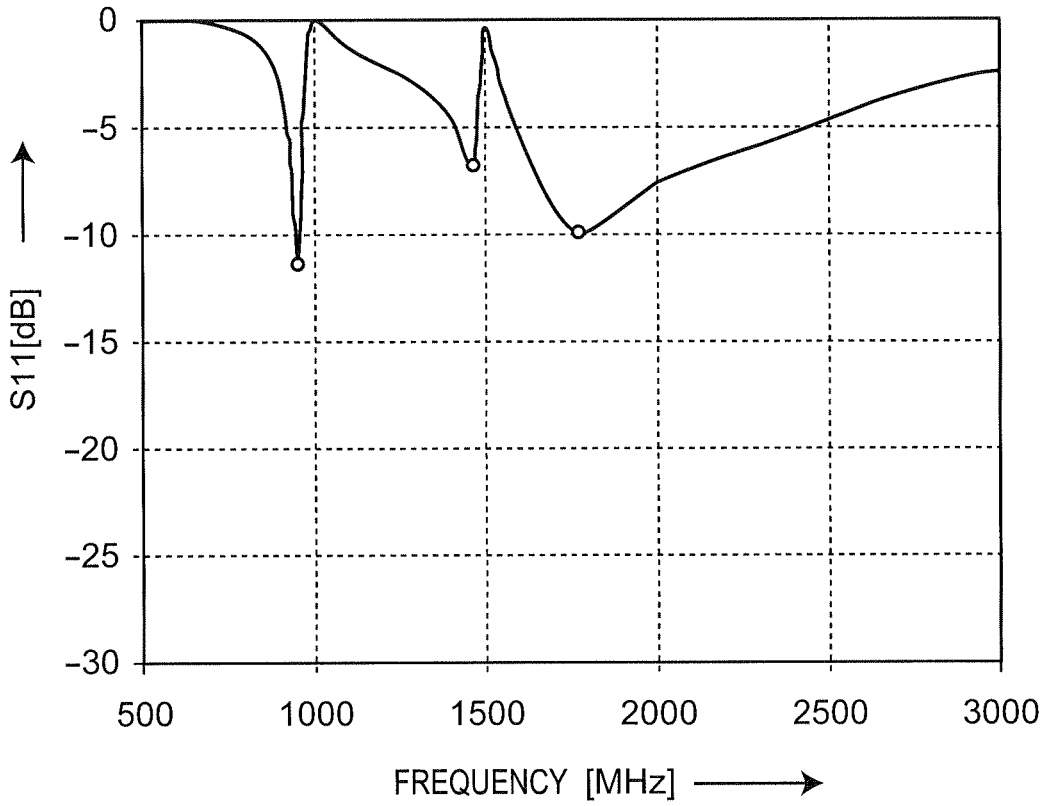
FIG. 77 is a graph showing a frequency characteristic of a reflection coefficient S11 for the antenna apparatus according to the first modified embodiment of the second implementation example.

FIG. 77 is a graph showing a frequency characteristic of a reflection coefficient S11 for the antenna apparatus according to the first modified embodiment of the second implementation example (FIG. 64). According to the computation results, it can be seen that the antenna apparatus is matched at three frequencies: f1=948 MHz (−11.5 dB), f2=1466 MHz (−6.9 dB), and f3=1778 MHz (−9.9 dB).

Figure 78:
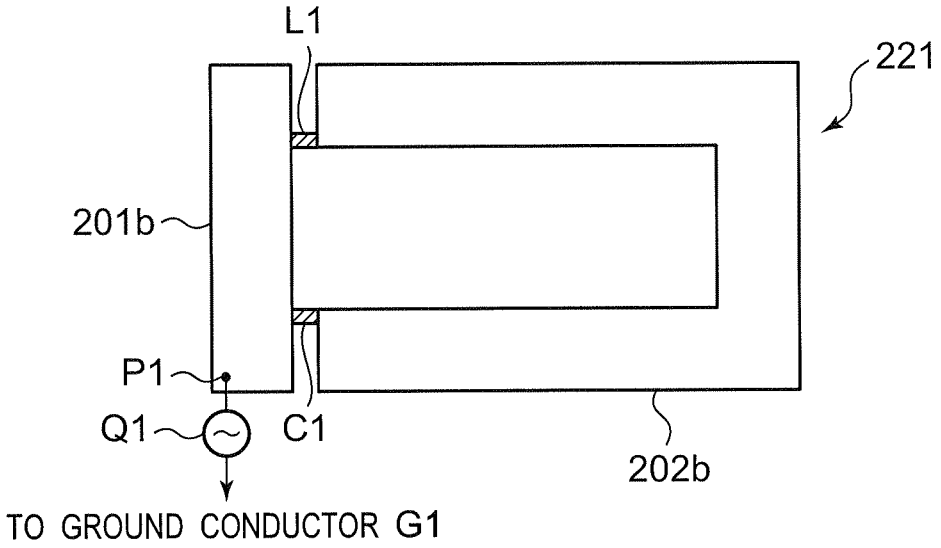
FIG. 78 is a plan view showing an antenna apparatus according to a first comparison example of the second implementation example.

FIG. 78 is a plan view showing an antenna apparatus according to a first comparison example of the second implementation example. A radiator 221 of the antenna apparatus of FIG. 78 is provided with radiation conductors 201*b* and 202*b*, an inductor L1, and a capacitor C1. The antenna apparatus of FIG. 78 is configured with the same dimensions as the antenna apparatus of FIG. 57 except that the antenna apparatus does not have a small loop, and is provided on a ground conductor G1, instead of the radiator 171 of FIG. 56.

Figure 79:
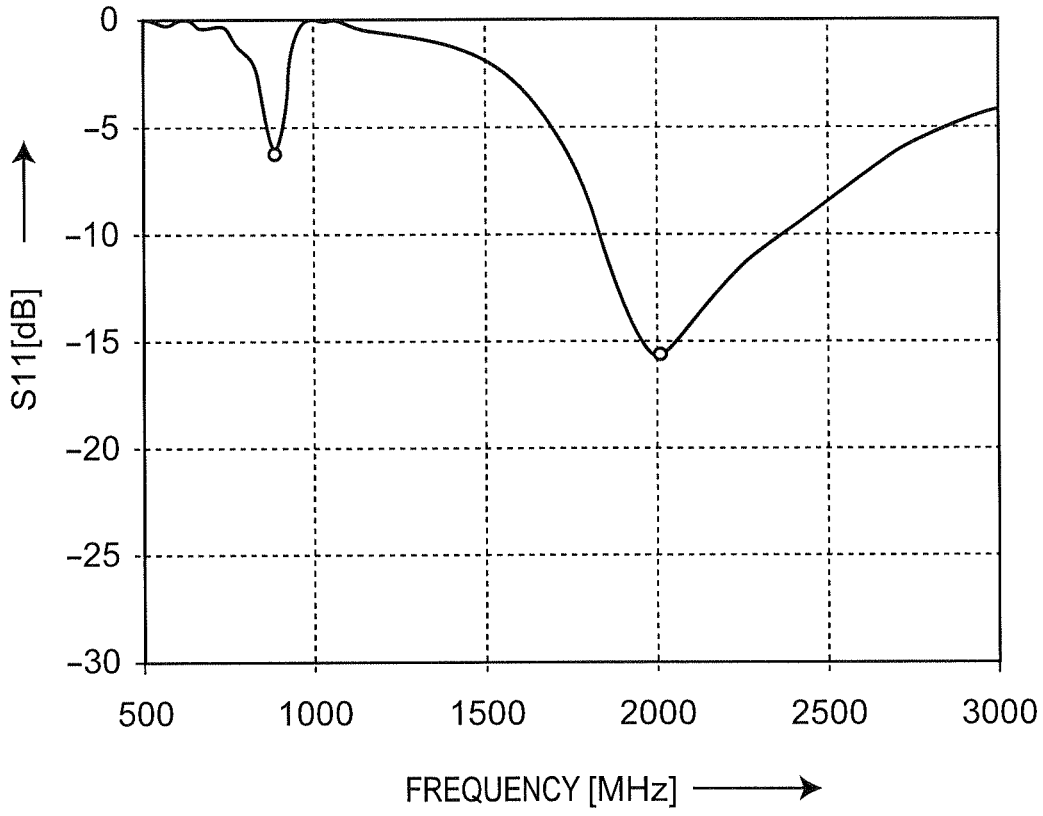
FIG. 79 is a graph showing a frequency characteristic of a reflection coefficient S11 for the antenna apparatus of FIG. 78.

FIG. 79 is a graph showing a frequency characteristic of a reflection coefficient S11 for the antenna apparatus of FIG. 78. According to the computation results, it can be seen that the antenna apparatus is matched at two frequencies: f1=893 MHz (−6.3 dB) and f3=2013 MHz (−15.8 dB).

Figure 80:
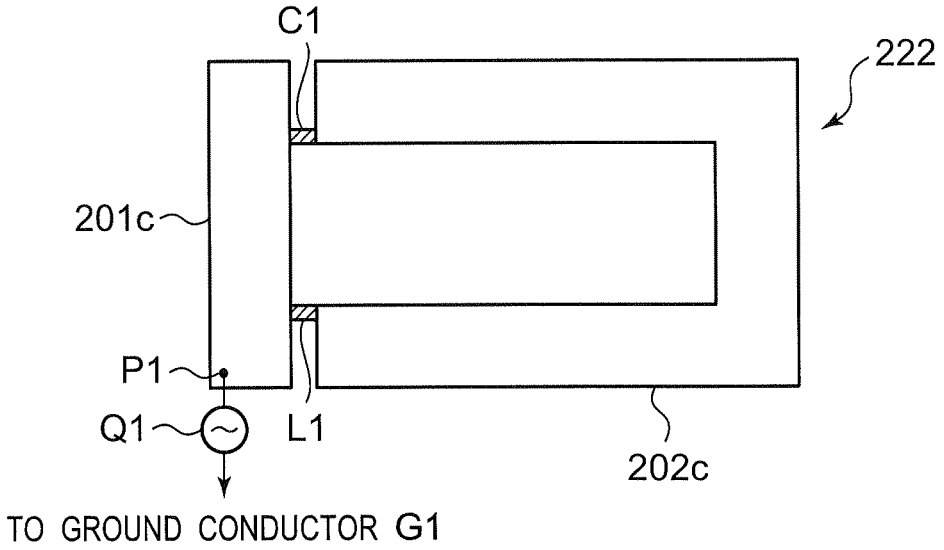
FIG. 80 is a plan view showing an antenna apparatus according to a second comparison example of the second implementation example.

FIG. 80 is a plan view showing an antenna apparatus according to a second comparison example of the second implementation example. A radiator 222 of the antenna apparatus of FIG. 80 is provided with radiation conductors 201*c* and 202*c*, an inductor L1, and a capacitor C1. The antenna apparatus of FIG. 80 is configured in a similar manner as that of the antenna apparatus of FIG. 78 except that the positions of the inductor L1 and the capacitor C1 are changed with each other.

Figure 81:
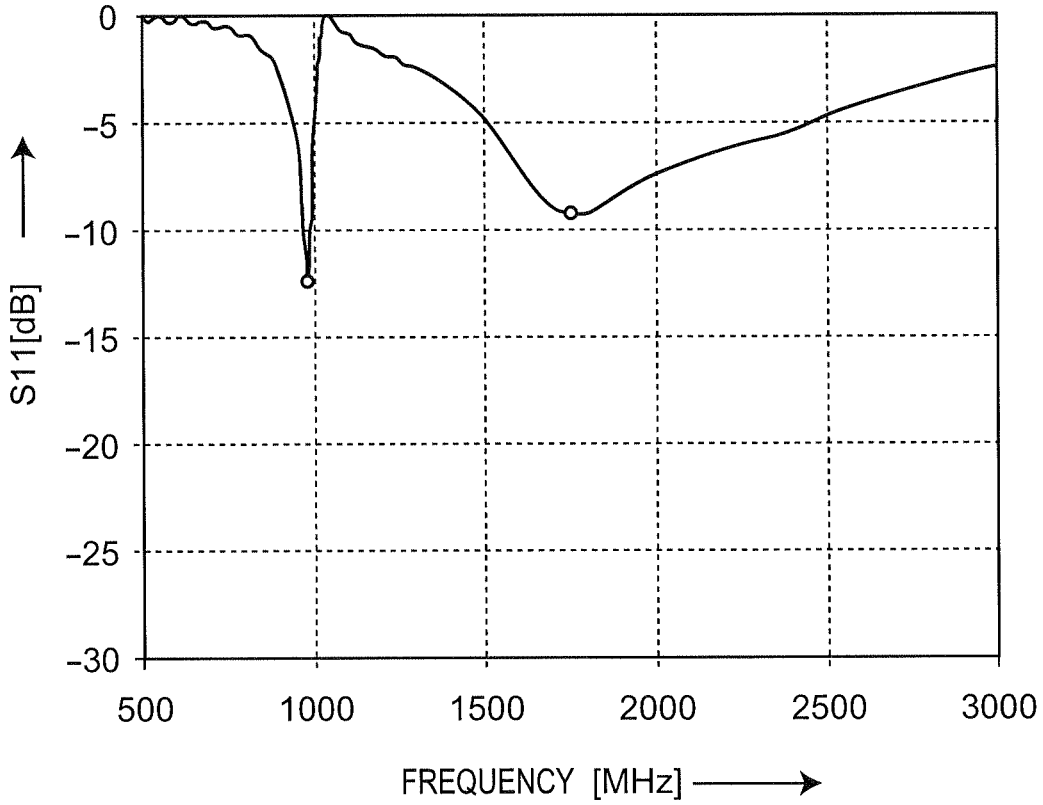
FIG. 81 is a graph showing a frequency characteristic of a reflection coefficient S11 for the antenna apparatus of FIG. 80.

FIG. 81 is a graph showing a frequency characteristic of a reflection coefficient S11 for the antenna apparatus of FIG. 80. According to the computation results, it can be seen that the antenna apparatus is matched at two frequencies: f1=985 MHz (−12.5 dB) and f3=1745 MHz (−9.3 dB).

Comparing FIGS. 79 with 81, it can be seen that both the antenna apparatus, one having the inductor L1 close to the feed point P1 and the other having the capacitor C1 close to the feed point P1, can achieve dual-band operation. However, their resonance frequency differs, because of the difference in the electrical lengths from the feed point P1 to the inductor L1 and to the capacitor C1.

Comparing FIGS. 79 and 81 with FIGS. 74 and 70, respectively, the similar frequency characteristic of the reflection coefficient S11 is found near the low-band resonance frequency f1 and near the high-band resonance frequency f3. Accordingly, It can be seen that even when a small loop is added to the antenna apparatus of FIG. 78 or 80, its dual-band operation is not impaired, and the antenna apparatus can further resonate at the mid-band resonance frequency f2, as long as the positions, inductance, and capacitance of the inductor L1 and the capacitor C1 are the same. In addition, the antenna apparatus can resonate at the substantially the same mid-band resonance frequency f2, regardless of the positions of the inductor L1 and the capacitor C1, and in the case of FIG. 74: f2=1435 MHz; and in the case of FIG. 70: f2=1417 MHz. In order to finely adjust only the mid-band resonance frequency f2, the value of the capacitor C2 can be adjusted.

INDUSTRIAL APPLICABILITY

As described above, antenna apparatuses of the present invention are operable in multiple bands, while having a simple and small configuration. In addition, when including a plurality of radiators, the antenna apparatuses of the present invention have low coupling between antenna elements, and is operable to simultaneously transmit or receive a plurality of radio signals.

The antenna apparatuses of the present invention and wireless communication apparatuses using the antenna apparatuses can be implemented as, for example, mobile phones, wireless LAN apparatuses, PDAs, etc. The antenna apparatuses can be mounted on, for example, wireless communication apparatuses for performing MIMO communication. In addition to MIMO, the antenna apparatuses can also be mounted on (multi-application) array antenna apparatuses capable of simultaneously performing communications for a plurality of applications, such as adaptive array antennas, maximal-ratio combining diversity antennas, and phased-array antennas.

REFERENCE SIGNS LIST

1, 1*a* to 1*k*, 2, 2*a* to 2*k*, 3, 3*a* to 3*k*, 5, 6, 7, 1A, 2A, 3A, 1B, 2B, 3B, 201, 202, 201*a* to 201*c*, and 202*a* to 202*c*: RADIATION CONDUCTOR,

71: WIRELESS TRANSMITTING AND RECEIVING CIRCUIT,

72: BASEBAND SIGNAL PROCESSING CIRCUIT,

73: SPEAKER,

74: MICROPHONE,

101 to 106, 111 to 116, 121, 131 to 136, 141 to 145, 151 to 156, 161, 171, 172, 200, 211, 221, and 222: RADIATOR, C1, C2, C11, C12, C13, C14, CIA, C2A, C1B, and C2B: CAPACITOR, G1 and G2: GROUND CONDUCTOR, L1, L2, L11, L12, L13, L14, L1A, L2A, L1B, and L2B: INDUCTOR, P1, HA, and P1B: FEED POINT, P2, P2A, and P2B: CONNECTING POINT, Q1, Q2, Q11, Q1A, and Q1B: SIGNAL SOURCE,

S1: STRIP CONDUCTOR.

The invention claimed is:

1. An antenna apparatus comprising at least one radiator, wherein each of the at least one radiator comprises:

a looped radiation conductor forming a first loop, and having a feed point, a first position, a second position, and a third position, which are arranged in this order along the first loop;

a first inductor inserted at the first position of the radiation conductor;

a first capacitor inserted at the third position of the radiation conductor; and a second inductor and a second capacitor inserted parallel to each other at the second position of the radiation conductor, wherein a second loop is formed by the second position of the radiation conductor, portions of the radiation conductor close to the second position, the second inductor, and the second capacitor, wherein each of the at least one radiator is excited through the feed point at at least two of a first frequency, a second frequency higher than the first frequency, and a third frequency higher than the second frequency, wherein each of the at least one radiator includes:

(A) a first portion of the radiator along the first loop, the first portion including the first inductor, the first capacitor, and one of the second inductor and the second capacitor;

(B) a second portion of the radiator including a section along the first loop, the section extending from the feed point to the second position through one of the first inductor and the first capacitor, and the second portion including the second loop; and (C) a third portion of the radiator including a section along the first loop, the section extending from the feed point to the second position through the first capacitor, or the section extending from the feed point to the first position through the first capacitor and one of the second inductor and the second capacitor, and wherein each of the at least one radiator is configured such that at least two of the first, second, and third portions resonate, and the radiator resonates at the first frequency when the first portion resonates, the radiator resonates at the second frequency when the second portion resonates, and the radiator resonates at the third frequency when the third portion resonates.

2. The antenna apparatus as claimed in claim 1, wherein the radiation conductor includes a first radiation conductor and a second radiation conductor, and wherein at least one of the first and second capacitors is formed by a capacitance between the first and second radiation conductors.

3. The antenna apparatus as claimed in claim 1, wherein at least one of the first and second capacitors includes a plurality of capacitors connected in series.

4. The antenna apparatus as claimed in claim 1, wherein at least one of the first and second inductors includes an inductor made of a strip conductor.

5. The antenna apparatus as claimed in claim 1, wherein at least one of the first and second inductors includes an inductor made of a meander conductor.

6. The antenna apparatus as claimed in claim 1, wherein at least one of the first and second inductors includes a plurality of inductors connected in series.

7. The antenna apparatus as claimed in claim 1, further comprising a ground conductor.

8. The antenna apparatus as claimed in claim 7, comprising:

a printed circuit board comprising the ground conductor, and a feed line connected to the feed point, wherein the radiator is formed on the printed circuit board.

9. The antenna apparatus as claimed in claim 1, wherein the antenna apparatus is a dipole antenna including at least a pair of radiators.

10. The antenna apparatus as claimed in claim 1, wherein the antenna apparatus comprises a plurality of radiators, and the plurality of radiators resonate different first frequencies, different second frequencies, and different third frequencies, respectively.

11. The antenna apparatus as claimed in claim 1, wherein the radiation conductor is bent at at least one position.

12. The antenna apparatus as claimed in claim 1, wherein the antenna apparatus comprises a plurality of radiators connected to different signal sources.

13. The antenna apparatus as claimed in claim 12, comprising a first radiator and a second radiator configured symmetrically with respect to a reference axis, wherein a first inductor of the second radiator is provided at a position corresponding to a position of a first capacitor of the first radiator, and a first capacitor of the second radiator is provided at a position corresponding to a position of a first inductor of the first radiator.

14. The antenna apparatus as claimed in claim 13, wherein a second inductor of the second radiator is provided at a position corresponding to a position of a second capacitor of the first radiator, and a second capacitor of the second radiator is provided at a position corresponding to a position of a second inductor of the first radiator.

15. The antenna apparatus as claimed in claim 12, wherein the first and second radiators are shaped such that a distance between the first and second radiators gradually increases as a distance from the feed points of the first and second radiators along the reference axis increases.

16. A wireless communication apparatus comprising an antenna apparatus wherein the antenna apparatus comprising at least one radiator, wherein each of the at least one radiator comprises:

a looped radiation conductor forming a first loop, and having a feed point, a first position, a second position, and a third position, which are arranged in this order along the first loop;

a first inductor inserted at the first position of the radiation conductor;

a first capacitor inserted at the third position of the radiation conductor; and a second inductor and a second capacitor inserted parallel to each other at the second position of the radiation conductor, wherein a second loop is formed by the second position of the radiation conductor, portions of the radiation conductor close to the second position, the second inductor, and the second capacitor, wherein each of the at least one radiator is excited through the feed point at at least two of a first frequency, a second frequency higher than the first frequency, and a third frequency higher than the second frequency, wherein each of the at least one radiator includes:

(A) a first portion of the radiator along the first loop, the first portion including the first inductor, the first capacitor, and one of the second inductor and the second capacitor;

(B) a second portion of the radiator including a section along the first loop, the section extending from the feed point to the second position through one of the first inductor and the first capacitor, and the second portion including the second loop; and (C) a third portion of the radiator including a section along the first loop, the section extending from the feed point to the second position through the first capacitor, or the section extending from the feed point to the first position through the first capacitor and one of the second inductor and the second capacitor, and wherein each of the at least one radiator is configured such that at least two of the first, second, and third portions resonate, and the radiator resonates at the first frequency when the first portion resonates, the radiator resonates at the second frequency when the second portion resonates, and the radiator resonates at the third frequency when the third portion resonates.

* * * * *